US011794122B1

(12) United States Patent
Choi

(10) Patent No.: US 11,794,122 B1
(45) Date of Patent: Oct. 24, 2023

(54) CRANE ARM EXTENSION MECHANISM FOR TOY TRUCK

(71) Applicant: Maison Battat, Inc., Montreal (CN)

(72) Inventor: Man Wa Choi, Fanling (CN)

(73) Assignee: MAISON BATTAT, INC., Montreal (CA)

( * ) Notice: Subject to any disclaimer, the term of this patent is extended or adjusted under 35 U.S.C. 154(b) by 50 days.

(21) Appl. No.: 17/380,917

(22) Filed: Jul. 20, 2021

(51) Int. Cl.

| | |
|---|---|
| ***A63H 17/12*** | (2006.01) |
| ***A63H 17/26*** | (2006.01) |
| ***A63H 29/16*** | (2006.01) |
| ***A63H 30/06*** | (2006.01) |
| ***A63H 17/05*** | (2006.01) |
| ***A63H 31/08*** | (2006.01) |

(52) U.S. Cl.
CPC ..... *A63H 17/12* (2013.01); *A63H 17/26* (2013.01); *A63H 29/16* (2013.01); *A63H 30/06* (2013.01); *A63H 31/08* (2013.01); *A63H 17/05* (2013.01)

(58) Field of Classification Search
CPC ..... A63H 17/12; A63H 17/26; A63H 17/05; A63H 31/08; A63H 33/3044; A63H 29/16; A63H 30/06
See application file for complete search history.

(56) References Cited

U.S. PATENT DOCUMENTS 4,388,776 A * 6/1983 Spring ..... F01B 17/02 446/197
4,552,274 A * 11/1985 Lundin ..... A63H 17/12 446/427
4,592,474 A * 6/1986 Rathe ..... B66C 23/701 212/292
5,413,515 A * 5/1995 Knox ..... A63H 17/12 446/85
6,568,984 B1 * 5/2003 Applewhite ..... A63H 30/06 446/379
6,800,014 B2 * 10/2004 Dominici ..... A63H 3/48 446/338
6,805,606 B1 * 10/2004 Kellum ..... A63H 3/36 92/92
6,978,974 B1 * 12/2005 Marasco ..... A63B 71/023 473/429

(Continued)

FOREIGN PATENT DOCUMENTS

CN 207270711 U * 4/2018
CN 208885720 U * 5/2019
GB 2375971 A * 12/2002 ..... A63H 30/06

OTHER PUBLICATIONS

Translation CN207570711U (Year: 2018).*

(Continued)

*Primary Examiner* — Eugene L Kim
*Assistant Examiner* — Alyssa M Hylinski
(74) *Attorney, Agent, or Firm* — Andrew S. Langsam

(57) ABSTRACT

A toy truck having a crane arm, comprising multiple telescopic components to form a crane extension mechanism. The crane arm extension mechanism includes a crane arm that is capable of telescopically extending based on the air pressure manually provided to fill telescopic members of the crane arm. To telescopically extend the crane arm, a crank is rotated which causes an air pump to pump air into the crane arm. As the air pressure in the crane arm increases, the crane arm telescopically extends.

10 Claims, 40 Drawing Sheets

(56) References Cited

U.S. PATENT DOCUMENTS

| | | | | |
|---|---|---|---|---|
| 2012/0045964 | A1* | 2/2012 | Ibarra | A63H 17/05 446/465 |
| 2018/0328387 | A1* | 11/2018 | Landberg | B66C 23/708 |
| 2019/0318673 | A1* | 10/2019 | Newton | G09F 19/08 |
| 2020/0261784 | A1* | 8/2020 | Balingit | A63B 71/023 |

OTHER PUBLICATIONS

Translation CN208885720U (Year: 2019).*
MU8901944U2 w/ translation (Year: 2010).*
GB2375971A w/ translation (Year: 2002).*
MU89019440U2 (Year: 2010).*

* cited by examiner

CRANE ARM EXTENSION MECHANISM FOR TOY TRUCK

TECHNICAL FIELD

The present application relates to a toy truck, particularly a toy truck including a crane arm extension mechanism that is operated using air.

BACKGROUND

Many children's toys are based upon real-world vehicles. For example, there are toy versions of automobiles, aircrafts, construction vehicles and sea vessels. While the toy versions of the aforementioned vehicles closely resemble their real-life and generally much larger, heavier and expensive counterparts, these toys may not necessarily have to be as detailed or even operate in the same manner. But, the features or utility aspects of the toys are often quite simulative and closely resembling those of the closely resembling counterparts. In other words, the toy versions may operate differently but still simulate, especially to a child, the features that are present in the real-life vehicles. The reason for the existence of the features results from the intended audience, i.e., children, who are to receive such toys. The features may be for entertaining or for enhancing the minds of children. As such, the toys may include novel characteristics that are for the benefit of children, rather than for conforming to the actual manner or functioning of the real-life vehicles to which they are based upon. The present invention is directed to a large construction vehicle toy with an extendable arm which operates in a manner to simulate a real crane in the construction industry but which substantially only extends and contracts by use of air, and compressed air, created by simple manual pumping, not be a motor or electric batteries or power.

SUMMARY

In general, in one aspect, exemplary embodiments of the present application provide an extendable crane arm mechanism for a toy construction truck. The extendable crane arm mechanism comprising a plurality of telescopic extension members, each of the plurality of extension members being slidably held within a hollow interior of a preceding extension member, the plurality of extension members being capable of moving from a retracted position to a partially and then full extended position, a plurality of boom members, each of the plurality of boom members being slidably held within a hollow interior of a succeeding extension member, the plurality of boom members being capable of moving from a retracted position to an extended position, and an air pump mechanism, operable by the child, which provides air, under pressure, into the plurality of extensions to cause the plurality of extension members to move from their fully retracted position to partially and/or fully extended positions. Allowing the child to turn a crank handle to extend and retract the boom extensions adds to the enjoyment of the toy and provides a sense of "doing the work" for the child, all adding to the play value of the toy.

Implementations of the various exemplary embodiments of the present application may include one or more of the following features. The extendable crane arm mechanism further comprises a cord having a first end and a second end. The extendable crane arm mechanism further comprises a hook mechanism connected to one or more of the plurality of boom members, the hook mechanism having a hook that is attached to the second end of the cord. The hook is realistic looking and can be useful in playing, picking up and delivering toy construction pieces, e.g., toy beams, walls, etc. The extendable crane arm mechanism further comprises a mechanical and manual winding mechanism connected to the air pump, such that rotation of the winding mechanism causes the air pump to repeatedly press air into the plurality of extension members, the winding mechanism having a winding portion that is attached to the first end of the cord, wherein the cord is capable of being wound or unwound around the winding portion or spool. The extendable crane arm mechanism further comprises a crank attached to the winding mechanism, wherein rotation of the crank in a first direction causes the plurality of extension members to move from a retracted position to a partial or fully extended position and causes the cord to unwind from around the winding portion, and wherein rotation of the crank in a second direction causes the plurality of extension members to move from a partial or fully extended position to a partial or fully retracted position and causes the cord to wind around the winding portion. Realistic play is provided to a child, while ensuring interactive use by the child with the toy—something that almost always adds to play value.

The extendable crane arm mechanism for the toy construction vehicle further comprises a one way air check valve disposed between the manually operated air pump and the plurality of extension members, so as to permit air pressed into the plurality of extension members from flowing in reverse backwardly towards the air pump, thereby maintaining air pressure within the plurality of extension members, and preventing the plurality of extension members from moving from an extended position to a relatively retracted position. The plurality of extension members include an air release valve that is capable of selectively activating to release air from within the plurality of extension members, thereby permitting the plurality of extension members to move from an extended position to a relatively retracted position. The release valve includes a release pin that causes the release valve to activate or open for releasing air when the release pin is moved from a non-releasing position to a releasing position, the release pin being connected to a biased spring that maintains the release pin in a non-releasing position until activated, as desired. The movement of the plurality of extension members from the retracted position to the extended position causes the movement of the plurality of boom members to change from the retracted position to the extended position. The extended position causes the movement of the plurality of boom members to change from the extended position to the retracted position.

In general, in one aspect, exemplary embodiments of the present application provide a toy. The toy comprises a toy truck including a cab and a flatbed body, and an extendable crane arm mechanism connected to the flatbed body. The extendable crane arm mechanism comprises a plurality of extension members, each of the plurality of extension members being slidably held (telescopic) within a hollow interior of a preceding extension member, the plurality of extension members being capable of moving from a partially or fully retracted position to a partially or fully extended position, a plurality of boom members, each of the plurality of extension members being slidably held within a hollow interior of a succeeding boom member, the plurality of boom members being capable of moving from a relatively retracted position to an extended position, and an air pump to selectively press compressed air into the plurality of extension members to cause the plurality of extension members to move from a partially retracted position to a full or partially extended position.

Implementations of the various exemplary embodiments of the present application may include one or more of the following features. The extendable crane arm mechanism further comprises a cord having a first end and a second end. The extendable crane arm mechanism further comprises a hook mechanism connected to plurality of boom members, the hook mechanism having a hook that is attached to the second end of the cord. The extendable crane arm mechanism further comprises a winding mechanism connected to the air pump, such that rotation of the winding mechanism causes the air pump to repeatedly press air into the plurality of extension members, the winding mechanism having a winding portion that is attached to the first end of the cord, wherein the cord is capable of being wound or unwound around the winding portion—similar to winding on a spool. The extendable crane arm mechanism further comprises a rotatable hand crank attached to the winding mechanism, wherein rotation of the crank in a first direction causes the plurality of extension members to move from a retracted position to an extended position and causes the cord to unwind from around the winding portion or spool, and wherein rotation of the crank in a second direction causes the plurality of extension members to move from an extended position to a retracted position and causes the cord to wind around the winding portion or spool for storage.

The extendable crane arm mechanism further comprises a check valve disposed between the air pump and the plurality of extension members, so as to permit air pressed into the plurality of extension members from flowing in reverse back towards the air pump, thereby maintaining air pressure within the plurality of extension members, and preventing the plurality of extension members from unintentionally moving from an extended position to a retracted position. The plurality of extension members include a release valve that is capable of activating to release air from within the plurality of extension members, thereby permitting the plurality of extension members to move from an extended position to a retracted position but only when desired. The release valve includes a release pin that causes the release valve to activate for releasing air when the release pin is moved from a non-releasing position to a releasing position, the release pin being connected to a spring that biases and maintains the release pin in a non-releasing position. The movement of the plurality of extension members from the retracted position to the extended position causes the movement of the plurality of boom members of the toy crane from the retracted position to the extended position. The extended position the movement of the plurality of boom members from the extended position to the retracted position.

BRIEF DESCRIPTION OF THE DRAWINGS

The aforementioned and other aspects, features and advantages can be more readily understood from the following detailed description with reference to the accompanying drawings wherein.

Figure 1:
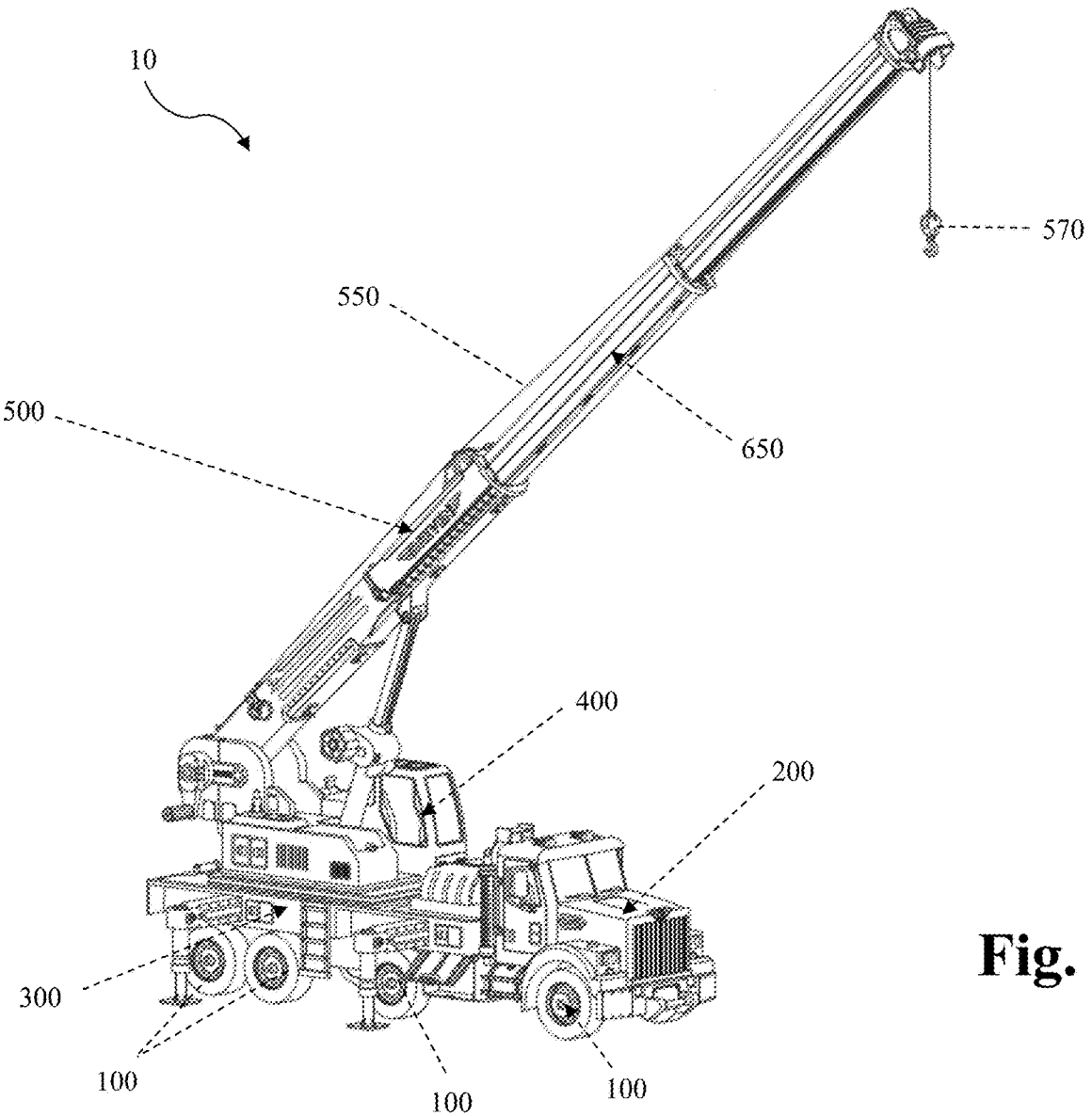
FIG. 1 shows a toy truck having an extendable crane arm mechanism, according to an embodiment of the present application.

DETAILED DESCRIPTION OF THE INVENTION AND THE PREFERRED EMBODIMENT OF THE FIGURES

In describing preferred embodiments illustrated in the drawings, specific terminology is employed herein for the sake of clarity. However, this disclosure is not intended to be limited to the specific terminology so selected and it is to be understood that each specific element includes all technical equivalents that operate in a similar manner. In addition, a detailed description of known functions and configurations is omitted from this specification when it may obscure the inventive aspects described herein.

Figure 2:
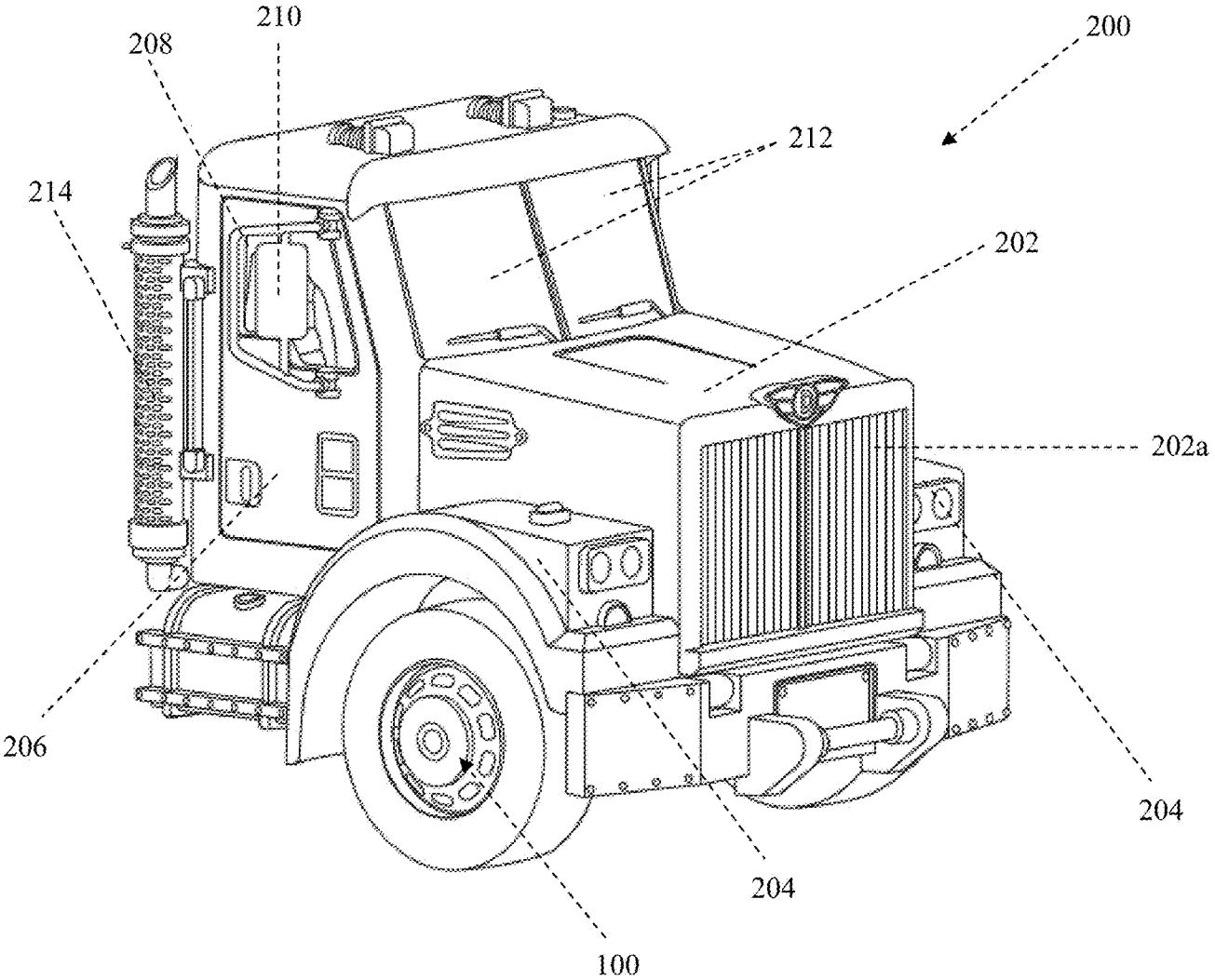
FIG. 2 shows a partial detailed view of a cab of the toy truck.

Referring now to the drawings and Figures, wherein like reference numerals designate identical or corresponding parts throughout the several views, FIG. 1 shows a toy truck 10 having one or more wheels 100 rotatable on axles, a freot cab 200, a flatbed rearwardly located body 300, a crane operator cabin 400 and an extendible crane arm 500. As shown in FIG. 2, the front cab 200 includes one or more wheels 100, a cab front or hood 202 for a toy engine, one or more wheel fenders 204, one or more cab doors 206, one or more side windows 208, one or more side-view mirrors 210, a split windshield 212 and one or more exhaust pipes 214, all intended to realistically resemble a real construction vehicle The cab front or hood 202 represents the location where an actual engine would be held. The cab hood or front 202 also includes a grill 202*a*. A wheel fender 204 is secured to each side of the cab hood or front 202. Below each fender 204 is a wheel 100 that is connected beneath the cab to a rotatable axle. In addition, the split windshield 212 extends vertically and rearwardly from the cab hood or front 202. Each of the cab doors 206 includes a side window 208 and a side-rearview mirror 210. The one or more exhaust pipes 214 are vertically attached to the back of the cab 200. Again, all of these components can be operational or merely decorative but are intended to resemble a real construction vehicle and its components. This adds to play value for the child.

Figure 3:
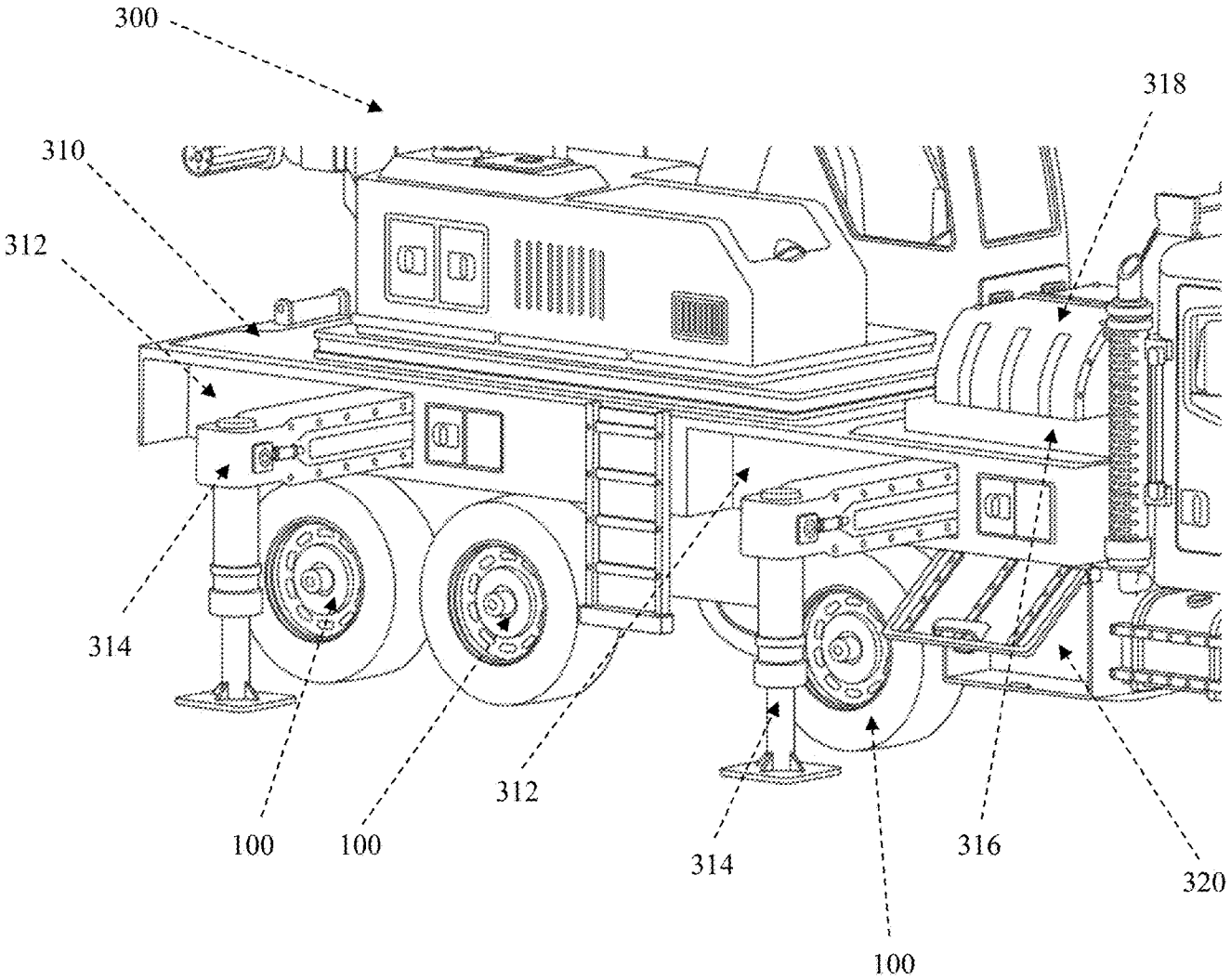
FIG. 3 shows a partial detailed view of a flatbed body of the toy truck.

As shown in FIG. 3, the flatbed body 300 is located rearwardly of the front cab and comprises a vertical master hinge to allow the flatbed body to rotate from side to side with respect to the front cab. This between the cab and the front of the flatbed body to allow a child to play with the construction vehicle and "drive" it from location to location. The flatbed body will follow the cab, just as a construction vehicle operates on a real road. The flatbed further includes a horizontal support platform 310, one or more side cavities 312, one or more outriggers 314, a bucket holder 316, a bucket 318 and a storage compartment 320. Again, the components are intended to resemble the actual look and utility of a real construction vehicle of the crane type. The support platform 310 may have a flat surface for supporting the crane cabin 400 (see FIG. 1). In addition, the support platform includes the one or more cavities 312 thereon and provides connections (storage locations and vertical hinges) to the one or more outriggers 314. In addition, the support platform 310 is also connected to the one or more rear wheels 100 (again which are secured on the ends of axles). Each outrigger 314 includes a wing 314*a* (see FIG. 4A), leg holder 314*b*, a smaller diameter and telescopic leg 314*c* and a flat, rotatable platform or ground-engaging foot 314*d*. The wing 314 may have an elongated body with a first end and a second end. The first end of the wing 314 is rotatively secured to the flatbed and its free end is hingedly connected to the leg holder 314*b*. The leg holder 314*b* may include a hollow body that includes a spring (not shown) and a locking mechanism (not shown). The leg 314*c* may include a first end connected to the spring and a second end connected to the ground engaging foot 314*d*. The foot 314*d* may be a substantially flat plate. The leg 314*c* is capable of moving from an upward locked position to a lowered unlocked position, and vice versa. The spring (contained within the leg 314*b*) is an elastic device (e.g., coil spring) that is held entirely within the leg holder 314*b*. The spring is movable between a compressed state and an uncompressed state. In the uncompressed state, the spring pushes the leg 314*c* away from the leg holder 314*b*, such that the leg 314*c* is in an unlocked and lowered position. In the compressed state, the spring is compressed due to an interaction between the locking mechanism and the leg 314*c*. When the leg 314*c* is pushed in a direction that compresses the spring toward a holding position, the leg 314*c* becomes substantially and telescopically held within the hollow body of the leg holder 314*b*. By rotating the leg 314*c* and the ground engaging plate in a first direction at the holding position, the leg 314*c* can cooperate with the locking mechanism to be in the upper and locked position. In other words, the leg 314*c* is held substantially within the hollow body of the leg holder 314*b*. The upper, locked position allows the construction toy/crane to drive from site to site but, once located as desired, the leg 314*c* can be pulled down (and unlocked) and the plate lowered to have contact between the plate and the ground of the worksite (just as in an actual construction). In one exemplary embodiment, the leg 314*c* may include a projection. The locking mechanism may include a groove on the internal walls of the leg holder 314*b*. When the leg 314*c* rotates, the projection of the leg 314*c* may enter the groove of the leg holder 314*b*. The groove of the leg holder 314*b* prevents the leg 314*c* from being overly pushed away from the leg holder 314*b* by the contained spring.

One end of the wing 314 is hingedly attached to the flat bed body 300. The wing 314 is capable of pivoting or rotating from a folded in position to an unfolded or outward position, and vice versa. In the unfolded position, the wing 314 preferably extends perpendicularly away from the flatbed body 300. To move to the folded in position, the wing 314 rotates about its hinge and toward the flatbed body 300 until the elongated body 314 is basically parallel with the flatbed body 300, and held in the storage cavity 314 of the flatbed body 300. The telescopic leg 314*c* is pushed in an upward direction that compresses the spring until the leg 314*c* reaches its retracted and storage and holding position. When the leg 314*c* reaches the holding position, the leg 314*c* is rotated until the leg 314*c* is capable of interacting with the locking mechanism. The locking mechanism holds the leg 314*c* in place, while simultaneously compressing the locking and holding spring.

Figure 4B:
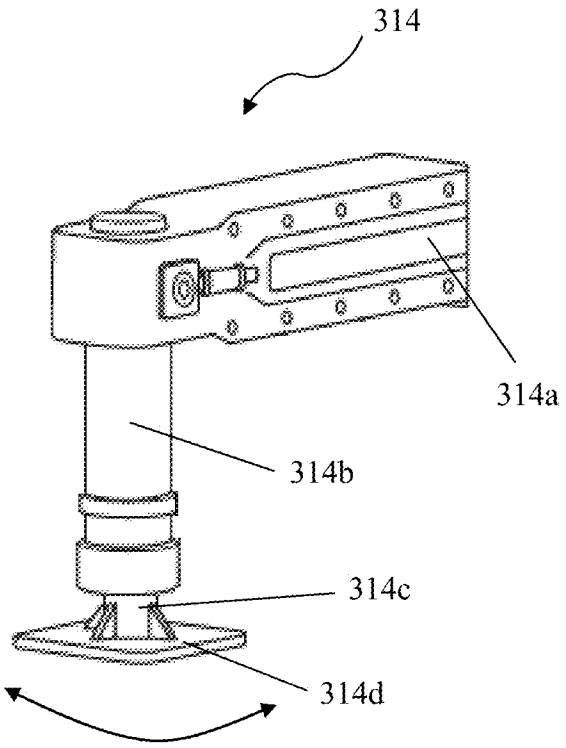
FIG. 4A-4B shows an outrigger attached to the flatbed body of the toy truck in an unlocked and ground engaging position and then in a locked and raised position.
Figure 4A:
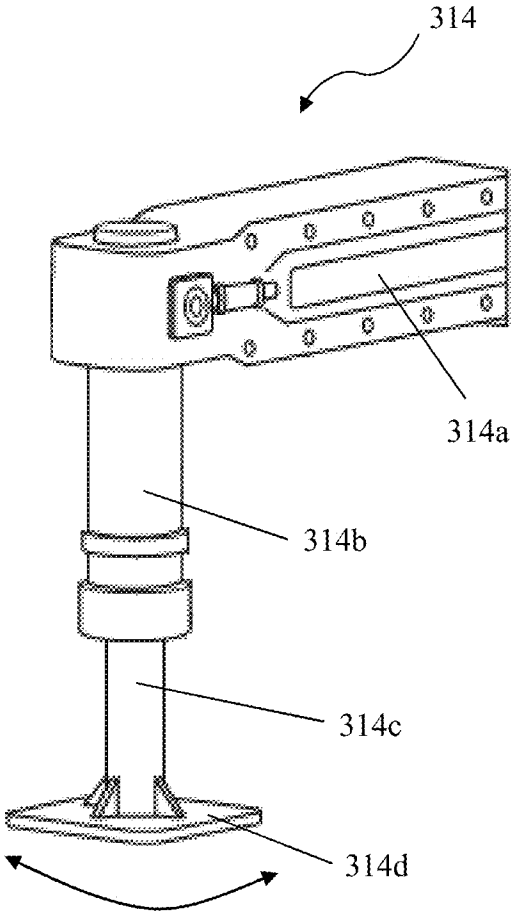

The outrigger 314 is capable of moving from an initial position to a ground stabilizing position, and vice versa. As illustrated in FIG. 4A, in the initial position, the wing 314 is in the folded-in and storage position, such that the leg 314*c* is substantially held within the leg holder 314*b* at the holding position and the leg 314 is within the cavity 312. The leg 314*c* is prevented from extending away from the holder 314*b* due to the locking mechanism. To move to the stabilizing position, the wing 314 is moved from the folded in position to the outward and unfolded position. After the wing 314 has moved to the unfolded position, the leg 314*c* is rotated in a second direction (opposite the first direction), which causes the leg 314*c* to be released from the locking mechanism, thereby permitting the spring to push the leg 314*c* away from the leg holder 314*b*. As a result, the outrigger 314 is now in the stabilizing or ground engaging position, as shown in FIG. 4A. The bucket holder 316 is disposed on the surface of the support platform 310. The bucket holder 315 is configured to hold a ground material collecting bucket 318. The bucket 318 may be a container that can hold objects. The bucket 318 may be removably attached to a hook on the proximal end of the crane arm 500.

Figure 5:
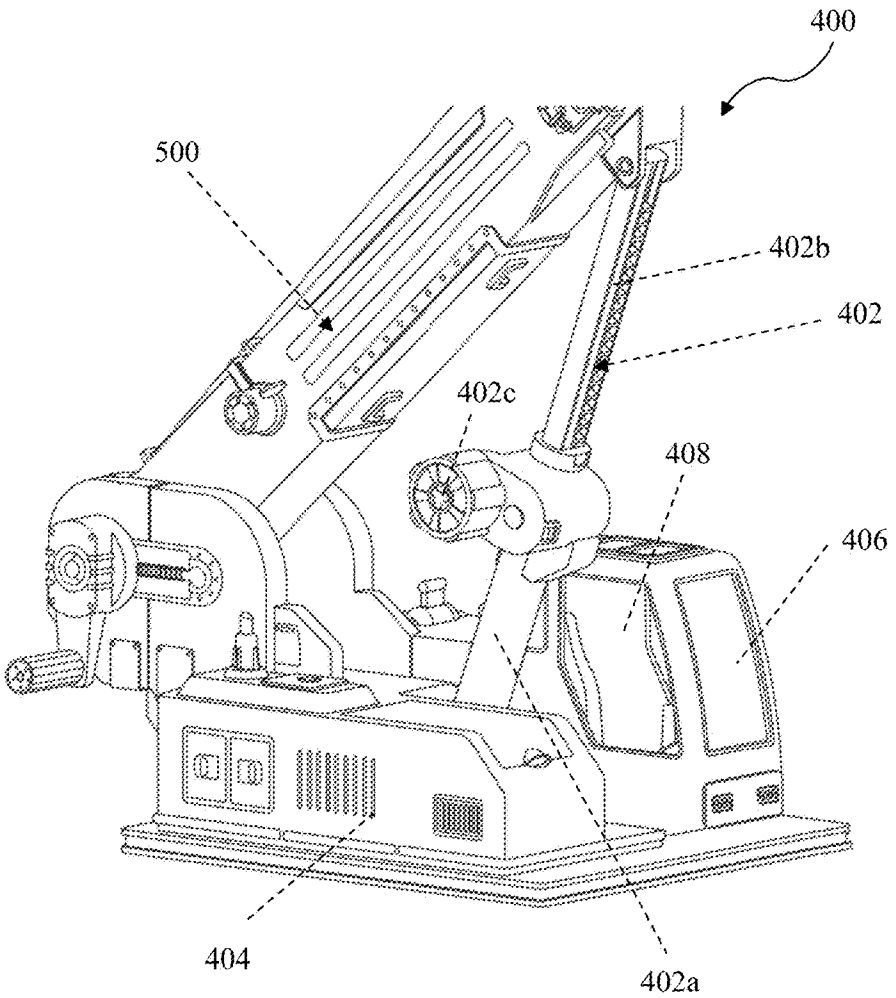
FIG. 5 shows a detailed view of the crane cabin that is attached to the flatbed body of the toy truck.

As shown in FIG. 5, the crane cabin 400 includes a crane arm angle or height adjuster 402, a mount 404 for mounting the proximal end of the crane arm 500, a front window 406, and a side window 408. The height adjuster 402 is in the form of a rack and pinion gear with the rack on the underside of the crane arm and the gear to cause the arm to elevate and be withdrawn being operated by a hand turning wheel 402*a*. The mechanism is connected between the crane cabin 400 and the underside of the crane arm. Indeed, there is a hinge connecting the rack to the crane arm, as shown in FIG. 5. Rotation of the wheel 402*c* will cause the rack to be extended or retracted which will cause the crane arm to elevate or drop down. The rack is connected to the mount 400 and to the crane arm 500. The rack container 402*a* is telescopic around the rack and is connected to the mount 400 and the rack 402*b* is connected at one end to the hinge of the crane arm 500. A substantial portion of the rack 402*b* is held within the rack container 402*a*. However, the rack 402*b* can extend away from the rack container 402*a* and/or retract towards and within the rack container 402*a*, depending on the rotation of and position of the gear and the desired angle/height selector or wheel 402*c*. For example, the height selector 402*c* may be a knob that is rotatable. The knob maybe connected to a pinion (circular internal gear) that cooperates with the teeth of the rack 402*b*. As such, when the height selector or turning knob 402*c* rotates in a first rotating direction, the internal pinion also rotates, causing the rack 402*b* to move in an upward direction away from the rack container 402*a*. The upward movement of the rack 402*b* causes the crane arm 500 to correspondingly move in an upward direction. Likewise, when the height and angle selector or turning knob 402*c* rotates in a second and opposite rotating direction, the pinion or internal gear again rotates, causing the rack 402*b* to move in a relative downward direction. The downward movement of the rack 402*b* causes the crane arm 500 to correspondingly move in a downward direction allowing the crane arm to be lowered. And, of course, the crane arm, suspended by the hinge at the end of the rack, moves up and down, secured at the end of the crane arm at its rear.

Figure 6:
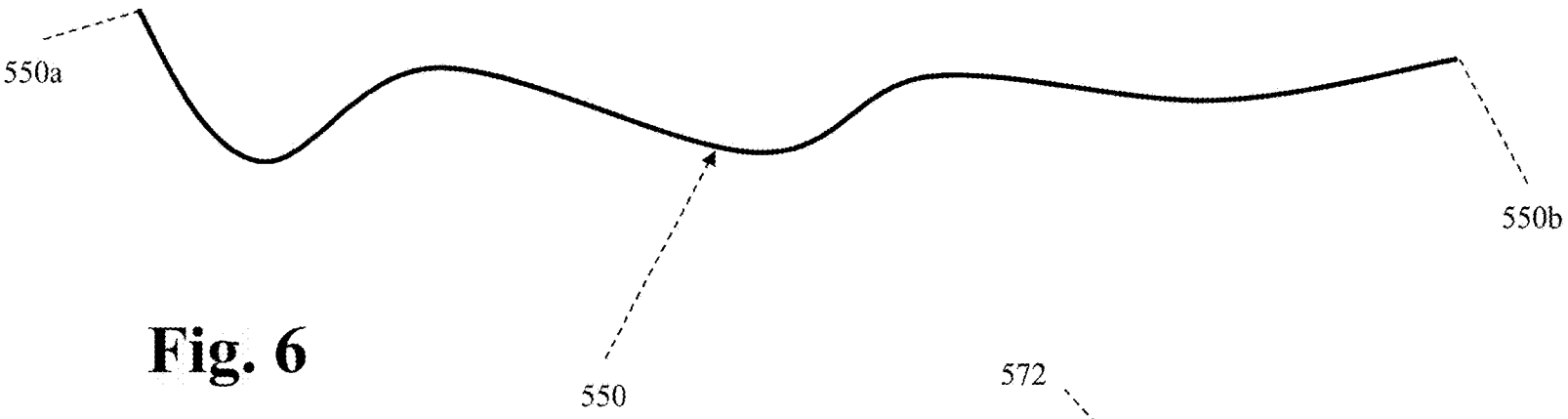
FIG. 6 shows a cord.

The crane arm 500 includes a cord 550, a distal hook 570 tied to one end of the cord 550, a telescopic arm 602, a driving mechanism 700, a hook and an air release mechanism 900. As shown in FIG. 6, the cord 550 is long and flexible that may, for example, be a string, rope, hoist rope, chain, twine, etc. The cord 550 includes a first end 550*a* and a second end 550*b*. The cord 550 passes preferably along and externally to the telescopic arm 600. The first end 550*a* of the cord 550 is connected (or attached) to the hook 570 (at an aperture 572) and the second end of the cord 550*b* is connected to the rear, rotating spool. The cord 550 allows the hook 570 to be disposed at a position that is down and away from the end of the telescopic arm 600 or to be disposed at a position that is close to the end of the telescopic arm 600. In other words, the cord 550 allows the hook 570 to be hoisted or lowered.

Figure 7:
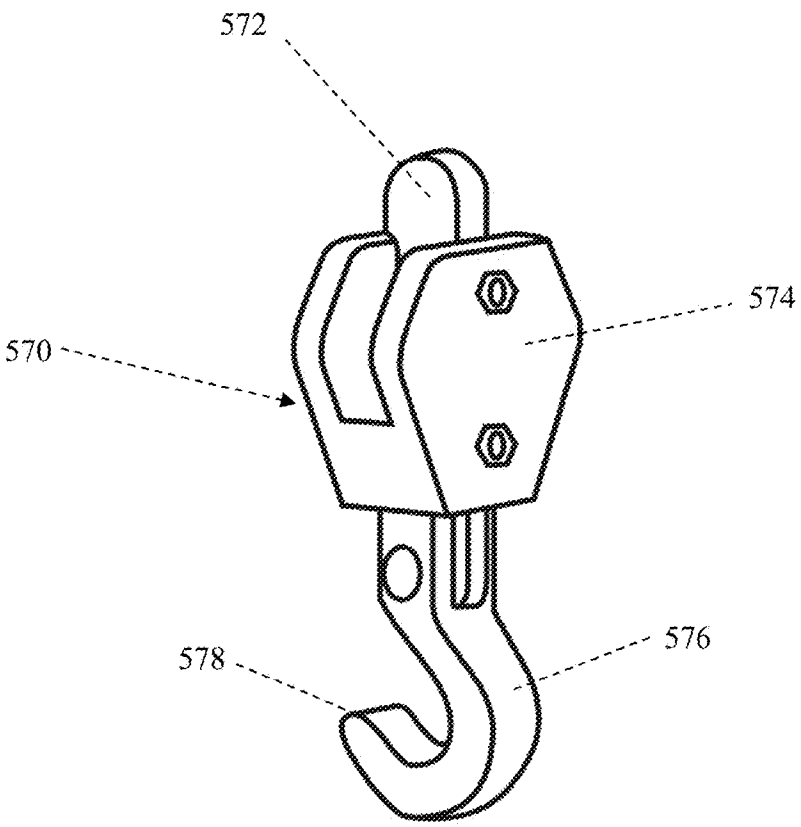
FIG. 7 shows a hook present within the extendable crane arm mechanism.

As shown in FIG. 7, the hook 570 includes a cord connector or aperture 572 with a hole (not shown) for threading and then tying the cord therethrough, a hook weight (like a tackle block) 574, a J-shaped bend 576 and a hook end 578. The cord connector 572 connects the hook 570 to the second end 550*b* of the cord 550. For example, the cord connector 572 may include an opening or aperture that allows the cord 550 to be tied to cord connector 572. The hook weight 574 allows the cord to extend vertically down, such that the hook 570 can be raised or lowered by the cord 550. The J-shaped bend 576 is the structure of the hook 570 that gradually curves into and becomes the hook end 578. Such curvature allows objects to be temporarily disposed and carried by the J-shaped bend 576. The hook end 578 creates an open aperture in the J-shaped bend, such that the hook 578 can releasably carry and lift objects.

Figure 8:
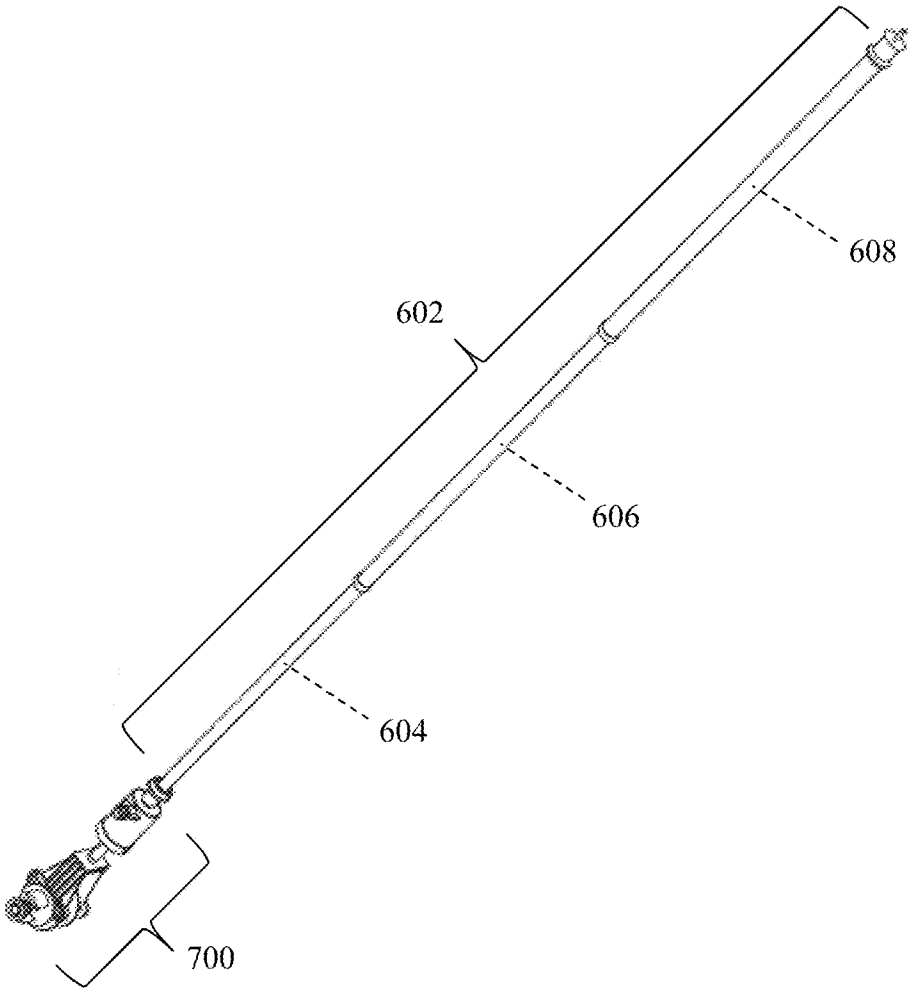
FIG. 8 shows an extension arm and a driving mechanism that is present within the extendable crane arm mechanism.

As shown in FIG. 8, the telescopic arm includes a set of extendible telescopic extension arms 602. Such an extension arm 602 includes a first extension member 604, a second extension member 606 and a third extension member 608. It should be noted that, while the example illustrated in FIG. 8 presents the extension arm 602 as having three extension members (i.e., extension members 604-608), there may be more (or less) than three extension members characterizing the extension arm 602. These extension arm elements 604-608 are telescopic—one within the other with the arm connected to the flatbed being the largest in diameter in comparison to the distal arm nearest to the hook member.

Figure 9A:
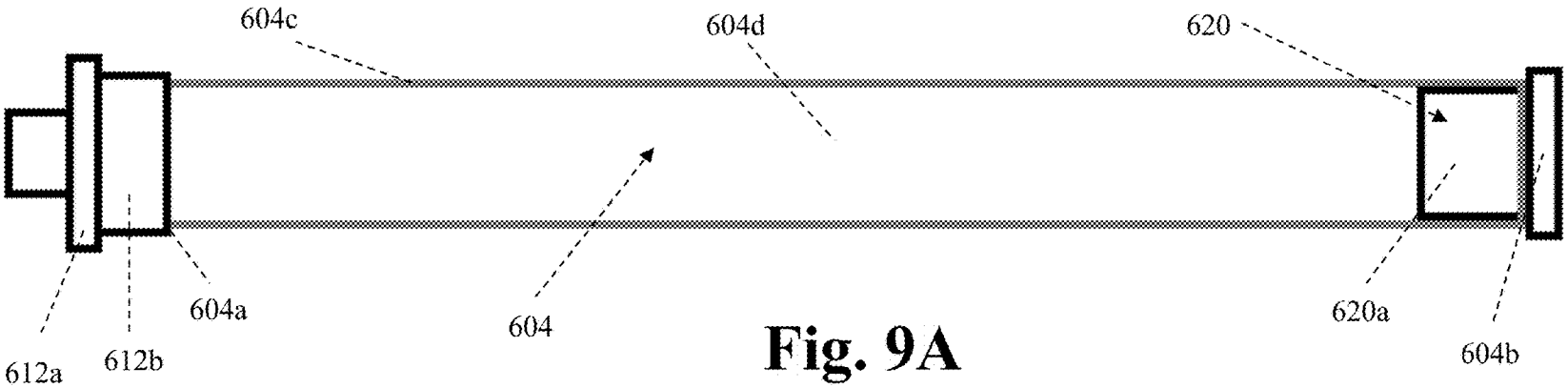
FIG. 9A shows a side view of a first extension member of the extension arm that includes a first end having a sealed connector attached thereto and a second end having a first blocking cap attached thereto.
Figure 9C:
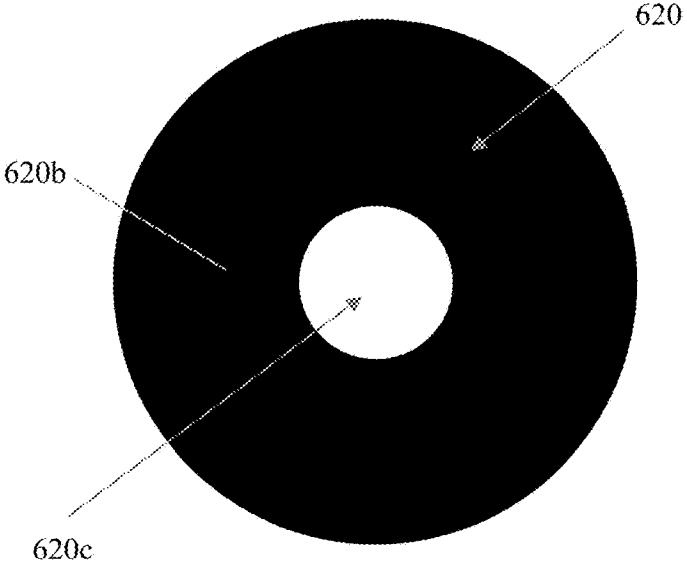
FIG. 9C shows a back view of the first extension member in FIG. 9A.
Figure 9B:
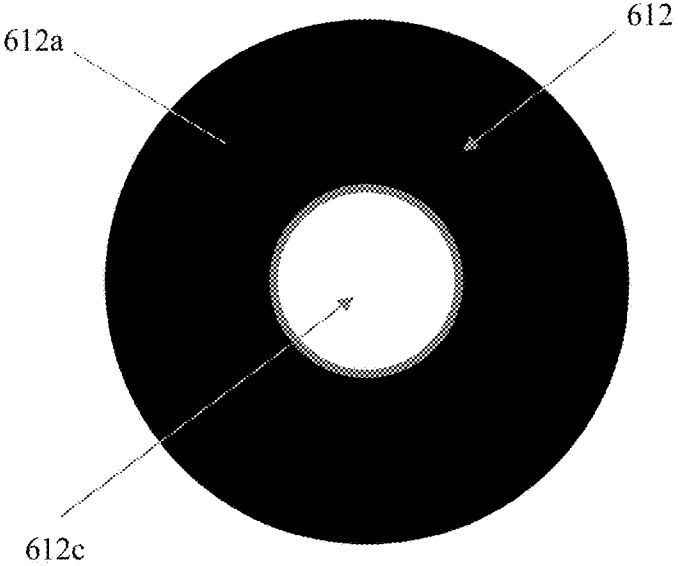
FIG. 9B shows a front view of the first extension member in FIG. 9A.

FIG. 9A illustrates an enlarged side view of the first extension member 604. As shown, the first extension member 604 includes a longitudinal, cylindrical body that includes a first and lower end 604*a*, a second distal end 604*b* and a cylindrical side wall 604*c* that extends from the first end 604*a* to the second end 604*b*. The first extension member 604 has a central bore that extends from the first end 604*a* to the second end 604*b*, such that the first extension member includes a hollow cylindrical bore or interior 604*d*. For example, the first extension member 604 may be a hollow tube. As also shown in FIGS. 8 and 9A, the first end 604*a* is connected to a driving mechanism 700 via a sealed O ring or connector 612 and the second end 604*b* may be connected to a first blocking cap (another O ring) 620. FIG. 9B illustrates a back view of the first extension member 604 when the sealed connector 612 is connected to the first extension member 604. FIG. 9C illustrates the front view of the first extension member 604 when the first blocking cap 620 is attached to the first extension member 604. In an exemplary embodiment, the first extension member 604 may include a transparent outer wall 604*c*. In another exemplary embodiment, the first extension member 604 may include a solid (i.e., non-transparent) wall 604*c*.

The sealed connector 612 includes a first portion 612*a* and a second portion 612*b*. The sealed connector 612 may also have an opening that extends through the first portion 612*a* to the second portion 612*b*, such that the sealed connector 612 includes a hollow interior 612*c*. The first portion 612*a* of the sealed connector 612 may be connected to the driving mechanism 700. The second portion 612*b* of the sealed connector 612 may be connected to the first end 604*a* of the first extension member 604 (e.g., via an adhesive), such that the hollow interior of the sealed connector 612 is concentric (or coaxial) with the hollow interior 604*d* of the first extension member 604. For example, the second portion 612*b* of the sealed connector 612 may hold the first extension member 604.

Figure 10A:
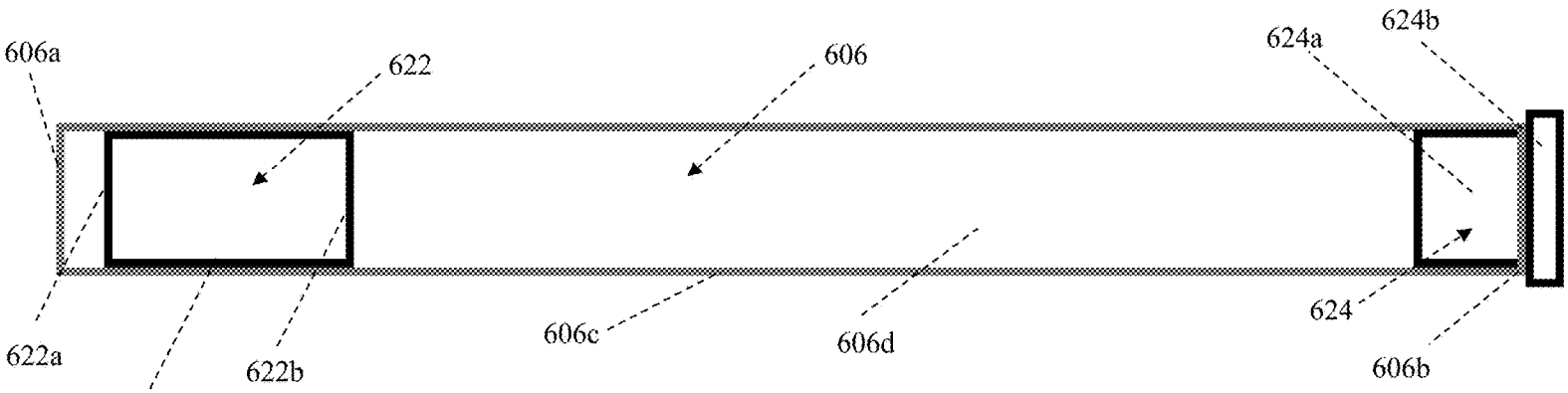
FIG. 10A shows a side view of a second extension member of the extension arm that includes a first end having a first blocking seal attached thereto and a second end having a second blocking cap attached thereto.
Figure 10C:
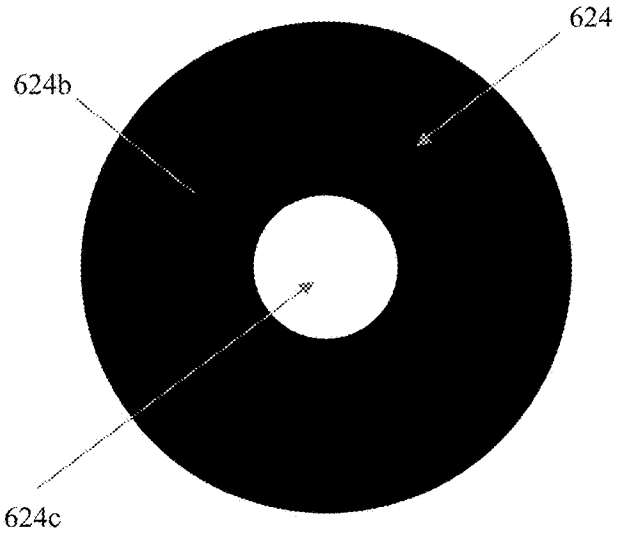
FIG. 10C shows a back view of the second extension member in FIG. 10A
Figure 10B:
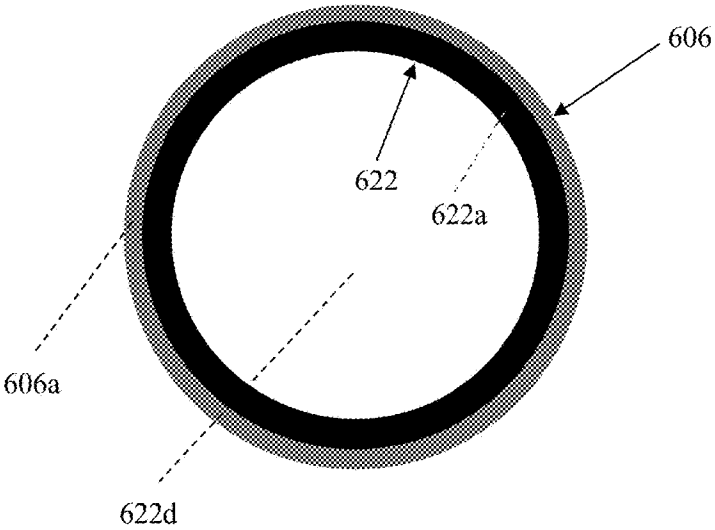
FIG. 10B shows a front view of the second extension member in FIG. 10A.

As seen in FIGS. 10A, 10B and 10C, the second extension member 606 may include a longitudinal cylindrical body that includes a first end 606*a*, a second opposed end 606*b* and a cylindrical side wall 606*c* that extends from the first end 606*a* to the second end 606*b*. The second extension member 606 may also have a central bore or an opening that extends from the first end 606*a* to the second end 606*b*, such that the second extension member includes a hollow cylindrical interior 606*d*. For example, the second extension member 606 may be a hollow tube. The first end 606*a* may be connected to a first blocking seal 622 and the second end 606*b* may be connected to a second blocking cap 624. FIG. 10B illustrates a back view of the second extension member 606 when the first blocking seal 622 is connected to the second extension member 606. FIG. 10C illustrates the front view of the second extension member 606 when the second blocking cap 624 is attached to the second extension member 606. In one exemplary embodiment, the second extension member 606 may include a transparent wall 606*c*. In another exemplary embodiment, the second extension member 606 may include a solid (i.e., non-transparent) wall 606*c*.

Figure 11A:
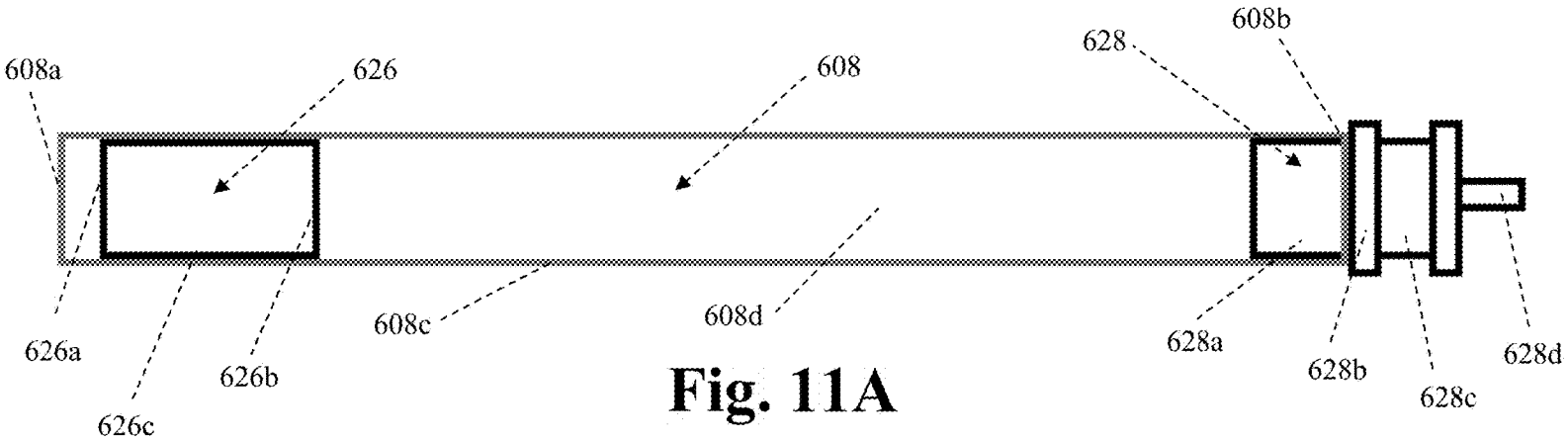
FIG. 11A shows a side view of a third extension member of the extension arm that includes a first end having a second blocking seal attached thereto and a second end having a release valve attached thereto.
Figure 11C:
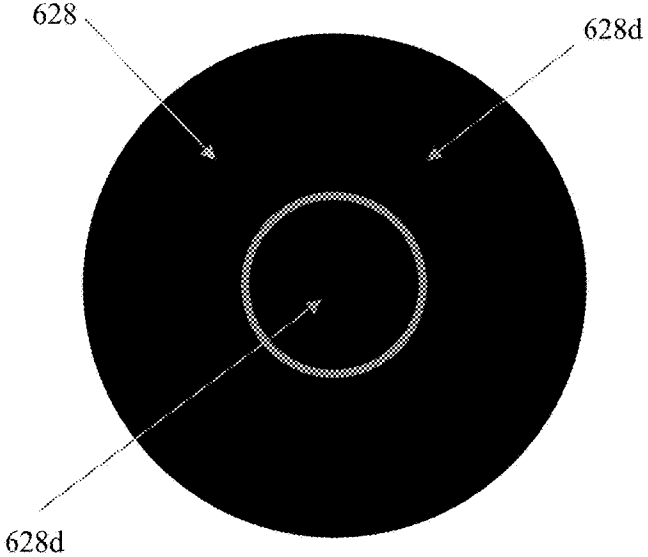
FIG. 11C shows a back view of the third extension member in FIG. 11A.
Figure 11B:
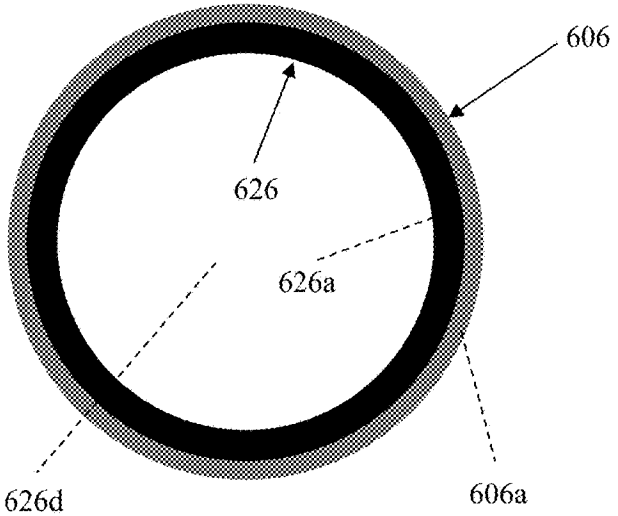
FIG. 11B shows a front view of the third extension member in FIG. 11A.

Turning attention to FIGS. 11A, 11B, and 11C, the third extension member 608 may include a longitudinal cylindrical body that includes a first end 608*a*, a distal second end 608*b* and a cylindrical side wall 608*c* that extends from the first end 608*a* to the second end 608*b*. The third extension member 608 may also have an opening or central bore that extends from the first end 608*a* to the second end 608*b*, such that the third extension member includes a hollow central, bore or interior 608*d*. For example, the third extension member 608 may be a hollow tube. The first end 606*a* may be connected to a second blocking seal 626 and the second and distal end 606*b* may be connected to a release valve 628. FIG. 11B illustrates a back and proximal view of the third extension member 608 when the second blocking seal 626 is connected to the second extension member 608. FIG. 10C illustrates the front and distal view of the third extension member 608 when the release valve 628 is attached to the third extension member 608. In one exemplary embodiment, the third extension member 608 may include a transparent wall 608*c*. In another exemplary embodiment, the third extension member 608 may include a solid (i.e., non-transparent) wall 608*c*.

As discussed previously, each of the extension members 604, 606, and 608 may include a hollow, continuous bore as the continuing interior (e.g., 604*d*, 606*d*, 608*d*). The inner diameters of the hollow interiors allow each of the extension members 604-608 to be configured to be capable of slidingly and telescopically fitting inside the adjacent extension member. For example, the first extension member 604 can fit within the hollow interior 606*d* of the second extension member 606. Likewise, the second extension member 606 can fit within the hollow interior 608*d* of the third extension member 608. Thus, each of the cross-sectional areas of the succeeding extension member increases. In other words, the cross-sectional area of the third extension member 608 is larger than the cross-sectional area of the second extension member 606. Likewise, the cross-sectional areas of the second extension member 606 is larger than the cross-sectional area of the first extension member 604. As a result of the aforementioned configuration, the extension members 604-608 are capable of being slidably connected to each other, such that the extension members 604-608 are capable of telescopically extending and retracting. Further, each of the extension members 604-608 are coaxial with each other such that each of the extension members 604-608 share a telescopic longitudinal axis.

The extension members 604-608 are prevented from being disconnected from each other via the blocking caps (e.g., 620, 624) and blocking seals (e.g., 622, 626). The first blocking cap 620 includes a first portion 620*a* and a second portion 620*b*. The second portion 620*b* includes a cross-sectional area that is larger than a cross-sectional area of the first portion 620*a*. The first blocking cap 620 may also have an opening that extends through the first portion 620*a* to the second end 620*b*, such that the third extension member includes a hollow interior 620*c*. The first portion 620*a* of the first blocking cap 620 may be connected to the second end 604*a* of the first extension member 604, such that hollow interior 620*d* of the first blocking cap 620 is concentric (or coaxial) with the hollow interior 604*d* of the first extension member 604. For example, the first portion 620*a* of the first blocking cap 620 is held within the first extension member 606, while the second portion 620*b* is external to the first extension member 606. In addition, the cross-section of the hollow interior 620*c* may have a smaller area than the cross-section of the hollow interior 604*d* of the first extension member 604. It should be noted that FIG. 9A illustrates the wall 604*c* of the first extension member 604 as transparent so as to better clarify how the first blocking cap 620 slidingly yet frictionally fits into the first extension member 604.

As shown in FIG. 10A, the first blocking seal 622 includes a first end 622*a*, a second end 622*b* and a wall 622*c* extending from the first end 622*a* to the second end 622*b*. The first blocking seal 622 may also have an opening that extends from the first end 622*a* to the second end 622*b*, such that the first blocking seal 622 includes a hollow interior 622*d*. In addition, the wall 622*c* includes an interior surface that faces the hollow interior 622*d* and an exterior surface opposite the interior surface, such that the exterior surface faces away from the hollow interior 622*d*, and contacts the second extension member 606. The first end 622*a* of the first blocking cap 622 may be connected to the first end 606*a* of the second extension member 606, such that hollow interior 622*d* of the first blocking seal is concentric (or coaxial) with the hollow interior 604*d* of the first extension member 604. Further, the cross-sectional area of the hollow interior 622*d* may be slightly larger than the cross-sectional area of the first extension member 604, such that the first extension member 604 is capable of being held within the hollow interior 622*d* of the first blocking seal 622. When the first extension member 604 is held within the hollow interior 622*d* of the first blocking seal 622, the first blocking seal 622 performs a function similar to a hermetic seal, which is an airtight seal that prevents gases (e.g., air) from escaping the extension arm 602. For example, the interior surface of the wall 622*c* contacts the exterior surface of the wall 604*c* of the first extension member 604, such that the first blocking seal 622 is capable of moving relative to the first extension member 604, while functioning to prevent air from escaping the extension arm 602. It should be noted that FIG. 10A illustrates the wall 606*c* of the second extension member 606 as transparent so as to better clarify how the first blocking seal 622 and the second blocking cap 624 fits into the second extension member 606.

The first blocking cap 620 also cooperates with the first blocking seal 622 to limit the movement of the second extension member 606 with respect to the first extension member 604. The first extension member 604 is attached to the driving mechanism 700, such that the first extension member 604 is fixed in moving along the telescopic and longitudinal axis. On the other hand, the second extension member 606 is capable of moving along the telescopic axis. For example, the second extension member 606 may be at a position, in which the first extension member 606 is substantially nested within (i.e. inside) the second extension member 606. As the second extension member 606 moves along the telescopic axis in a first direction (e.g., away from the driving mechanism 700), portions of the first extension member 604 no longer become nested within the second extension member 606. At a point, the second end 622*b* of the first blocking seal 622 contacts the second portion 620*b* of the first blocking cap 620, such that the second portion 620*b* prevents the first blocking seal 622 (and by extension the second extension member 606) from moving any further in the first direction. As a result, at least a portion of the first extension member 604 remains nested within the second extension member 606.

The second blocking cap 624 includes a first portion 624*a* and a second portion 624*b*. The second portion 624*b* includes a cross-sectional area that is larger than a cross-sectional area of the first portion 624*a*. The second blocking cap 624 may also have an opening that extends from the first portion 624*a* to the second portion 624*b*, such that the second blocking cap 624 includes a hollow interior 624*c*. The first portion 624*a* of the second blocking cap 624 may be connected to the second end 606*a* of the second extension member 606, such that hollow interior 624*c* of the second blocking cap 624 is concentric (or coaxial) with the hollow interior 604*d* of the second extension member 606. For example, the first portion 624*a* of the first blocking cap 624 is held within the second extension member 606, while the second portion 624*b* is external to the second extension member 606. In addition, the cross-section of the hollow interior 624*c* may have a smaller area than the cross-section of the hollow interior 608*d* of the second extension member 606. It should be noted that FIG. 10A illustrates the wall 606*c* of the second extension member 606 as transparent so as to better clarify how the second blocking cap 624 fits into the second extension member 606.

The second blocking cap 624 cooperates with the second blocking seal 626 to limit the movement of the second extension member 606 with respect to the first extension member 604. As discussed previously, the first extension member 604 is attached to the driving mechanism 700, such that the first extension member 604 is fixed in moving along the telescopic axis. On the other hand, the second extension member 606 is capable of moving along the telescopic axis. The second extension member 606 is capable of retracting back towards the first extension member 604, when, for example, the second extension member 606 is at a maximum extended position (i.e., the furthest position that the second extension member 606 can extend with respect to the first extension member 604). When the second extension member 606 retracts along the telescopic axis in a second direction (e.g., towards the driving mechanism 700), portions of the first extension member 604 gradually become nested within the second extension member 606. At a point, the first portion 624*a* of the second blocking cap 624 contacts the second portion 620*b* of the first blocking cap 620, such that the second portion 620*b* prevents the second blocking cap 624 (and by extension the second extension member 606) from moving any further in the second direction. As a result, a substantial portion of the first extension member 604 becomes nested within the second extension member 606.

The second blocking seal 626 includes a first end 626*a*, a second end 626*b* and a wall 626*c* extending from the first end 626*a* to the second end 626*b*. The second blocking seal 626 may also have an opening that extends from the first end 626*a* to the second end 626*b*, such that the second blocking seal 626 includes a hollow interior 626*d*. The second end 626*b* of the second blocking seal 626 may be connected to the first end 608*a* of the third extension member 608, such that hollow interior 626*d* of the first blocking seal 626 is concentric (or coaxial) with the hollow interior 608*d* of the third extension member 608. Further, the cross-sectional area of the hollow interior 626*d* may be slightly larger than the cross-sectional area of the second extension member 606, such that the second extension member 606 is capable of being held within the hollow interior 626*d* of the second blocking seal 622. When the second extension member 606 is held within the hollow interior 626*d* of the second blocking seal 626, the second blocking seal 626 performs a function similar to a hermetic seal, which is an airtight seal that prevents gases (e.g., air) from escaping the extension arm 602. For example, the interior surface of the wall 626*c* contacts the exterior surface of the wall 606*c* of the second extension member 606, such that the second blocking seal 626 is capable of moving relative to the second extension member 606, while functioning to prevent air from escaping the extension arm 602. It should be noted that FIG. 11A illustrates the wall 606*c* of the second extension member 606 as transparent so as to better clarify how the second blocking seal 626 fits into the second extension member 606.

The second blocking cap 624 also cooperates with the second blocking seal 626 to limit the movement of the third extension member 608 with respect to the second extension member 606. Like the second extension member 606, the third extension member 608 is capable of moving along the telescopic axis. For example, the third extension member 608 may be at a position, in which the second extension member 606 is substantially nested within (i.e. inside) the third extension member 608. As the third extension member 608 moves along the telescopic axis in a first direction (e.g., away from the driving mechanism 700), portions of the second extension member 606 no longer become nested within the third extension member 608. At a point, the second end 624*b* of the second blocking seal 624 contacts the second portion 624*b* of the second blocking cap 624, such that the second portion 624*b* prevents the second blocking seal 624 (and by extension the third extension member 608) from moving any further in the first direction. As a result, a portion of the second extension member 606 remains nested within the third extension member 608.

Figure 12A:
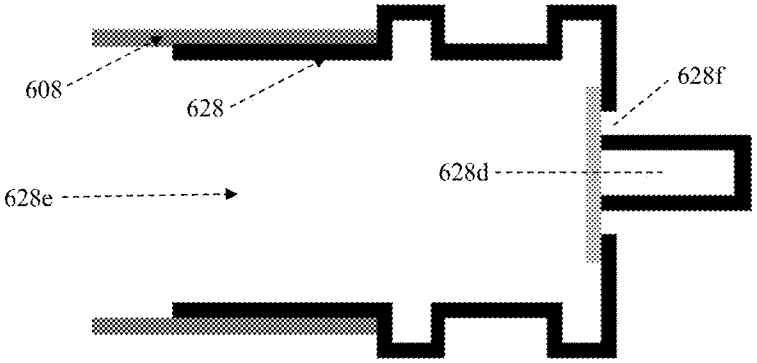
FIG. 12A shows the release valve in a normal position.
Figure 12B:
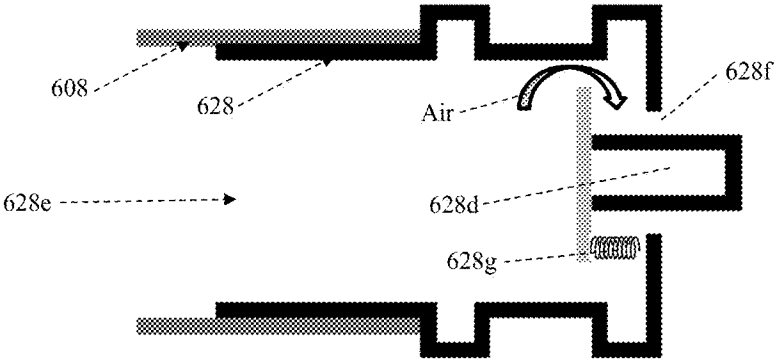
FIG. 12B shows the release valve in a breaching position.

Thus, the aforementioned configuration in which the hollow interiors of the extension members (e.g., 604, 606 and 608), the blocking caps (e.g., 620, 624) and blocking seals (e.g., 622, 626) are concentric produce a linear path that allows air to pass through each of the aforementioned components. As such, an air pressure may reside in the linear path until air is released via the release valve 628. As shown in FIGS. 11A, 11B, 12A and 12B, the release valve 628 includes a first portion 628*a*, a second portion 628*b*, a release portion 628*c* and a release pin 628*d*. The release valve 628 may also have an opening that extends through the first portion 628*a*, the second portion 628*b*, and the release portion 628*c*, such that the release valve 628 includes a hollow interior 622*e*. The release pin 628*d* is connected to the release portion 628*c*, and blocks the air from escaping the hollow interior 622*e* (and by extension the extension arm) by blocking an opening 628*f* For example, the release portion 628*c* may be capable of moving along the telescopic axis in an elastic (e.g., spring-like) manner. In other words, the release pin 628*d* may be attached to the release portion 628*c* via a spring 628*g*. As such, in the uncompressed position, the release pin 628*d* prevents air from escaping the extension arm 602, as illustrated in FIG. 12A, when the release pin 628*d* is in the blocking position. When the release pin 628*d* is pushed in a direction towards the release portion 628*c* (breaching position), a breach is created in the opening 628*f* thereby allowing air to escape the release valve 628 (and by extension the extension arm), as illustrated in FIG. 12B. It should be noted that FIG. 11A illustrates the wall 608*c* of the third extension member 608 as transparent so as to better clarify how the release valve 628 fits into the third extension member 608.

The release valve 628 cooperates with the second blocking cap 624 to limit the movement of the third extension member 608 with respect to the second extension member 606. As discussed previously, the third extension member 608 is capable of moving along the telescopic axis. The third extension member 608 is capable of retracting back towards the second extension member 606, when, for example, the third extension member 608 is at a maximum extended position (i.e., the furthest position that the third extension member 608 can extend with respect to the second extension member 606). When the third extension member 606 retracts along the telescopic axis in a second direction (e.g., towards the driving mechanism 700) portions of the second extension member 606 gradually become nested within the third extension member 608. At a point, the first portion 628*a* of the release valve 628 contacts the second portion 624*b* of the second blocking cap 624, such that the second portion 624*b* prevents the release valve 628 (and by extension the third extension member 608) from moving any further in the second direction. As a result, a substantial portion of the second extension member 606 becomes nested within the third extension member 608.

Figure 13A:
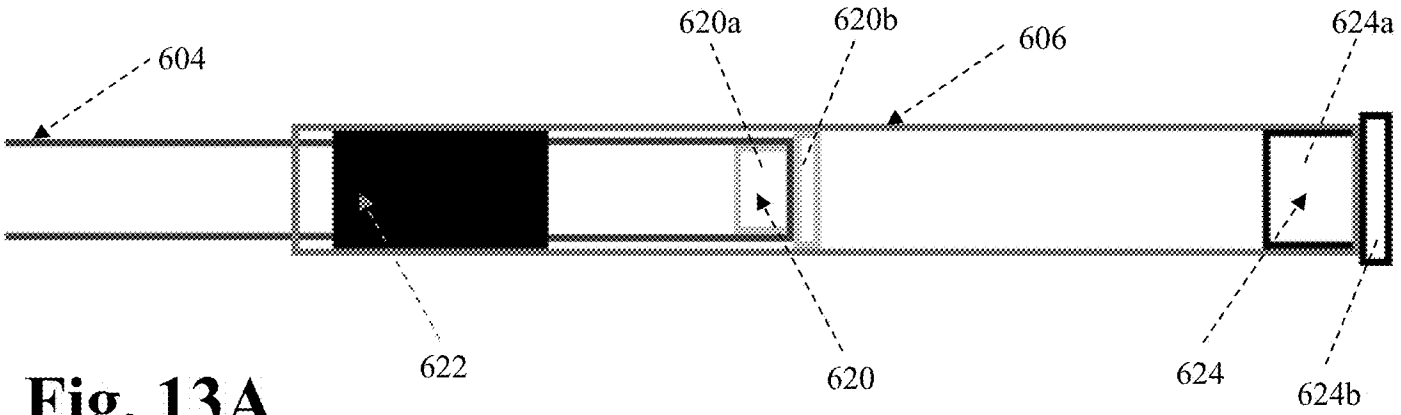
FIG. 13A-13B shows the second extension member extending away from the first extension member.
Figure 13B:
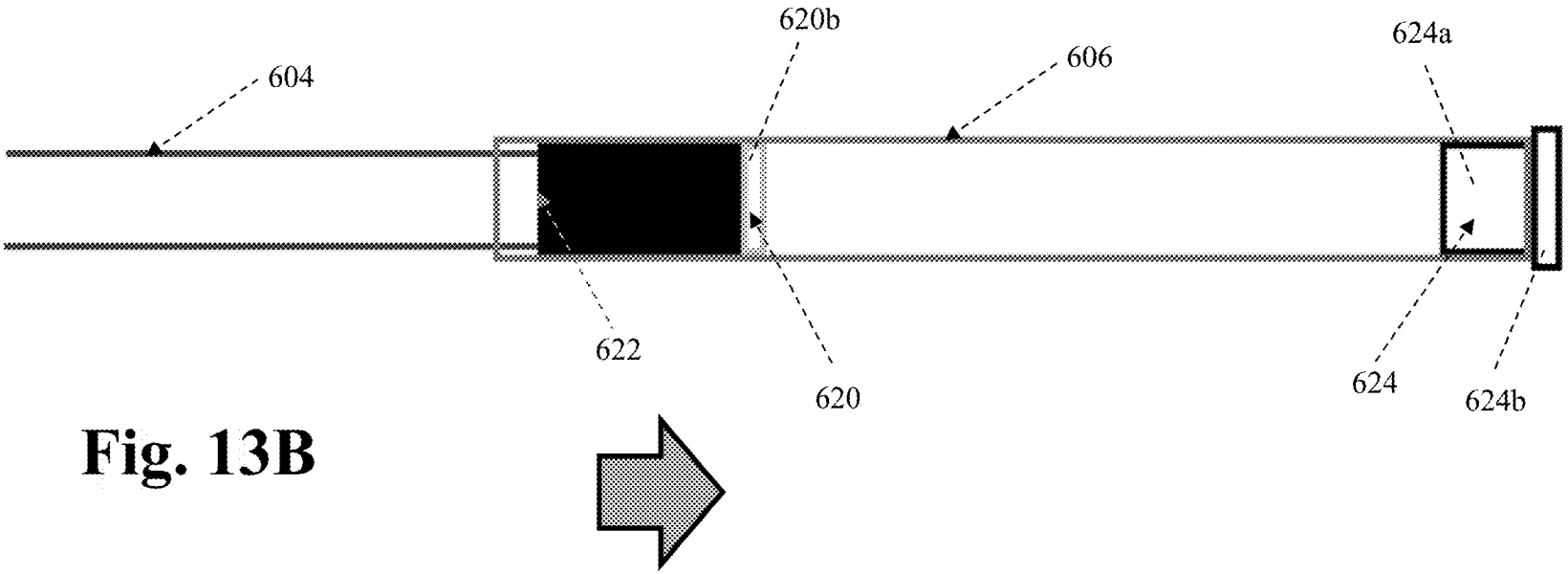

FIGS. 13A-13B illustrate the movement of the second extension member 606 with respect to the first extension member 604. As shown, the second extension member 606 is capable of moving (sliding) away from the first extension member 604 in a telescopic manner (as indicated by the large arrow in FIG. 13B). However, the second extension member 606 is limited in movement due to the interaction between the first blocking seal 622 and the second portion 620*b* of the first blocking cap 620. As shown in FIG. 13B, the first blocking seal 622 eventually contacts the first blocking cap 620. The second portion 620*b* of the first blocking cap 620 prevents the first blocking seal 622 from moving further, thereby also preventing the second extension member 606 from moving any further in that direction. Thus, the second extension member 606 is prevented from being completely disconnected from the first extension member 604.

Figure 13C:
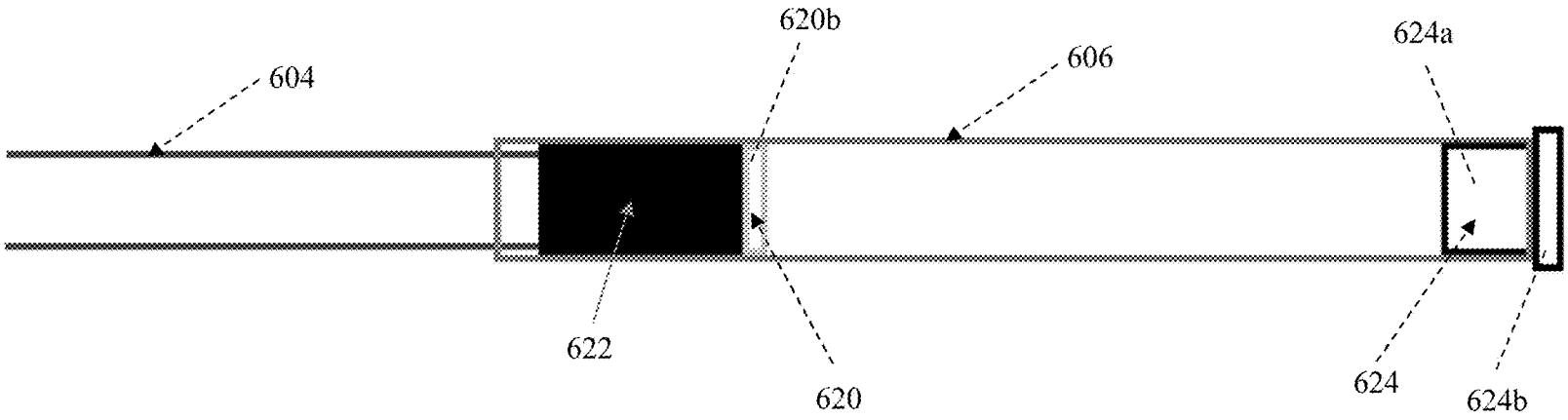
FIG. 13C-13D shows the second extension member retracting towards the first extension member.
Figure 13D:
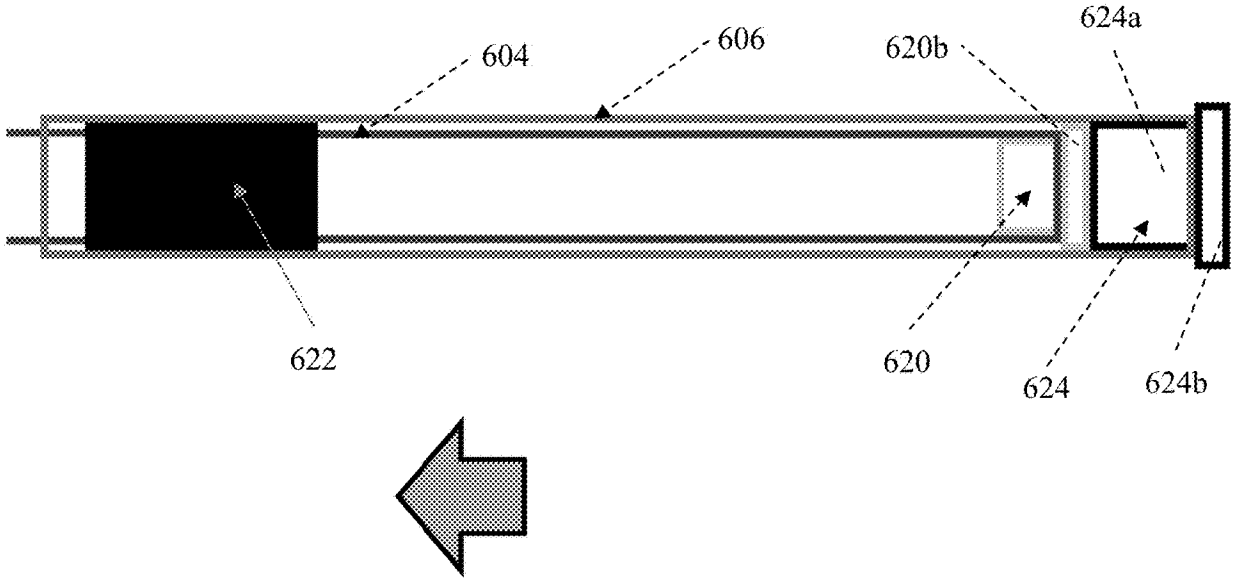

FIGS. 13C-13D illustrates the movement of the second extension member 606 with respect to the first extension member 604. As shown, the second extension member 606 is capable of moving (sliding) toward the first extension member 604 in a telescopic manner (as indicated by the arrow). However, the second extension member 606 is limited in movement due to the interaction between the second portion 620*b* of the first blocking cap 620 and the first portion 624*a* of the second blocking cap 624. As shown in FIG. 13D, the first blocking cap 620 eventually contacts the second blocking cap 624. The second portion 620*b* of the first blocking cap 620 prevents the second blocking cap 624 from moving further, thereby also preventing the second extension member 606 from moving any further in that direction. Thus, the first extension member 604 becomes substantially nested within the second extension member 606.

Figure 14A:
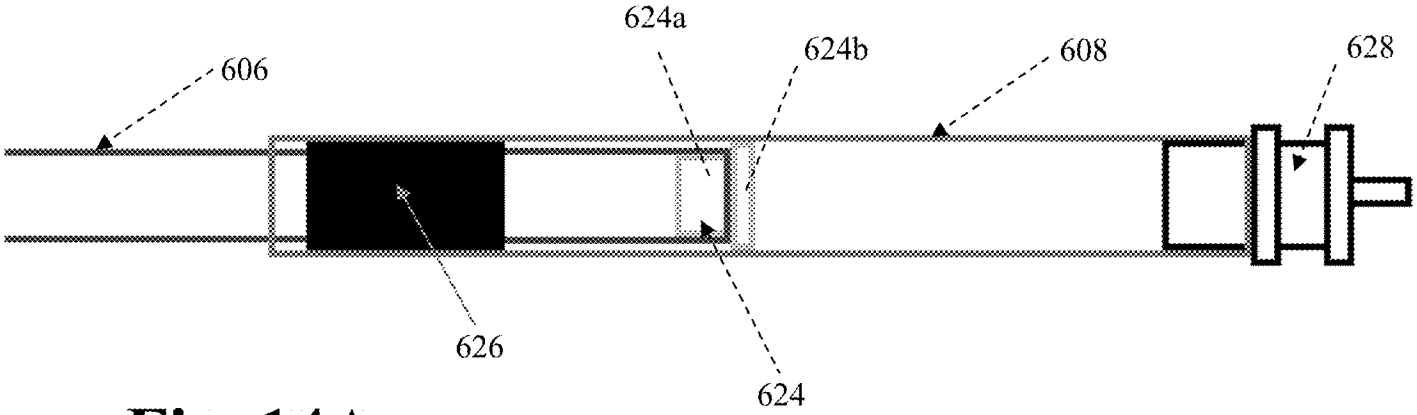
FIG. 14A-14B shows the third extension member extending away from the second extension member.
Figure 14B:
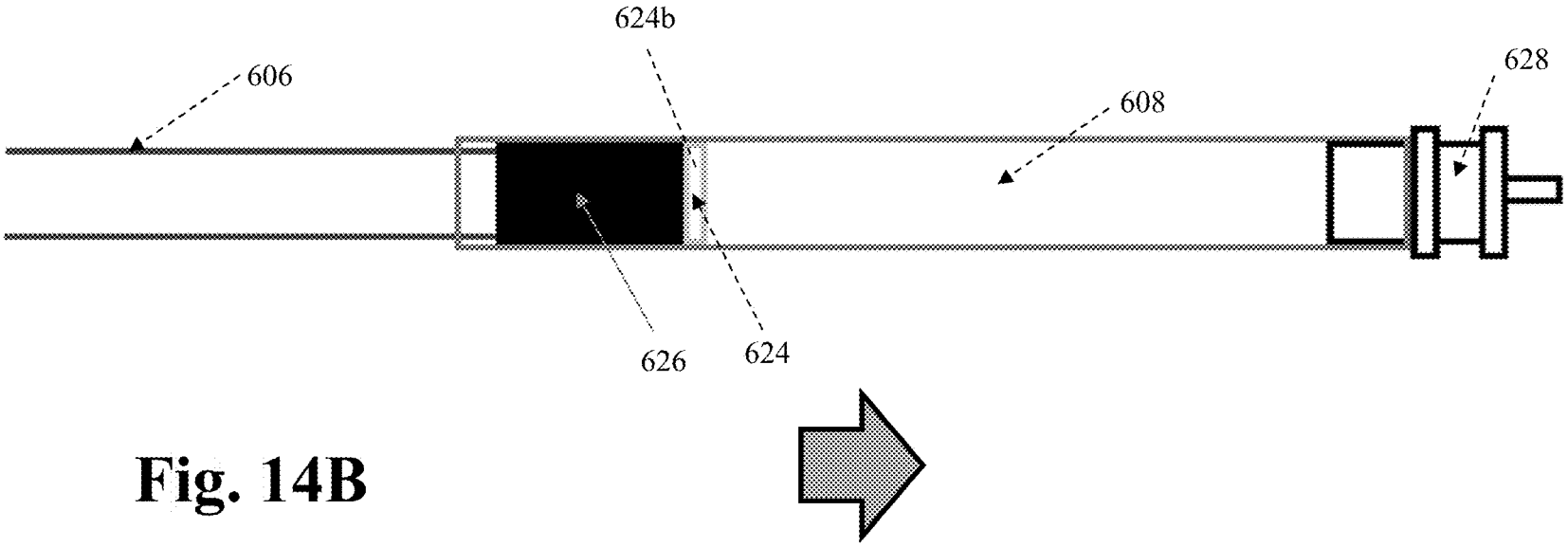

FIGS. 14A-14B illustrates the movement of the third extension member 608 with respect to the second or middle extension member 606. As shown, the third extension member 608 is capable of moving (sliding) away from the second extension member 606 in a telescopic manner (as indicated by the large arrow of FIG. 14B). However, the third extension member 608 is limited in movement due to the interaction between the second blocking seal 626 and the second portion of the second blocking cap. As shown in FIG. 14B, the second blocking seal 626 eventually contacts the second blocking cap 622. The second portion 622*b* of the second blocking cap 622 prevents the second blocking seal 626 from moving further, thereby also preventing the third extension member 608 from longitudinally moving any further in that direction. Thus, the third extension member 608 is prevented from being completely disconnected from the second extension member 606.

Figure 14C:
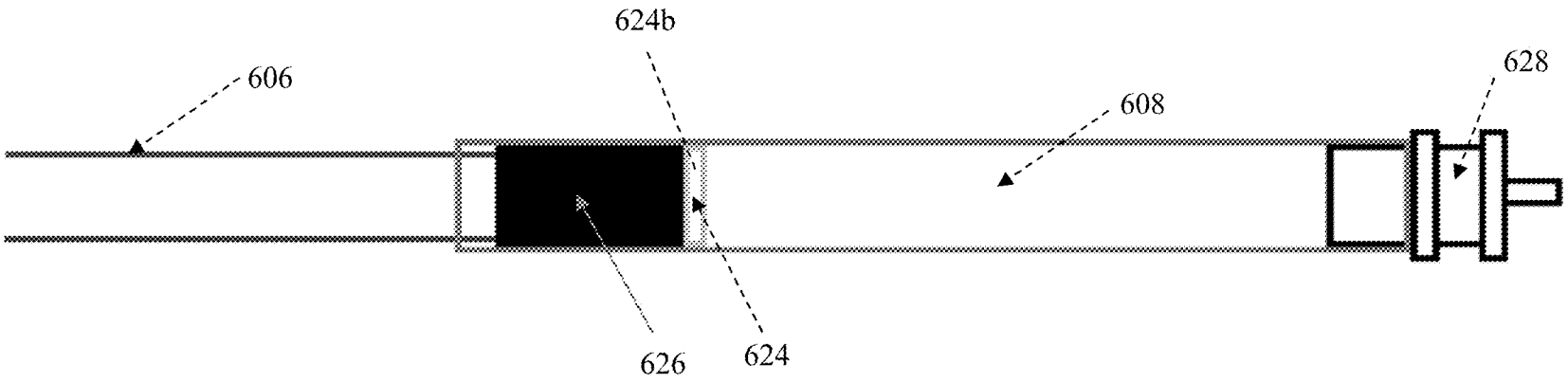
FIG. 14C-14D shows the third extension member extending away from the second extension member.
Figure 14D:
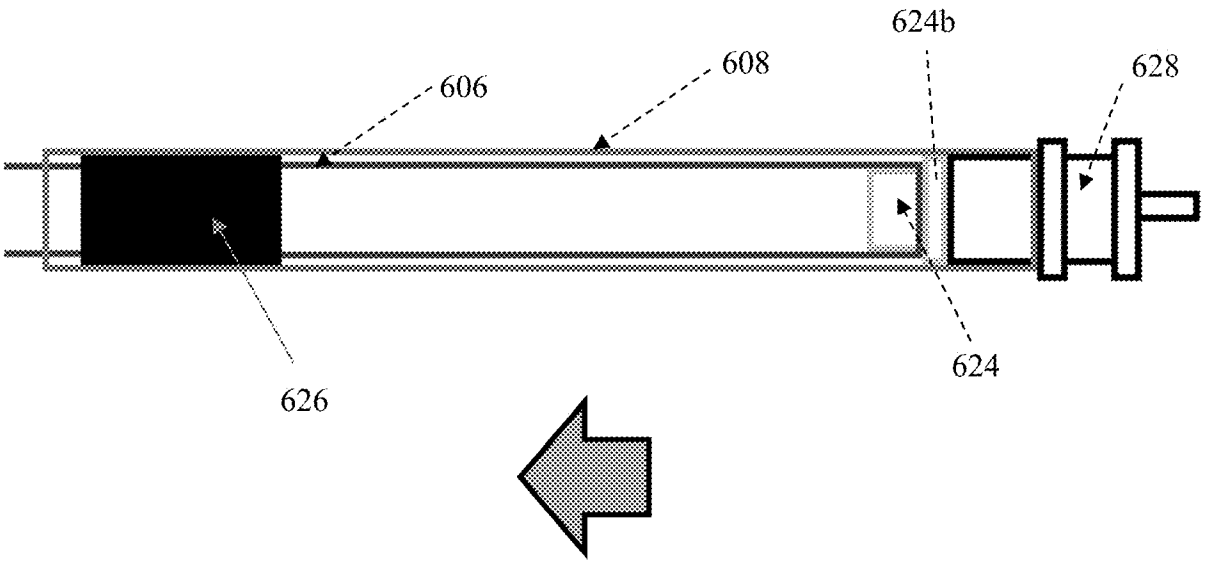

FIGS. 14C-14D illustrates the retracting movement of the third extension member 608 with respect to the second extension member 606. As shown, the third extension member 608 is capable of moving (sliding) toward the second extension member 606 in a telescopic manner (as indicated by the large arrow in FIG. 14D). However, the third extension member 608 is limited in movement due to the interaction between the second portion 624*b* of the second blocking cap 624 and the first portion 624*a* of the release valve 628. As shown in FIG. 14D, the second blocking cap 624 eventually contacts the release valve 628. The second portion 624*b* of the second blocking cap 624 prevents the release valve 628 from moving further, thereby also preventing the third extension member 608 from moving any further. Thus, the second extension member 606 becomes substantially axially nested within the third extension member 608.

Figure 15:
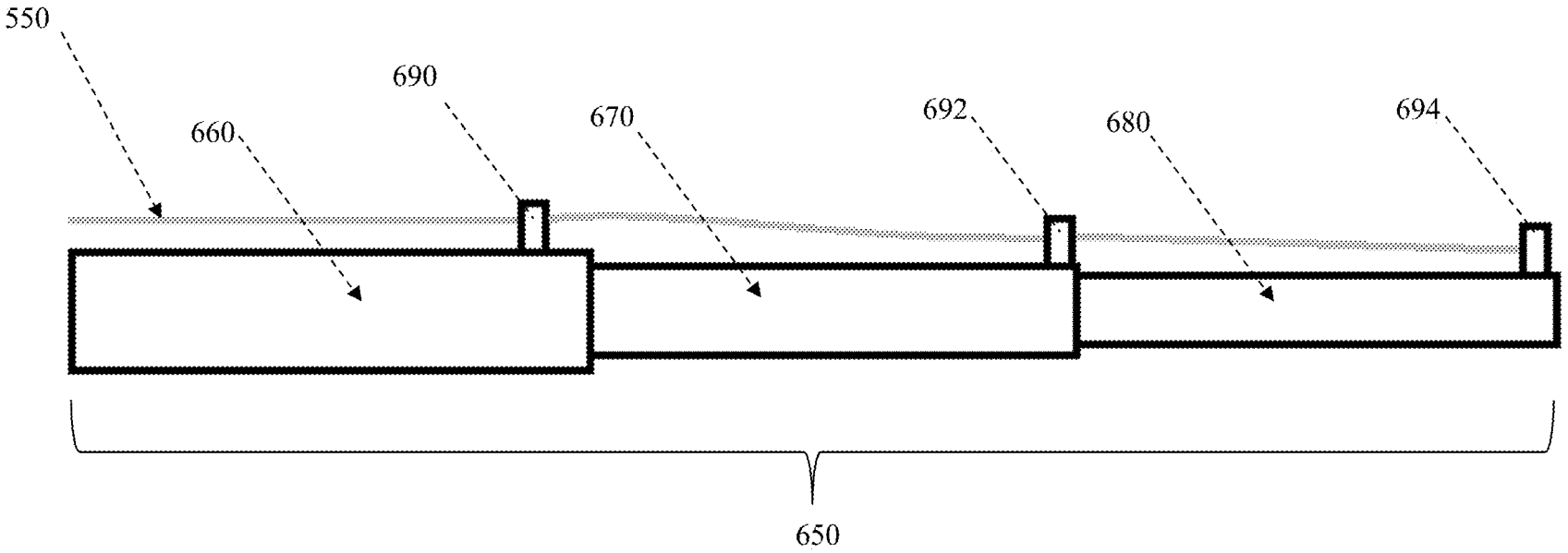
FIG. 15 shows a boom arm of the driving mechanism in an extended position.

The telescopic arm 600 also includes a boom arm 650, as shown in FIG. 15. The boom arm 650 includes a first boom member 660, a second boom member 670, and a third boom member 680. Each of the boom members 660, 670, 680 may include a hollow interior (e.g., 660*g*, 670*g*, 680*g*). Such hollow interiors allow each of the extension members or boom members 660, 670, 680 to be configured to be capable of fitting inside the preceding extension members. For example, the third boom member 680 can fit within the hollow interior 670*g* of the second boom member 670. Likewise, the second boom member 670 can fit within the hollow interior 660*g* of the first boom member 670*g*. Thus, each of the cross-sectional areas of the succeeding extension member increases. In other words, the cross-sectional area of the first boom member 660 is larger than the cross-sectional area of the second boom member 670. Likewise, the cross-sectional area of the second boom member 670 is larger than the cross-sectional area of the third boom member 680. As a result of the aforementioned configuration, the boom members 660, 670, 680 are capable of being slidably connected to each other. Further, each of the boom members 660, 670, 680 are coaxial with each other such that each of the boom members 660, 670, 680 share the telescopic axis.

Figure 16A:
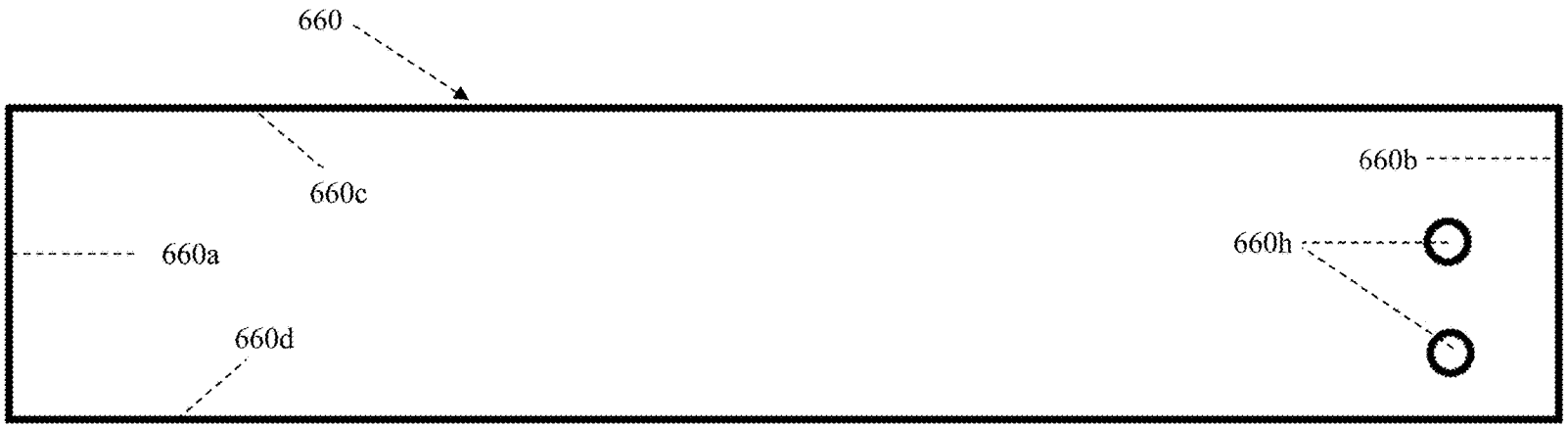
FIG. 16A shows a side view of a first boom member of the boom arm.
Figure 16B:
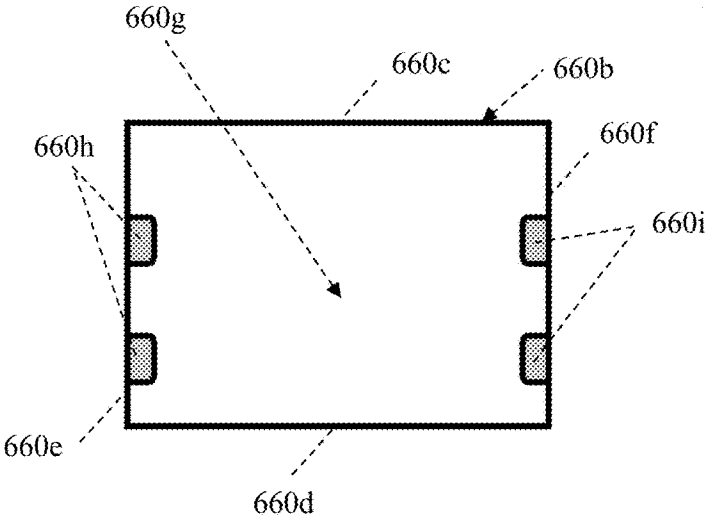
FIG. 16B shows a front view of the first boom member in FIG. 16A.
Figure 16C:
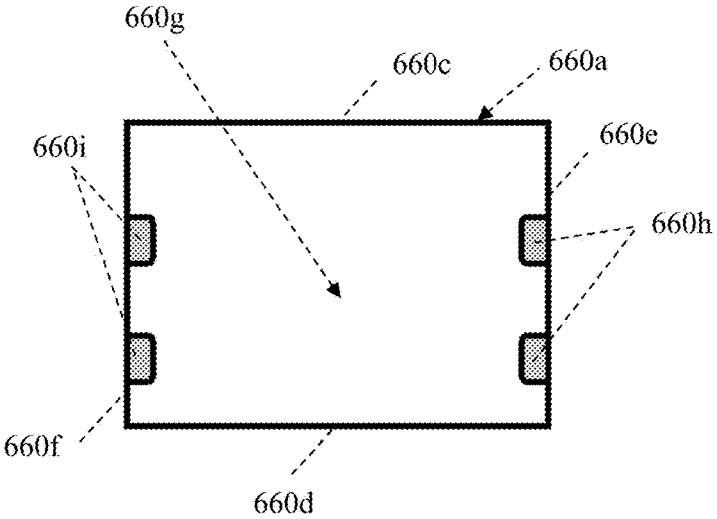
FIG. 16C shows a back view of the first boom member in FIG. 16A.

FIGS. 16A-16C illustrated an example of the first boom member 660. FIG. 16A is a side view of the first boom member 660. FIG. 16B is a front view of the first boom member 660. FIG. 16C is a back view of the first boom member 660. As shown, the first boom member 660 includes a first end 660*a*, a second end 660*b*, a top surface 660*c*, a bottom surface 660*d*, a first side surface 660*e* and a second side surface 660*f* The first end 660*a* is connected to the driving mechanism 700. The top surface 660*c* is parallel to the bottom surface 660*d*. The first side surface 660*e* is parallel to the second side surface 660*f*. The first side surface 660*e* is connected to the top surface 660*c* and connected to the bottom surface 660*d*. In an exemplary embodiment, the first side surface 660*e* is perpendicular to the top surface 660*c* and the bottom surface 660*d*. The second side surface 660*f* is connected to the top surface 660*c* and connected to the bottom surface 660*d*. In an exemplary embodiment, the second side surface 660*f* is perpendicular to the top surface 660*c* and the bottom surface 660*d*. An opening extends from the first end 660*a* to the second end 660*b*, to form the hollow interior 660*g* that is surrounded by the top surface 660*c*, the bottom surface 660*d*, the first side surface 660*e* and the second side surface 660*f*. The first side surface 660*e* includes one or more projections 660*h* and the second side surface 660*f* includes one or more projections 660*i*. The one or more projections 660*h* extend from an interior surface of the first side surface 660*e* towards the hollow interior 660*g*. Likewise, the one or more projections 660*i* extend from an interior surface of the second side surface 660*f* towards the hollow interior 660*g*. Each of the projections 660*h*, 660*i* may be disposed at (or near to) the second end 660*b*. In one exemplary embodiment, the one or more projections 660*h*, 660*i* are cylindrical-shaped. In another exemplary embodiment, the one or more projections 660*h* are disposed directly opposite the one or more projections 660*g*.

Figure 17A:
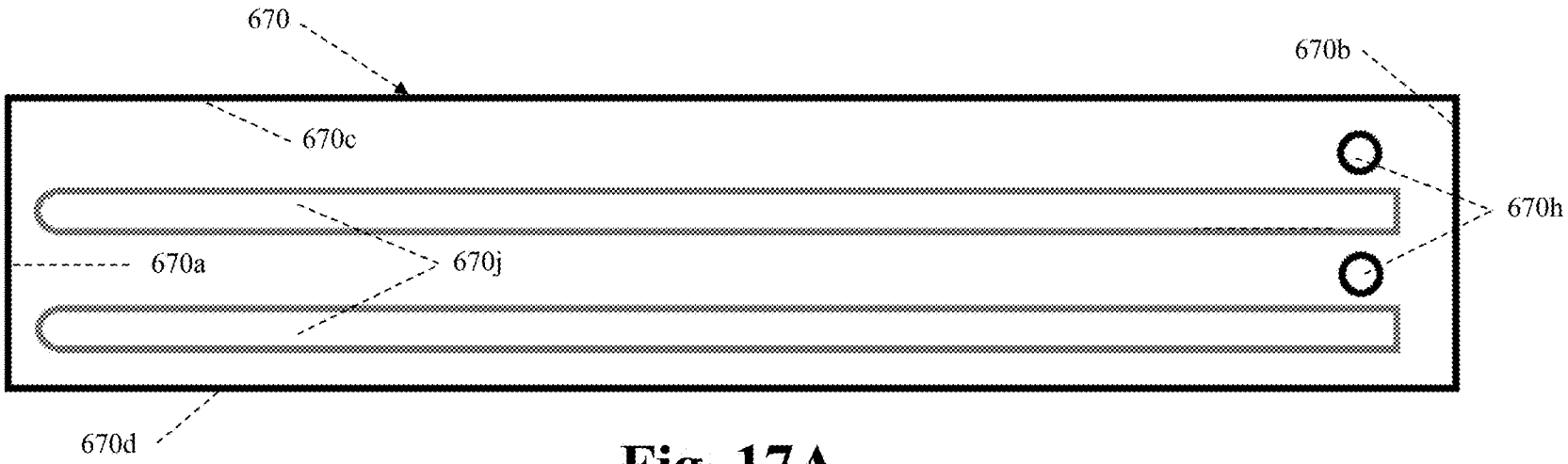
FIG. 17A shows a side view of a second boom member of the boom arm.
Figure 17B:
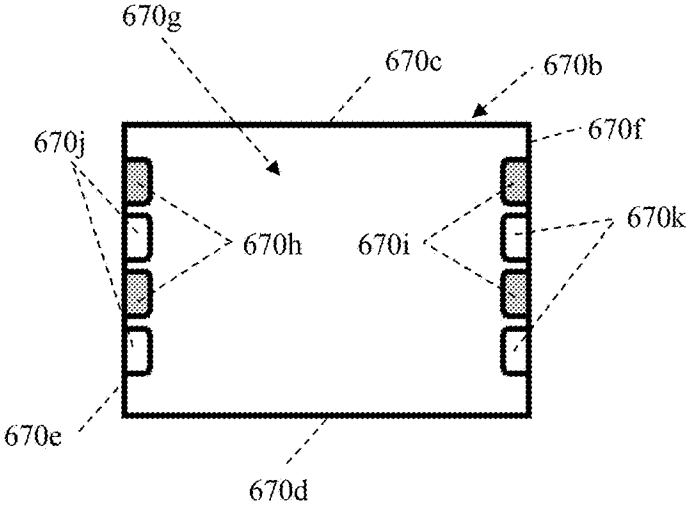
FIG. 17B shows a front view of the second boom member in FIG. 17A.
Figure 17C:
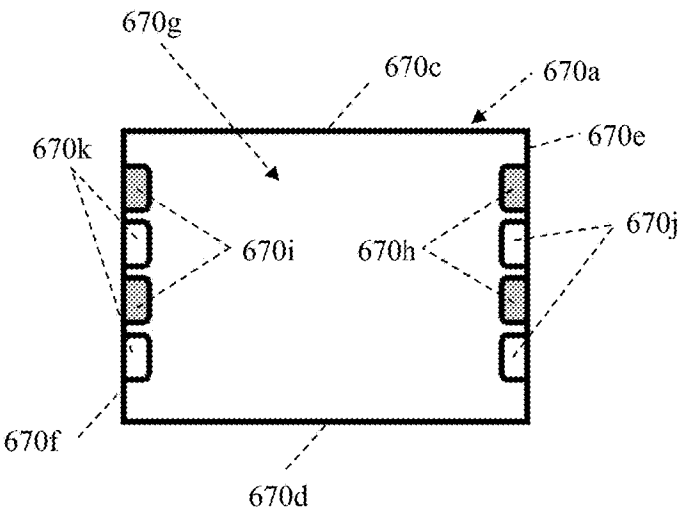
FIG. 17C shows a back view of the second boom member in FIG. 17A.

FIGS. 17A-17C illustrate an example of the second boom member 670. FIG. 17A is a side view of the second boom member 670. FIG. 17B is a front view of the second boom member 670. FIG. 17C is a back view of the second boom member 670. The second boom member 670 includes a first end 670, a second end 670*b*, a top surface 670*c*, a bottom surface 670*d*, a first side surface 670*e* and a second side surface 670*f* The top surface 670*c* is parallel to the bottom surface 670*d*. The first side surface 670*e* is parallel to the second side surface 670*f* The first side surface 670*e* is connected to the top surface 670*c* and connected to the bottom surface 670*d*. In an exemplary embodiment, the first side surface 670*e* is perpendicular to the top surface 670*c* and the bottom surface 670*d*. The second side surface 670*f* is connected to the top surface 670*c* and connected to the bottom surface 670*d*. In an exemplary embodiment, the second side surface 670*f* is perpendicular to the top surface 670*c* and the bottom surface 670*d*. The second extension member 606 is held within the second boom member 670, such that the second extension member 606 is surrounded by the top surface 670*c*, the bottom surface 670*d*, the first side surface 670*e* and the second side surface 670*f*. An opening extends from the first end 670*a* to the second end 670*b*, to form the hollow interior 670*g* that is surrounded by the top surface 670*c*, the bottom surface 670*d*, the first side surface 670*e* and the second side surface 670*f*.

The first side surface 670*e* includes one or more projections 670*h* and the second side surface 670*f* includes one or more projections 670*i*. The one or more projections 670*h* extend from an interior surface of the first side surface 670*e* towards the hollow interior 670*g*. Likewise, the one or more projections 670*i* extend from an interior surface of the second side surface 670*f* towards the hollow interior 670*g*. Each of the projections 670*h*, 670*i* may be disposed at (or near to) the second end 670*b*. In one exemplary embodiment, the one or more projections 670*h*, 670*i* are cylindrical-shaped. In another exemplary embodiment, the one or more projections 670*h* are disposed directly opposite the one or more projections 670*g*. In addition, the first side surface 670*e* also includes one or more grooves 670*j* and the second side surface 670*f* includes one or more grooves 670*k*. The one or more grooves 670*j* hold respective one or more projections 660*h* of the first boom member 660, such that the projections 660*h* are capable of moving (e.g., slide) from a first end of the grooves 670*j* to a second end of the grooves 670*j*, and vice versa. Likewise, the one or more grooves 670*k* hold respective one or more projections 660*i* of the first boom member 660, such that the projections 660*i* are capable of moving (e.g., slide) from a first end of the grooves 670*k* to a second end of the grooves 670*k*, and vice versa. The first and second ends of each of the grooves 670*j*, 670*k* prevent the projections 660*h*, 660*i* from moving beyond the first and second ends of each of the grooves 670*j*, 670*k*. As a consequence, while the second boom member 670 may slidably extend from a position inside the first boom member 660 to a position that is away from the first boom member 660, the cooperation of the projections 660*h*, 660*i* and the grooves 670*j*, 670*k* prevent the second boom member 670 from being removed or disconnected from the first boom member 660.

Figure 18A:
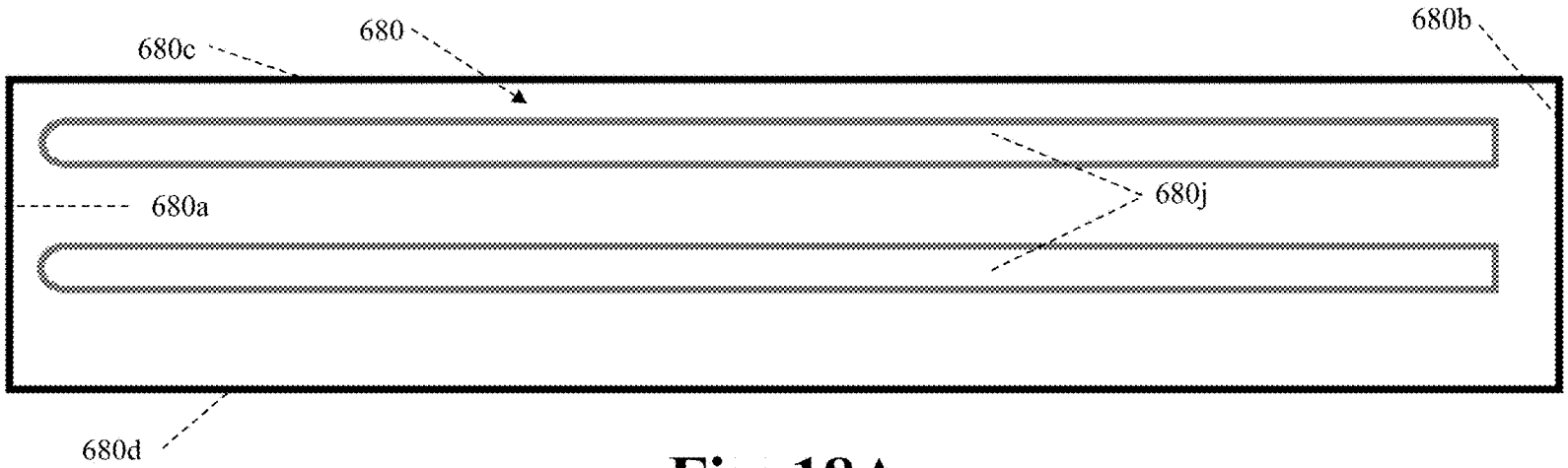
FIG. 18A shows a side view of a third boom member of the boom arm.
Figure 18B:
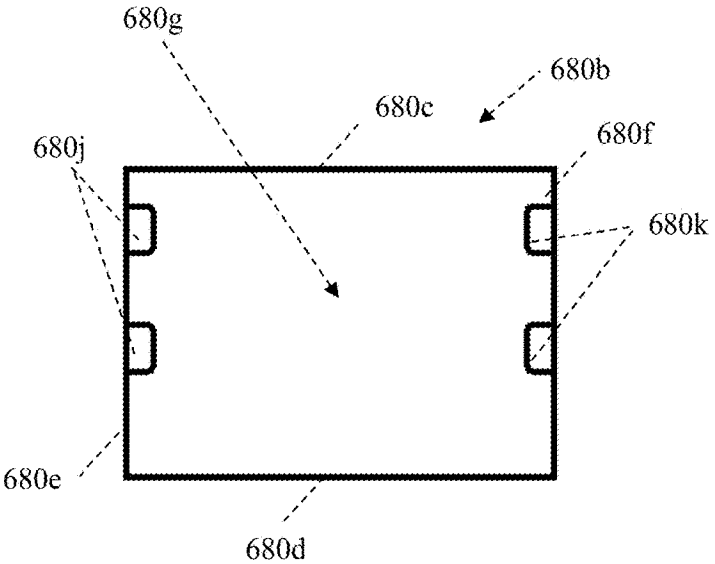
FIG. 18B shows a front view of the third boom member in FIG. 18A.
Figure 18C:
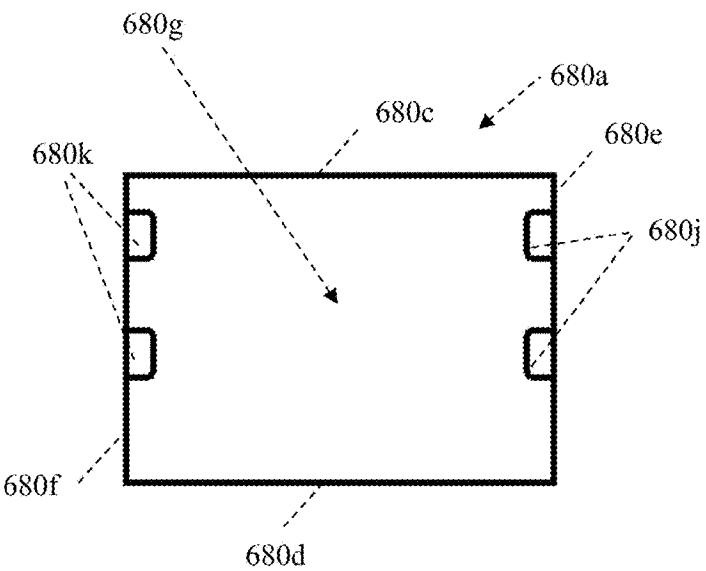
FIG. 18C shows a back view of the third boom member in FIG. 18A.

FIGS. 18A-18C illustrate an example of the second boom member 680. FIG. 18A is a side view of the third boom member 680. FIG. 18B is a front view of the third boom member 680. FIG. 18C is a back view of the third boom member 680. The third boom member 680 includes a first end 680*a*, a second end 680*b*, a top surface 680*c*, a bottom surface 680*d*, a first side surface 680*e* and a second side surface 680*f* The top surface 680*c* is parallel to the bottom surface 680*d*. The release valve 628 is fixedly attached to the first end 680*a* of the third boom member 680, such that the movement of the third boom member 680 also causes movement in the third extension member 608, and vice versa. The first side surface 680*e* is parallel to the second side surface 680*f* The first side surface 680*e* is connected to the top surface 680*c* and connected to the bottom surface 680*d*. In an exemplary embodiment, the first side surface 680*e* is perpendicular to the top surface 680*c* and the bottom surface 680*d*. The second side surface 680*f* is connected to the top surface 680*c* and connected to the bottom surface 680*d*. In an exemplary embodiment, the second side surface 680*f* is perpendicular to the top surface 680*c* and the bottom surface 680*d*. An opening extends from the first end 680*a* to the second end 680*b*, to form the hollow interior 680*g* that is surrounded by the top surface 680*c*, the bottom surface 680*d*, the first side surface 680*e* and the second side surface 680*f*.

In addition, the first side surface 680*e* also includes one or more grooves 680*j* and the second side surface 680*f* includes one or more grooves 680*k*. The one or more grooves 680*j* hold respective one or more projections 670*h* of the second boom member 670, such that the projections 670*h* are capable of moving (e.g., slide) from a first end of the grooves 680*j* to a second end of the grooves 680*j*, and vice versa. Likewise, the one or more grooves 680*k* hold respective one or more projections 670*i* of the second boom member 670, such that the projections 660*i* are capable of moving (e.g., slide) from a first end of the grooves 670*k* to a second end of the grooves 670*k*, and vice versa. The first and second ends of each of the grooves 680*j*, 680*k* prevent the projections 670*h*, 670*i* from moving beyond the first and second ends of each of the grooves 680*j*, 680*k*. As a consequence, while the third boom member 680 may slidably extend from a position inside the second boom member 670 to a position that is away from the second boom member 670, the cooperation of the projections 670*h*, 670*i* and the grooves 680*j*, 680*k* prevent the third boom member 680 from being removed or disconnected from the second boom member 670.

Figure 19:
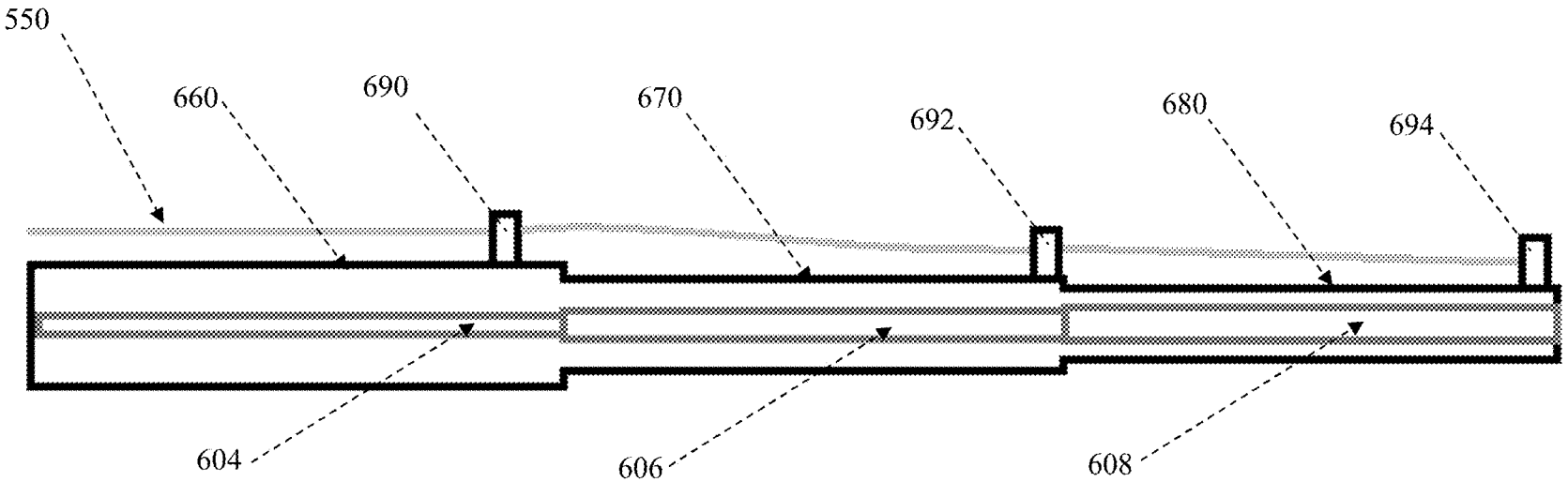
FIG. 19 shows a boom arm of the driving mechanism in an extended position with the extension arm held within.

As shown in FIGS. 15 and 19, the first boom member 660 may include a first cord guide 690 that is disposed on an exterior surface of the top surface 660*c*. The second boom member 670 may include a second cord guide 692 that is disposed on an exterior surface of the top surface 670*c*. The third boom member 680 may include a third cord guide 694 that is disposed on an exterior surface of the top surface 680*c*. The cord guides 690, 692, 694 each include an opening that allows the cord 550 to pass through. However, the openings of the cord guides 690, 692, 694 may not necessarily be coaxial, yet may still provide a guide for the cord 550. Also shown in FIG. 19 is the extension arm 602 (including first extension member 604, second extension member 606, and third extension member 608) held within the boom arm 650 (including the first boom arm 660, second boom arm 670 and third boom arm 680).

Figure 20:
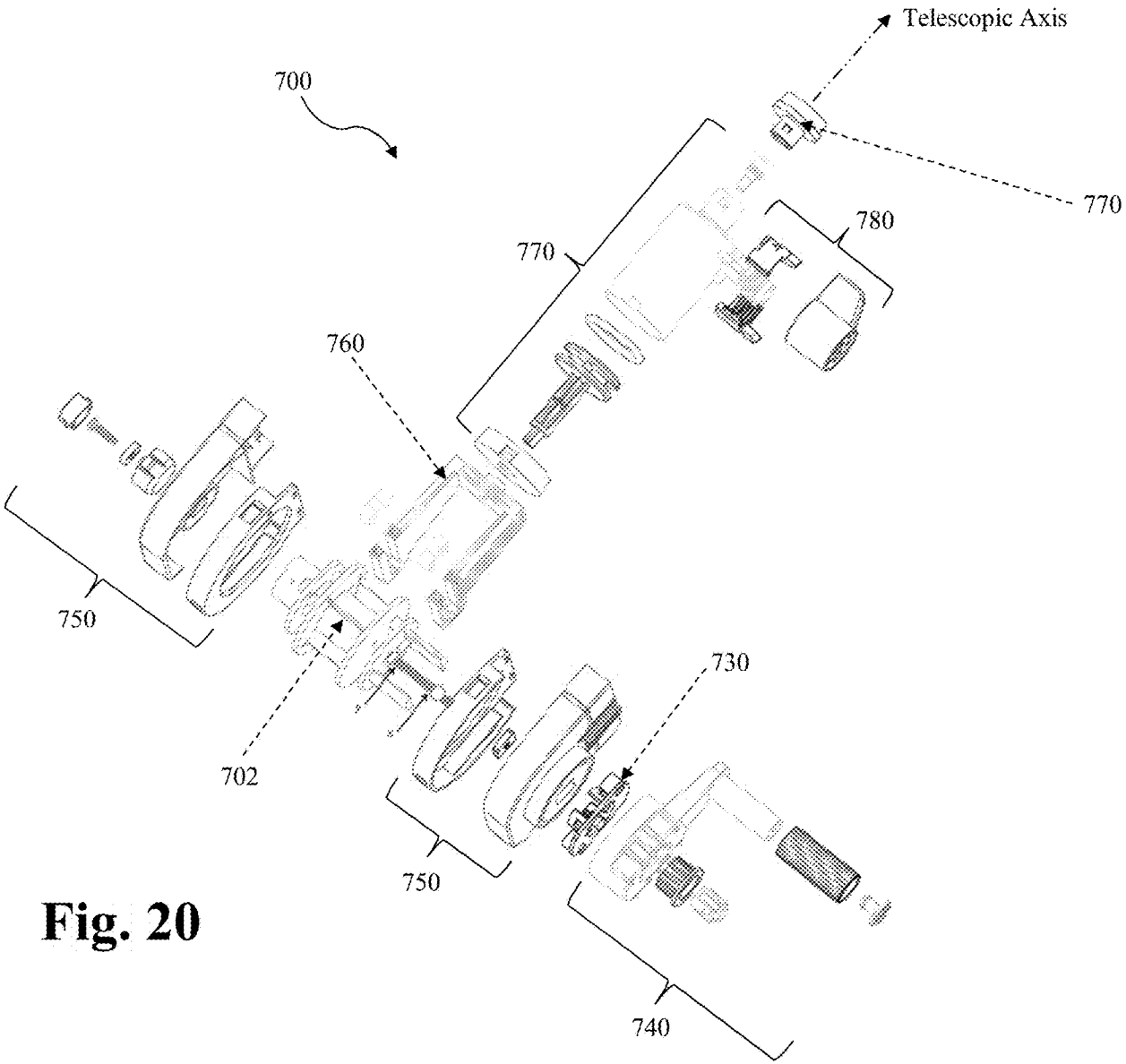
FIG. 20 shows an exploded view of the driving mechanism of the extendable crane arm mechanism.
Figure 21:
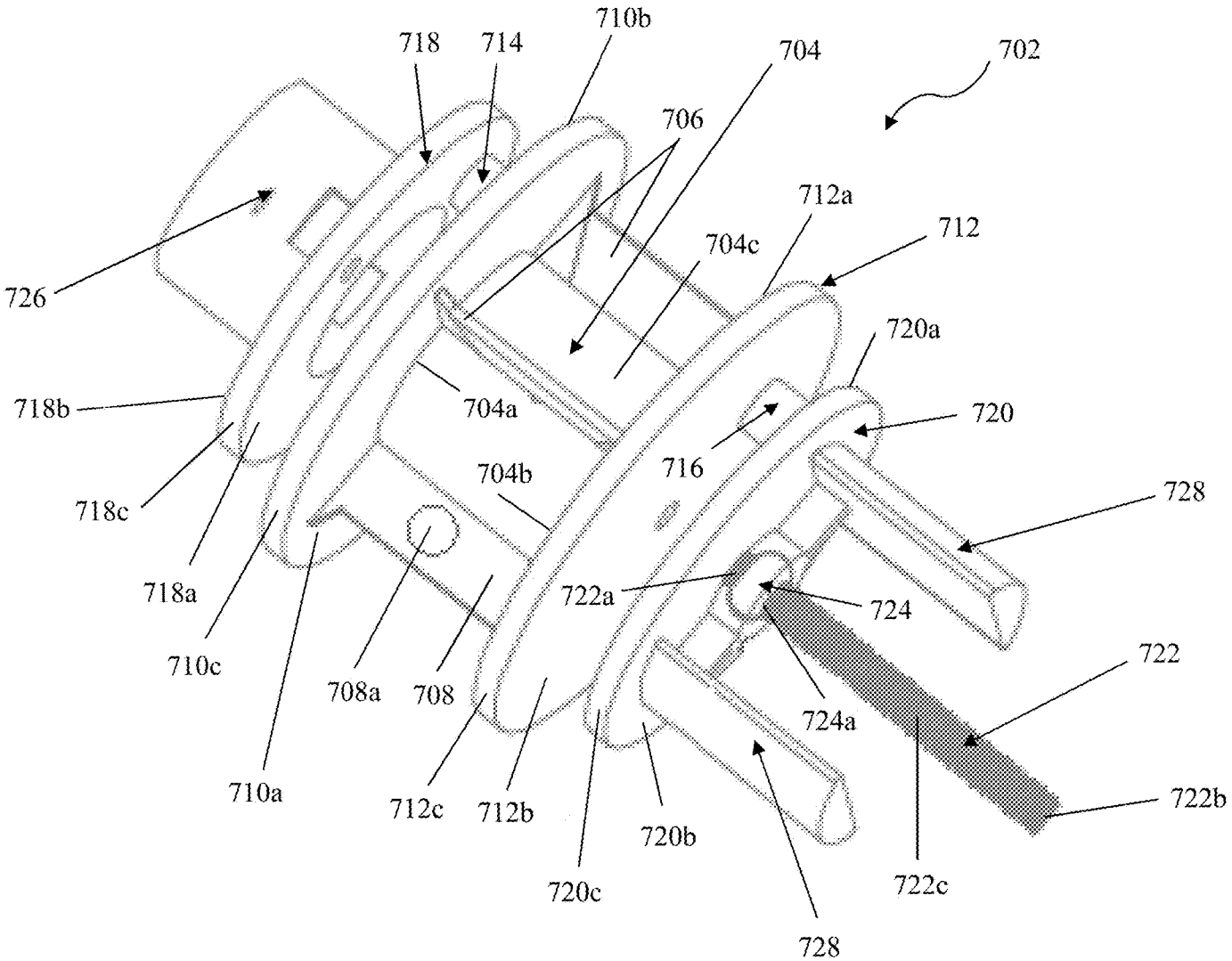
FIG. 21 shows a rotating member of the driving mechanism.

The crane arm 500 also includes a driving mechanism 700, as shown in FIG. 20. The driving mechanism 700 is connected to the first extension member 602 and the first boom member 660. The driving mechanism 700 includes a rotating member 702, a crank handle 740, a clutch 730, one or more arm supports 750, a driver 760, an air pump and knob control 780 and an air intake mechanism 790. As shown in FIG. 21, the rotating member 702 includes a winding portion 704 (like a spool) that holds the cord 550 such that at least the first end of the cord 550 is attached to the winding portion 704. For example, the winding portion 704 may have a cylindrical body that includes a first side 704*a* and a second side 704*b* that is parallel to the first side 704*a*. Both the first and second sides 704*a*, 704*b* have a circular shape and are connected to each other by a cylindrical wall 704*c*.

One or more fins 706 extend from such cylindrical wall 704*c* at a fixed length. Each of the one or more fins 706 may be an elongated structure having a first side 706*a* and second side 706*b* (both not numbered in the drawings) that are substantially flat. For example, each of the one or more fins 706 may be a cuboid. The one or more fins 706 includes an attachment fin 708, which has an opening 708*a* that is capable of allowing the cord 550 to pass through but remain attached to the winding portion 704. For example, the cord 550 may have a knot at one end that is a larger size than the opening of the attachment flange, such that the knot prevents the cord 550 from completely passing through the opening 708*a* of the attachment fin 708. In another example, the first end of the cord 550 may be tied to the attachment fin 708 by using the opening 708*a*. Thus, when the winding portion or spool 704 rotates, the cord 550 is wounded around or unwounded from the one or more fins 706.

A first flange 710 is connected to the first side 704*a* of the winding portion 704 and a second flange 712 is connected to the second side 704*b* of the winding portion 704. For example, the first flange 710 may be a cylindrical body having a first side 710*a*, a second side 710*b* and cylindrical wall 710*c* extending from the first side 710*a* to the second side 710*b*. Likewise, the second flange 712 may be a cylindrical body having a second side 712*a*, a second side 712*b* and cylindrical wall 710*c* extending from the first side 712*a* to the second side 712*b*. In an exemplary embodiment, the first flange 710 (second flange 712) may be a cylindrical body having a substantially flat first side 710*a* (712*a*) and a substantially flat second side 710*a* (712*a*) that is opposite the first side 710*a* (712*a*). In effect the component shown in FIG. 21 is like a fishing reel.

The first flange 710 and the second flange 712 may be coaxial (or concentric) with the winding portion 704, such that the centers of the first flange 710, second flange 712 and the winding portion 704 are on a first axis. In an exemplary embodiment, a radius of the first and/or second flange 710, 712 is greater than the radius of the winding portion 704. The first side 710*a* of the first flange 710 is directly attached to the first side 704*a* of the winding portion 704. Likewise, the first side 712*a* of the second flange 712 is directly attached to the second side 704*b* of the winding portion 704. In an exemplary embodiment, the first and second flanges 710, 712 may each have a radius that is greater than the length of each of the one or more fins 706 (including attachment fin 708). The first and second flanges 710, 712 assist the rotating member 712 in keeping the cord 550 wounded around the one or more fins 706 (including attachment fin 708), such that the cord 550 does not deviate away from the winding portion 704.

Figure 22A:
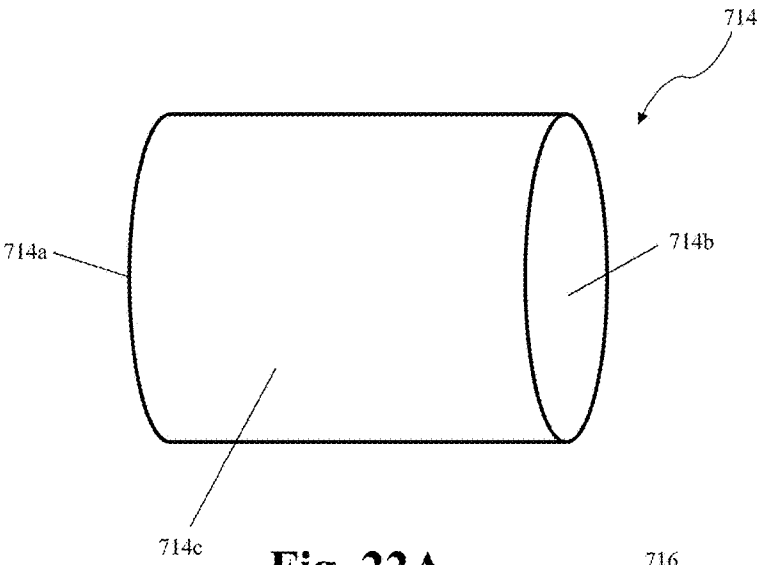
FIGS. 22A and 22B show a first driving shaft and a second driving shaft of the rotating member.
Figure 22B:
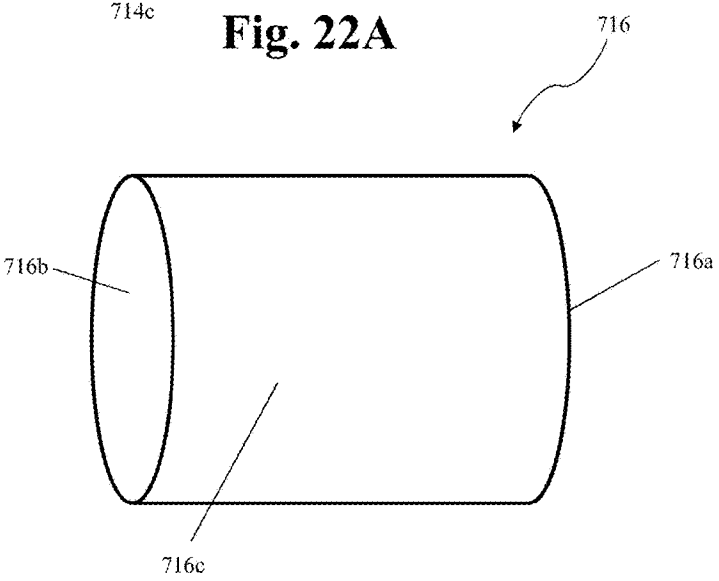

A first driving shaft 714 extends from the first flange 710, as shown in FIGS. 21 and 22A, and a second driving shaft 716 extends from the second flange 712, as shown in FIG. 22B. For example, the first driving shaft 714 may be a cylindrical body having a first side 714*a*, a second side 714*b* and a cylindrical wall 714*c* extending from the first side 714*a* to the second side 714*b*. Likewise, the second driving shaft 716 may be a cylindrical body having a first side 716*a*, a second side 716*b* and a cylindrical wall 716*c* extending from the first side 716*a* to the second side 716*b*. As such, the first side 714*a* of the first driving shaft 714 may be connected to the second side 710*b* of the first flange 710, and the first side 716*a* of the second driving shaft 716 may be connected to the second side 712*b* of the second flange 712.

The first driving shaft 714 may extend perpendicularly from the second side 710*b* of the first flange 710 from a first driving position. Such first driving position may be any position that is between an edge (e.g., circumference) of the second side 710*b* and a center of the second side 710*b* (i.e., the first driving position is offset from the center). Likewise, the second driving shaft 716 may extend perpendicularly from the second side 712*b* of the second flange 712 from a second driving position. Such second driving position may be any position that is between an edge (e.g., circumference) of the second side 712*b* and a center of the second side 712*b* (i.e., the second driving position is offset from the center). It should be noted that the first driving position and the second driving position are disposed on the same axis, such that the centers of the first driving shaft 714 and the second driving shaft 716 are on a second axis, but are not on the first axis.

A first disc 718 is connected to the first driving shaft 714 and a second disc 720 is connected to the second driving shaft 716. For example, the first disc 718 may be a cylindrical body having a first side 718*a*, a second side 718*b* and a cylindrical wall 718*c* extending from the first side 718*a* to the second side 718*b*. Likewise, the second disc 720 may be a cylindrical body having a first side 720*a*, a second side 720*b* and a cylindrical wall 720*c* extending from the first side 720*a* to the second side 720*b*. The first driving shaft 714 is attached to the first disc 718 at a position that is between an edge (e.g., circumference) of the first side 718*a* and a center of the first side 718*a* (i.e., offset from the center). Likewise, the second driving shaft 716 is attached to the second disc 718 at a position that is between an edge (e.g., circumference) of the first side 718*a* and a center of the first side 718*a* (i.e., offset from the center). The first and second discs 718, 720 may be coaxial (i.e., concentric) with the first and second flanges 714, 716 and winding portion 704, such that the centers of the winding portion 704, the first flange 710, the second flange 712, the first disc 718 and the second disc 720 are on the first axis.

A release shaft 722 extends from the second side 720*b* of the second disc 720. For example, the release shaft 722 may extend perpendicularly from the second side 720*b* of the second disc 720. The release shaft 722 may include a cylindrical body that has a first end 722*a*, a second end 722*b* and a cylindrical wall 722*c* that extends from the first end 722*a* towards the second end 722*b*. For example, the release shaft 722 may be an elongated cylindrical rod that is capable of rotating. The release shaft 722 may also include a releasing member that moves along the release shaft 722. The cylindrical wall 722*c* may include a track or thread that allows the releasing member 724 to travel along the release shaft 722. For example, the releasing member 724 may be a fastener, such as a nut, that includes a threaded opening 724*a* that is capable of receiving the thread of the cylindrical wall 722*c*. Thus, as the release shaft 722 rotates, the releasing member 724 travels along the thread of the cylindrical wall 722*c* from the first end 722*a* to the second end 722*b*.

A rotational support member 726 includes a first side 726*a*, a second side 726*b* and a cylindrical wall 726*c* that extends from the first side 726*a* to the second side 726*b* (not numbered in the drawings). In addition, the rotational support member 726 may also include an opening that extends from the first side 726*a* to a position between the first side 726*a* and the second side 726*b*. For example, the opening may extend from the first side 726*a* to a middle of the rotation support member 726. The rotational support member 726 interacts with the one or more arm supports 750 (See FIG. 20) to provide support to the rotating member 702, when the rotating member 702 is caused to rotate. In other words, the rotation support member 726 cooperates with the one or more arm supports 750 to assist in holding up the rotating member 702, which allows the rotating member 702 to rotate freely when the crank handle 740 is rotated.

One or more linking members 728 (FIG. 21) are attached to the second side 720*b* of the second disc 720, such that the one or more linking members extend perpendicularly from the second side 720*b* of the second disc 720. The one or more linking members 728 may be positioned such that the one or more linking members 728 and the release shaft 722 are in alignment. The linking members 728 may be elongated. Further, the linking members 728 may have a constant distance between each other.

Figure 23:
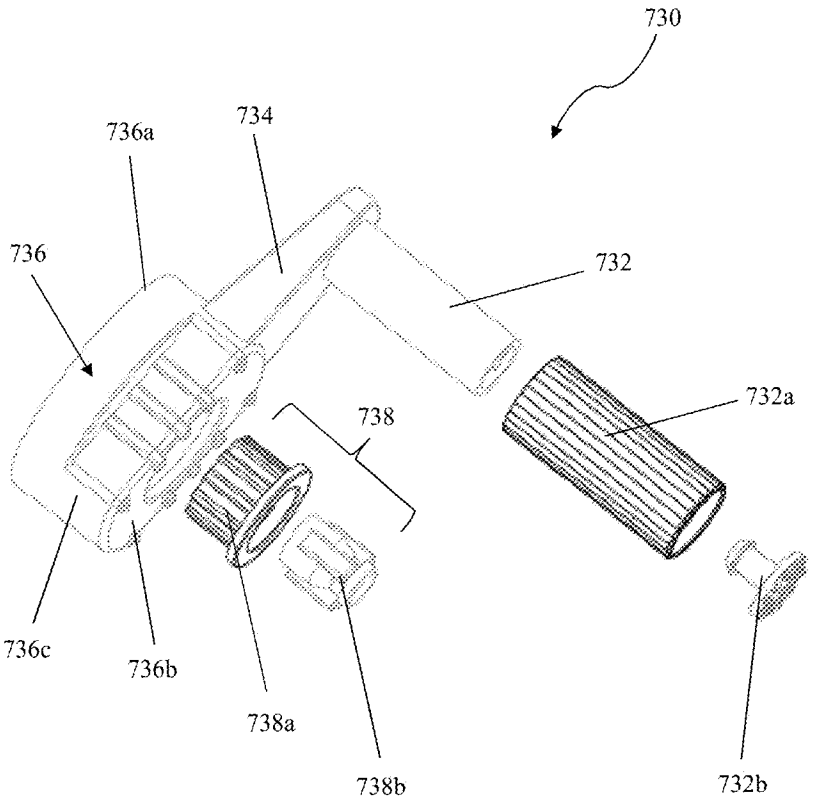
FIG. 23 shows a crank of the driving mechanism.

As shown in FIG. 23, the crank 730 includes a crank handle 732, a crank arm 734 and a crank rotator 736. The crank handle 732 can be gripped by a hand of a child or person for the purpose of rotating the crank 730. The crank handle 732 is connected to the crank arm 734 in a substantially perpendicular manner. In turn, the crank arm 734 is connected to the crank rotator 736. More specifically, the crank arm 734 extends outwardly from the crank rotator 736. In one exemplary embodiment, the crank rotator 736 may have a cylindrical body that includes a first side 736*a*, a second side 736*b* and a cylindrical wall 736*c* that extends from the first side 736*a* toward the second side 736*b*, such that the crank arm 734 extends away perpendicularly from the cylindrical wall 736*c*. A rotatable knob 732*a* is connected over the handle 732 and held there by a stopper 732*b* to make it easier and without friction for the rotation of the handle in either of two directions of rotation.

The clutch 730 connects and disconnects the release shaft 722 to the crank handle. More specifically, the clutch 730 is connected to the release shaft 722, and can engage or disengage with the crank rotator 736 of the crank handle based on the position of the releasing member 724 on the release shaft 722. For example, when the crank is continuously rotated in a clockwise direction, the release shaft 722 also rotates in the clockwise direction causing the releasing member 724 to move along the release shaft 722 in a first direction towards a first releasing position. Likewise, in a similar manner, when the crank 730 is continuously rotated in a counter-clockwise direction, the release shaft 722 also rotates in the counter-clockwise direction causing the releasing member 724 to move along the release shaft 722 in a second direction (opposite the first direction) towards a second releasing position. In a case that the releasing member 724 reaches the end of either the first releasing position or the second releasing position, the releasing member 724 automatically causes the clutch 740 to disengage from the crank 736. When such disengagement occurs, the crank handle can be further continuously rotated without having any effect (e.g., rotational effect) upon the release shaft 722. In other words, as the crank handle and crank 730 rotate, the release shaft 722 may remain motionless.

Likewise, when the releasing member 724 is moved away from the first or second releasing positions, the clutch 740 automatically engages the crank 730 allowing the continuous rotation of the crank 730 to have an effect (e.g., rotational effect) upon the release shaft 722. In other words, as the crank 730 rotates, the release shaft 722 rotates as well. By including the aforementioned configuration of having the clutch 740 engage and disengage the crank 730, the over winding of the cord 550 can be prevented. In other words, the thread of the release shaft 722 is specifically configured to move the releasing member 724 to the first or second releasing positions once the cord 550 is in danger of being overwound. For example, a child unknowingly may overwind the cord 550 possibly causing damage to the crane arm 400 (or by extension, the toy truck 100) or causing the cord 550 to break or rip. The clutch mechanism prevents that.

Figure 24:
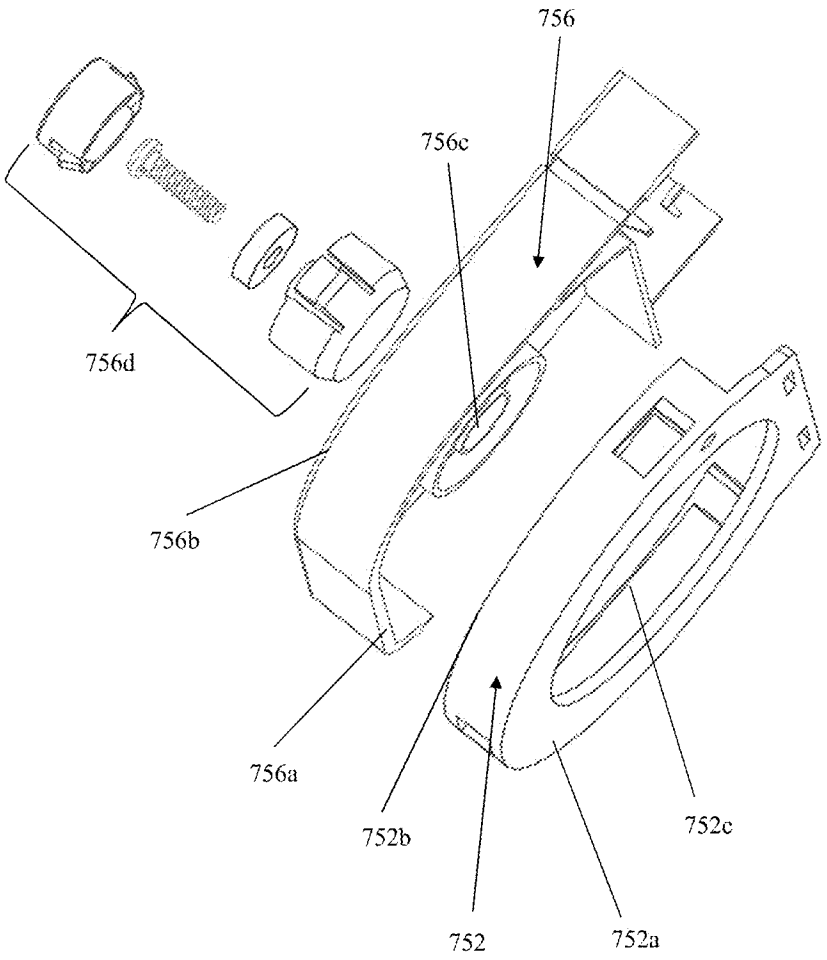
FIG. 24 shows a first inner support and a first outer support of the driving mechanism.

The arm support 750 may include a first inner support 752, a second inner support, a first outer support 756 and a second outer support. As shown in FIG. 24, the first inner support 752 includes a first side 752*a*, a second side 752*b* that is opposite the first side 752*a*, and an opening 752*c* that extends from the first side 752*a* to the second side 752*b*. Such opening 752*c* may be circularly-shaped, such that the opening 752*c* includes a radius that is equivalent to the radius of the first flange 710, thereby configuring the opening 752*c* to be capable of being fitted onto and over the flange. Thus, the first inner support 752 is disposed on the rotating member 702, such that the first flange 710 is held within the opening 752*c* of the first inner support 752 in a manner that creates a smooth continuous surface along the second side 752*b* and the second side 710*b* of the first flange 710. As a result, the first inner support 752 provides additional protection against keeping the cord 550 wounded around the one or more fins 706 (including attachment fin 708), such that the cord 550 does not deviate away from the winding portion 704.

Figure 25:
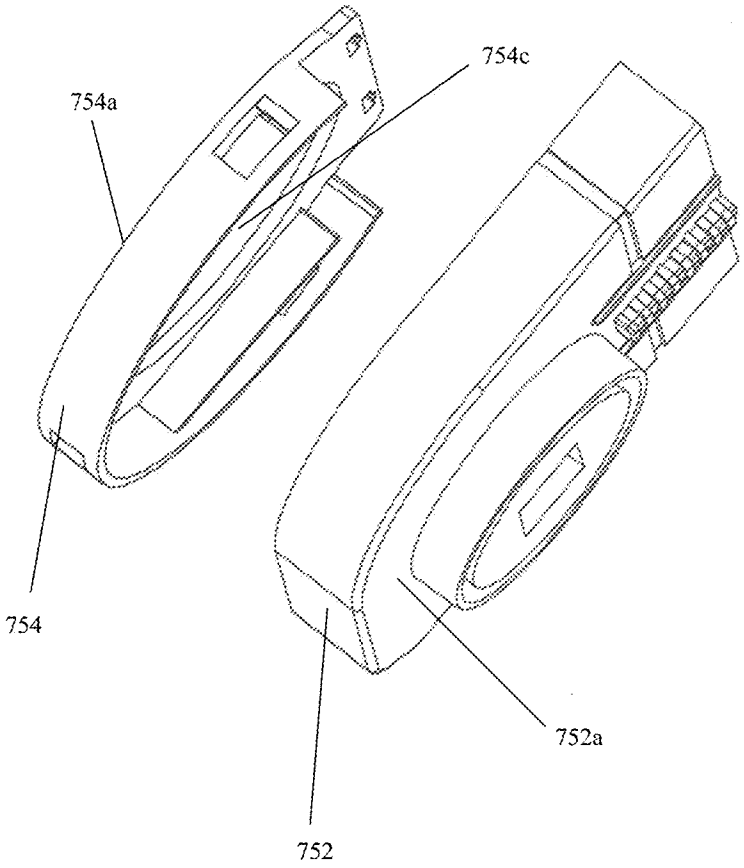
FIG. 25 shows a second inner support and a second outer support of the driving mechanism.
Figure 26:
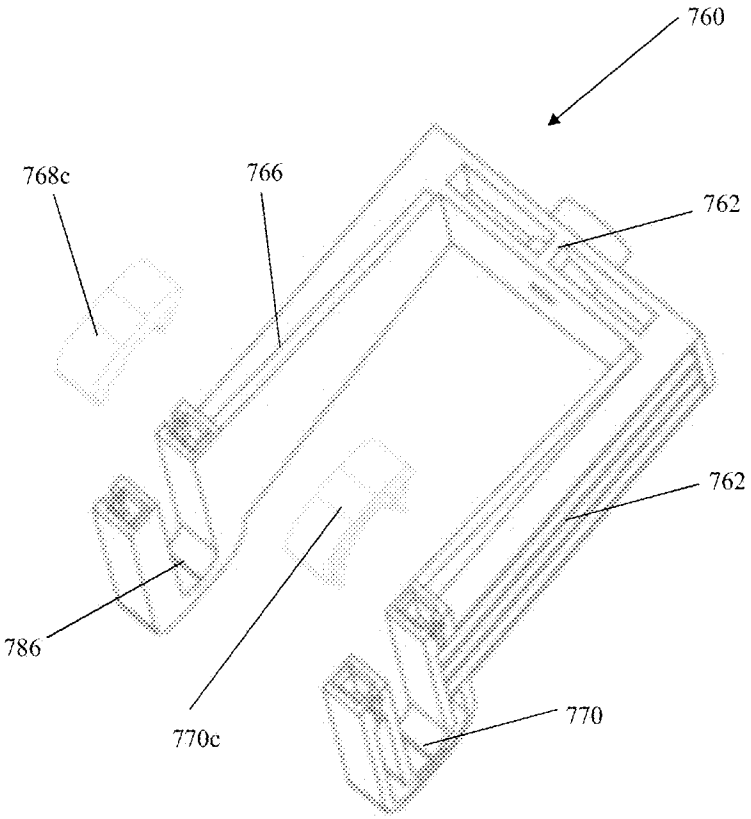
FIG. 26 shows a driver of the driving mechanism.

As shown in FIG. 25, the second inner support 754 includes a first side 754*a*, a second side that is opposite the first side 754*a*, and an opening 754*c* that extends from the first side 754*a* to the second side 754*b*. Such opening 754*c* may be circularly-shaped, such that the opening 754*c* includes a radius that is equivalent to the radius of the second flange 712, thereby configuring the opening 754*c* to be capable of being fitted onto and over the flange 712. Thus, the second inner support 754 is disposed on the rotating member 702, such that the second flange 712 is held within the opening 754*c* of the second inner support 754 in a manner that creates a smooth continuous surface along the first side 742*a* and the first side 712*a* of the second flange 712. As a result, the second inner support 754 provides additional protection against keeping the cord 550 wound around the one or more fins 706 (including attachment fin 708), such that the cord 550 does not deviate away from the winding portion 704.

As shown in FIG. 24, the first outer support 756 is connected to the rotating member 702, such that the first outer support 756 provides a protective cover for the driving mechanism 700. The first outer support may include first side 756*a*, a second side 756*b* and an opening 756*c* extending from the first side 756*a* to the second side 756*b*. The opening 756*b* is configured to receive (and hold) the rotational support member 726 of the rotating member 702. The first outer support 756 may include one or more fastening members 756*d* that are configured to secure the first outer support 765 to the rotational support member 726, such that the rotating member 702 is capable of rotating, while the first outer support remains static. In addition, the first outer support 756 is attached to the crane cabin 400.

As shown in FIG. 25, the second outer support 754 is connected to the rotating member 702, such that the second outer support 754 provides a protective cover for the driving mechanism 700. The second outer support may include first side 754*a*, a second side, and an opening 754*c* extending from the first side 754*a* to the second side 754*b*. The second side 754 is connected to the clutch 740 and the crank 730. The opening 754*c* is configured to receive the release shaft 722 of the rotating member 702, and allows the release shaft 722 to pass through. In one exemplary embodiment, the second outer support 754 may include grooves on the first side 754*a* that can receive the one or more linking members 728 such that the rotating member 702 is capable of rotating, while the second outer support 758 remains static. In addition, the first outer support 758 is attached to the crane cabin 400. The first outer support 756 and the second outer support 754 are configured to cooperate with each other in order to connect the crane arm 500 to the crane cabin 400, such that the crane arm 500 is pivotable with respect to the crane cabin 400. Thus, the crane arm 500 can be moved in a vertical direction. More specifically, the crane arm 500 is able to pivot around the first axis.

As shown, the driver 760 converts the rotational motion of the crank 730 into linear motion (e.g., reciprocating motion). In other words, the driver 760 may function similarly to a crankshaft. The driver 760 includes a first elongated member 762, a second elongated member 764 and a third elongated member 766. The first elongated member 762 includes a first end and a second end. The second elongated member 764 includes a first end 764*a* and a second end 764*b*. The third elongated member 766 includes a first end and a second end. The first end 762*a* of the first elongated member 762 is connected to the first end 764*a* of the second elongated member 764. For example, the second elongated member 764 may be perpendicular with respect to the first elongated member 762. The second end 762*b* of the first elongated member 762 is connected to the first end 766*a* of the third elongated member. For example, the third elongated member 766 may be perpendicular with respect to the first elongated member 762. In an exemplary embodiment, the second elongated member 764 and the third elongated member 766 may be parallel to each other. In effect, these elongated members from a U-shape.

A first smaller U-shape is connected to the second elongated member 764. For example, the first smaller U-shape 786 may include a wall that defines and encloses an opening. Such opening may have the shape of an ellipse having a minor axis and a major axis. In another example, the first U-shape may also include a first cover 768*c* that can be removed from the first U-shape, such that the opening 786*b* becomes O-shaped. Initially, when the first cover is removed, the first driving shaft 714 can be inserted into the U-shaped opening. After the first driving shaft 714 is inserted, the first cover 768*c* can be reattached to the first U-shape 786. For example, the radius of the first driving shaft 714 may be substantially similar to the minor axis of opening. As the first driving shaft 714 rotates, the first driving shaft 714 travels in a vertical direction on the major axis of the opening.

A second U-shape 770 is connected to the third elongated member 762. For example, the second U-shape may include a loop wall that defines an opening 770. Such opening 770 may have the shape of an ellipse (when closed off by its cover 770*c*) having a minor axis and a major axis. In another example, the second U-shape 770 may also include a second cover 770*c* that can be removed from the second U-shape 770, such that the opening 770 becomes U-shaped. Initially, when the second cover 770*c* is removed, the second driving shaft 716 can be inserted into the opening 770. After, the second driving shaft 714 is inserted, the second cover 770*c* can be reattached to the second U-shape to form an O-shape. For example, the radius of the second driving shaft may be substantially similar to the minor axis of opening 770, when the opening 770 is an ellipse. As the second driving shaft 716 rotates, the second driving shaft 716 travels in a vertical direction on the major axis of the opening 770.

Figure 27:
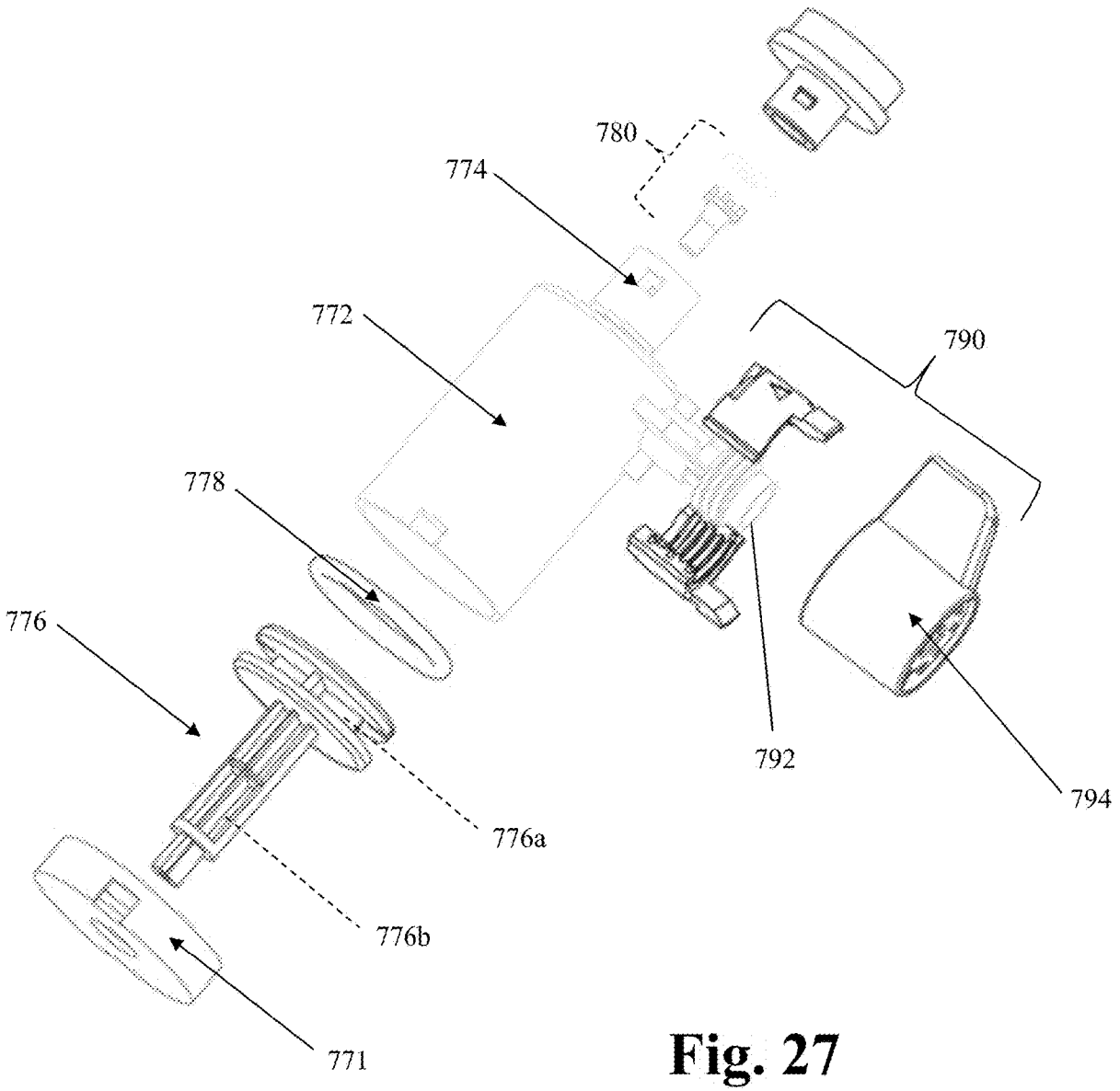
FIG. 27 shows an air pump of the driving mechanism.

As shown in FIG. 27, the air pump 770 includes a drive connector 771, a first chamber 772, a second chamber 774, a piston 776, an air seal 778 and a check valve 780. The drive connector 771 connects the driver 760 to the piston 776. It should be noted that the drive connector 771 is an optional component, and that the driver 760 can be attached directly to the piston 776. The first chamber 772 includes a first end 772*a*, a second end 772*b*, a cylindrical wall 772*c* that extends from the first end 772*a* to the second end 772*b*, and a hollow interior 772*d*. The first end 772*a* includes a first opening 772*e* that is capable of receiving the piston 776. The second end 772*b* includes a second opening 772*f* that has a substantially smaller cross-sectional area than the first opening 772*e*. As such, for example, the piston 776 may not be capable of passing through the second opening 772*f*. An air intake portion 772*g* is attached to the first chamber 772, such that the air intake portion 772*g* extends in a perpendicular manner away from the cylindrical wall 772*c*. The air intake portion 772*g* allows air external to the first chamber 772 to enter the first chamber 772. The second chamber 774 includes a first end 774*a*, a second end 774*b*, a cylindrical wall 774*c* that extends from the first end 774*a* to the second end 774*b*, and a hollow interior 774*d*. The first end 774*a* includes a first opening 774*e* and the second end includes a second opening 774*f*. In one exemplary embodiment, both the first opening 774*e* and the second opening 774*f* may have a cross-sectional area that is substantially the same as the second opening 772*f*. In one exemplary embodiment the second chamber 774 may be integrally connected to the first chamber 772.

Figure 28A:
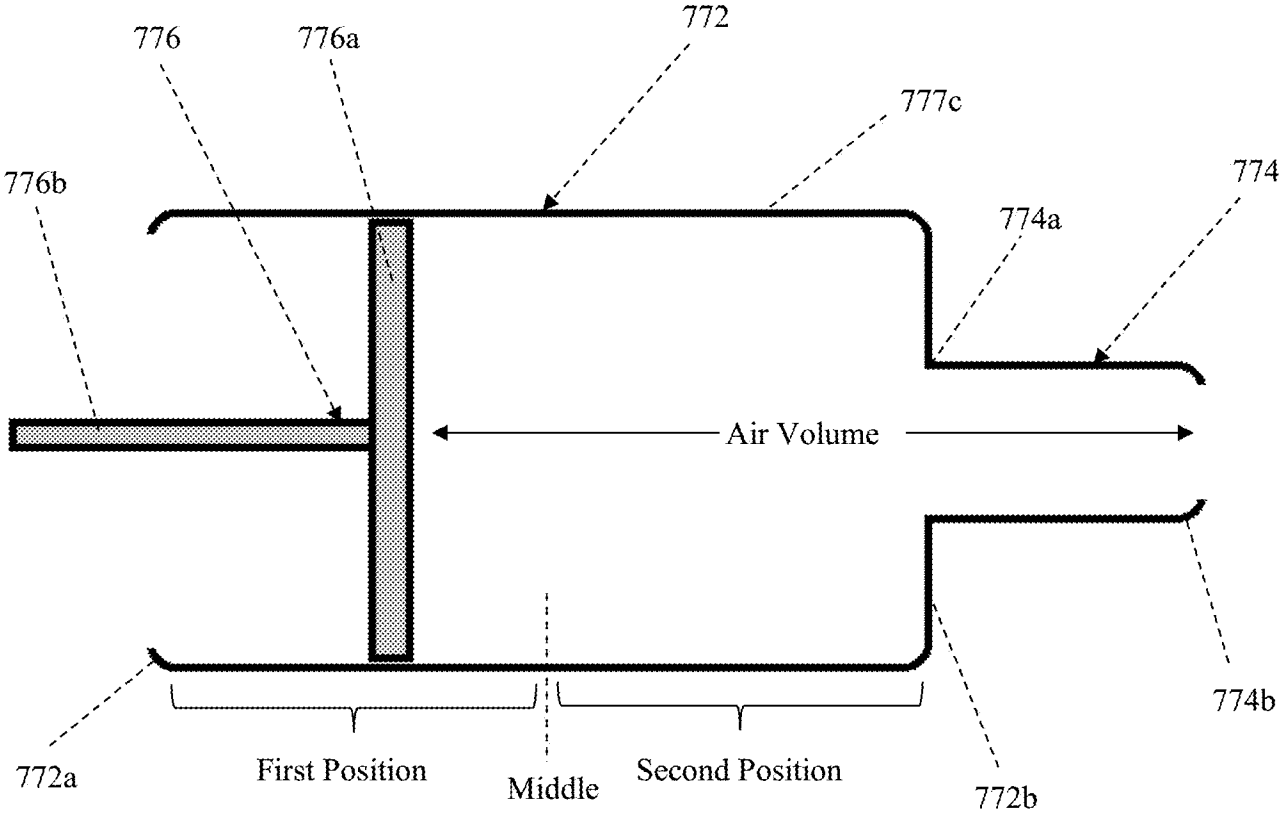
FIGS. 28A and 28B show a piston of the air pump moving within a first chamber of the air pump.
Figure 28B:
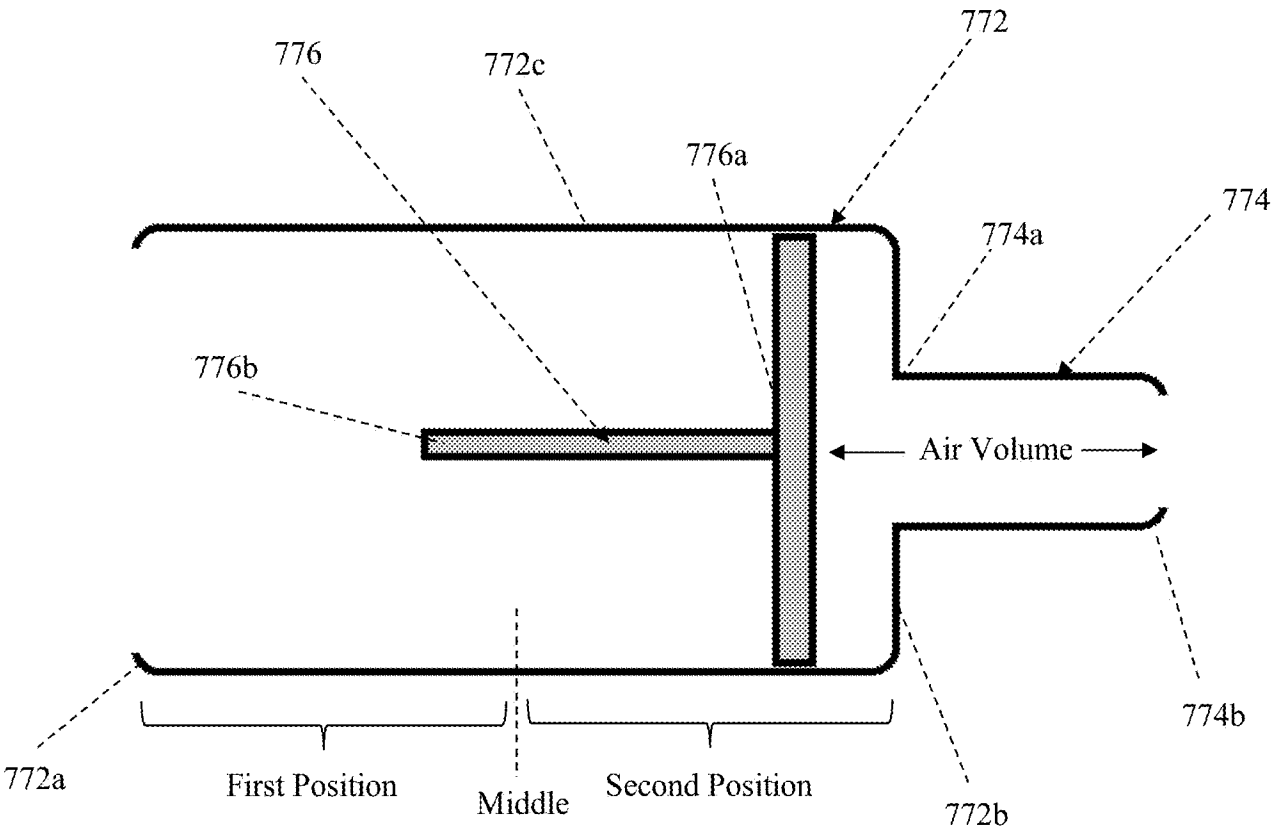

The piston 776 includes a plunger like an air compressing member 776*a* and a connecting rod 776*b*. The air compressing member 776*a* includes a cross-sectional area that is substantially the same as the cross-sectional area as the first opening 772*e*, such that the piston 776 fits neatly into the first chamber 772, while being able to slide towards the second end 722*b* and slide back towards the first end 722*a*. The connecting rod 776*b* includes a first end that is connected to the drive connector 771 or directly to the driver 760 and a second end that is connected to the air compressing member 776*a*. The piston 776 may be capable of moving from a first position to a second position, and vice versa on the telescopic axis. In one exemplary embodiment, the first position may be any position between the first end 772*a* of the chamber 772 and the middle of the chamber 772, and the second position may be any position between the second end 772*b* and the middle of the chamber 772. In another exemplary embodiment, the first position is at the first end 772*a* of the chamber 772 or the closest position that the piston 774 is capable of moving towards the first end 772*a*. The second position is at the second end 772*b* of the chamber 772 or the closest position that the piston 774 is capable of moving towards the second end 772*b*. In other words, the first position is closer to the first end 772*a* of the chamber 772 than the second position is. Likewise, the second position is closer to the second end 772*b* of the chamber 772 than the first position is. As such, the piston 776, the cylindrical wall 772*c*, the cylindrical wall 774*c*, and the second end 774*b* forms a variable continuous air volume within the first chamber 772 and the second chamber 774. As shown in FIGS. 28A and 28B, as the piston 776 moves from the first position to the second position, the piston 776 causes the air volume to decrease. Likewise, as the piston 776 moves from the second position to the first position, the air volume increases.

The air seal 778 prevents air from escaping via any openings between the piston 776 and the first chamber 772. For example, the air seal 778 may be a rubber O-ring or washer. The air seal 778 is disposed adjacent to the air compressing member 776*a*, such that the air seal 778 completely prevents any air from escaping the first chamber 772. As such, the air seal 778 allows the air to be held inside the first chamber 772. The check valve 780 includes a first end 780*a* and a second end 780*b*. The first end 780*a* is connected to the second end 774*b* of the second chamber 774. The check valve 780 allows air to flow in a single direction from the first end 780*a* to the second end 780*b*. As such, the check valve 780 prevents air from flowing from the second end 780*b* to the first end 780*a*. The check valve 780 prevents any moving air from passing through the first end 780*a* to the second end 780*b* until an air pressure threshold is exceeded. In other words, if the pressure of the moving air is below the air pressure threshold, the check valve 780 acts to prevent the moving air from moving through the check valve 780. On the other hand, in the case that the pressure of the air is above or equal to the air pressure threshold, the check valve 780 activates to permit the moving air to pass through from the first end 780*a* to the second end 780*b*.

The air intake mechanism 790 is connected to the air pump 770. More specifically, the air intake mechanism 790 is connected to the air intake portion 772*g*. The air intake mechanism 790 includes an airflow controller 792 and a selector 794. The airflow controller 792 is attached to the air intake portion 772*g*, such that the airflow controller 792 can control the flow of air into the air intake portion 772*g* (and by extension the first chamber 772). For example, the airflow controller 792 can allow air to flow into the air intake portion 772*g* or the airflow controller 792 can prevent air from flowing into the air intake portion 772*g*. The selector 794 controls the operations of the airflow controller 792. In other words, the selector 794 determines whether the airflow controller 792 is to allow air to flow into the air intake portion 772*g*. The selector 794 can move from an intake position to a closing position. When the selector 794 is in the intake position, the selector 794 causes the airflow controller 792 to allow air into the air intake portion 772*g* (and by extension the first chamber 772). When the selector 794 is in the closing position, the selector 794 prevents the airflow controller 792 from allowing air into the air intake portion 772*g* (and by extension the first chamber 772). In an exemplary embodiment, the selector 794 may be a knob that is rotatable from the intake position to the closing position.

Figure 29:
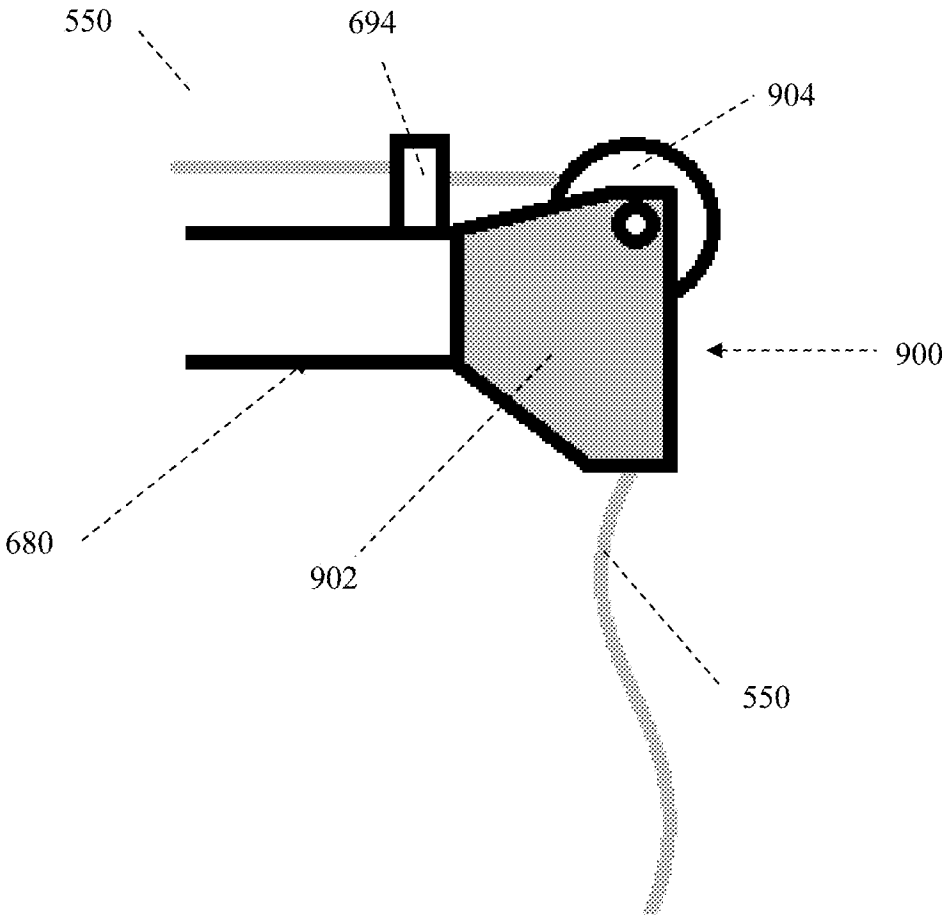
FIG. 29 shows an air release mechanism of the extendable crane arm mechanism.

As shown in FIG. 29, the air release mechanism 900 is attached to the second end 680*b* of the third boom member 680. The air release mechanism 900 includes a body 902, a sheave 904 and a release activator 906. The body 102 holds the sheave 904 and release activator 906, and is attached to the third boom member 680. The sheave 904 may be a wheel with a groove in the center of the wheel (e.g., pulley wheel). The groove of the sheave 904 assists in guiding the cord 550, as the cord 550 is causing hook 570 to be lowered or raised. The release activator 906 is pivotable and disposed below the sheave 904. The release activator 906 may have a first portion 906*a*, a second portion 906*b* and a pivoting portion 906*c* connected between the first portion 906*a* and the second portion 906*b*. In an exemplary embodiment, the first portion 906*a* and the second portion 906*b* may be at an angle with respect to the other. In another exemplary embodiment, the release activator 904 may be L-shaped.

Figure 30A:
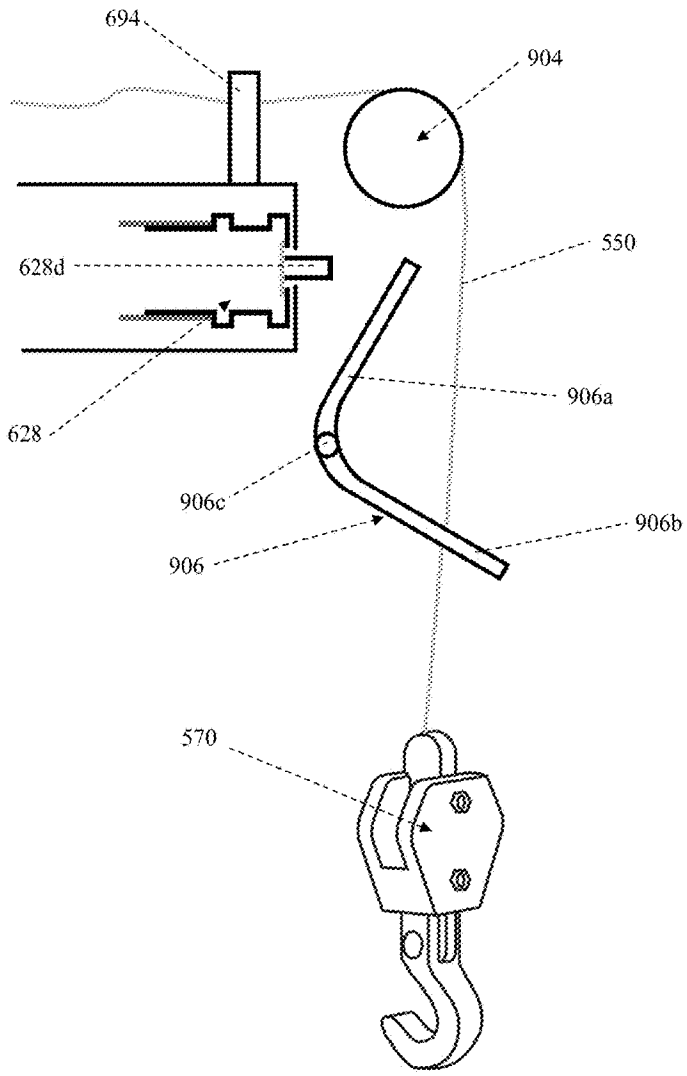
FIG. 30A-30B show the air release mechanism activating the release valve.
Figure 30B:
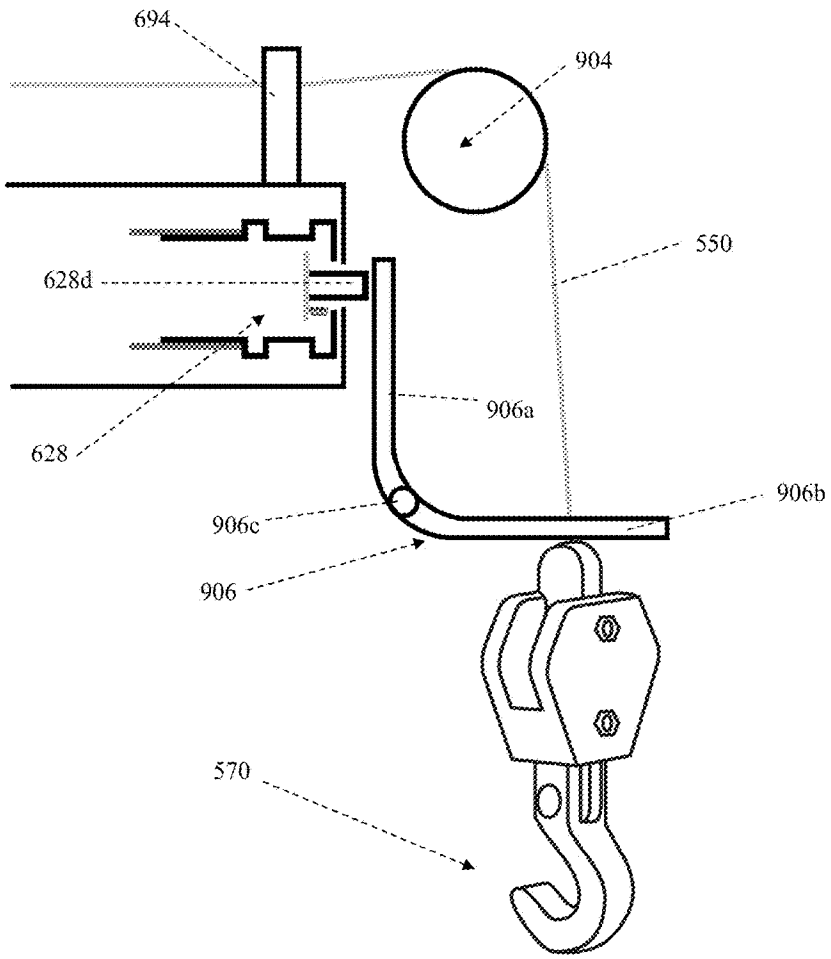

The release activator 906 includes an opening or aperture that has a cross-sectional area that is large enough for the cord 550 to pass through. However, the cross-sectional area of the aforementioned opening is not large enough for the hook 570 to pass through. As such, when the hook 570 is being raised, the hook 570 eventually contacts the second portion 906*b* of the release activator 906, which in turn pivots (via the pivoting axis or portion 906*c*) the first portion 906*a* of the release activator 906 then pushes into the release pin 628*d* of the release valve 628 (causing the spring 628*f* to extend) as shown in FIGS. 30A and 30B. In the case that the air pressure within the extension arm 602 is greater than the air pressure external to the extension arm 602 (e.g., atmospheric pressure) the air within the extension arm 602 is released, thereby allowing the telescopic arm 600 to retract.

Figure 31A:
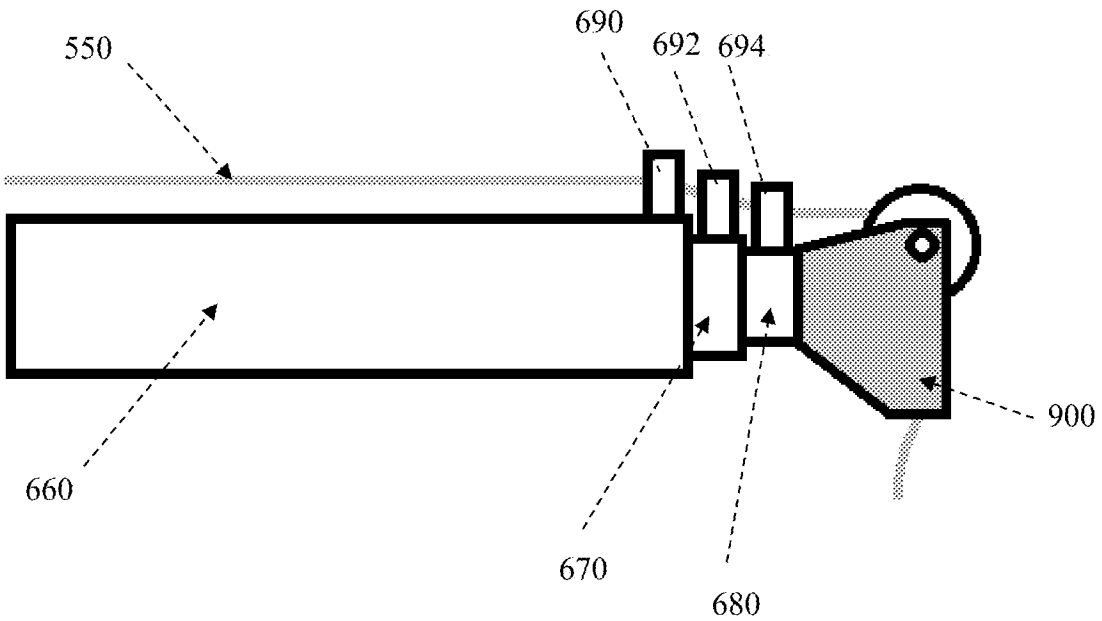
FIG. 31A-31C show the crane arm moving from a retracted position to an extended position.

The following is a process for causing the crane arm 500 to extend from a retracted position to an extended position. In the retracted position, the first extension member 604 is substantially within the hollow interior 606*d* of the second extension member 606, which in turn is substantially within the hollow interior 608*d* of the third extension member 608, as shown in FIG. 31A. Likewise, in a retracted position, the third boom member 680 is substantially within the hollow interior 670*g* of the second boom member 670, and the second boom 660 is within the hollow interior 660*g* of the first boom member 660. To move the crane arm 500 to the extended position, the selector 794 is moved to the intake position. Then, the crank 730 is turned. When the crank 730 is turned in a first turning direction, the clutch 740 causes the release shaft 722 to rotate, which in turn causes the rotating member 702 to rotate. As the rotating member 702 rotates, the cord 550 is unwound from the rotating member 702 and causes the hook 570 to be lowered.

Simultaneously, while the rotating member 702 rotates, the first driving shaft 714 orbits around the first axis, which causes the driver 760 to move in such a manner that the rotational motion of the crank 730 is transformed into linear motion (e.g., reciprocating motion). In turn, the driver 760 causes the piston 776 to move repeatedly from the first position to the second position, and from the second position to the first position. When the piston 776 is at the first position and moves along the telescopic axis in a first direction towards the second position, the piston 776 causes the air within the chamber 772 to be pushed towards the check valve 780. Because the cross-sectional area of the second chamber 774 is smaller than the cross-sectional area of the first chamber 772, the piston 776 exerts additional pressure onto the air from the first chamber 772 to the second chamber 774. Such exertion causes the air to have a pressure that is above or equal to the air pressure threshold. As such, the check valve 780 activates, thereby letting air pass through the check valve 780.

As discussed previously, because the check valve 780 is a single direction valve (i.e., the air passing through the check valve does not return in the opposite direction), there is no air (or very little air) remaining in the first chamber 772 after the air passes through the check valve 780. As a result, the air pressure inside the chamber 772 becomes less than the air pressure outside of the chamber 772. As such, air from outside the chamber 772 is drawn into the chamber 772 until the air pressure inside the chamber 778 is equal to the air pressure outside the chamber 772. By the same principle, as the piston 774 moves from the first position to the second position, more air from the outside comes in to the chamber 772 due to the volume of the chamber 772 increasing. As such, by continuously rotating the crank 730, air can be continuously pushed into the check valve 780, which in turn causes air to flow in one direction towards the extension arm 602. As air is being pumped into the extension arm 602, the pressure is built into the extension arm 602. As discussed previously, the release valve 628 is normally in a closed position. As such, the closed release valve 628, the extension arm 602 and the check valve 780 create an enclosed space in which air pressure can build up.

Figure 31B:
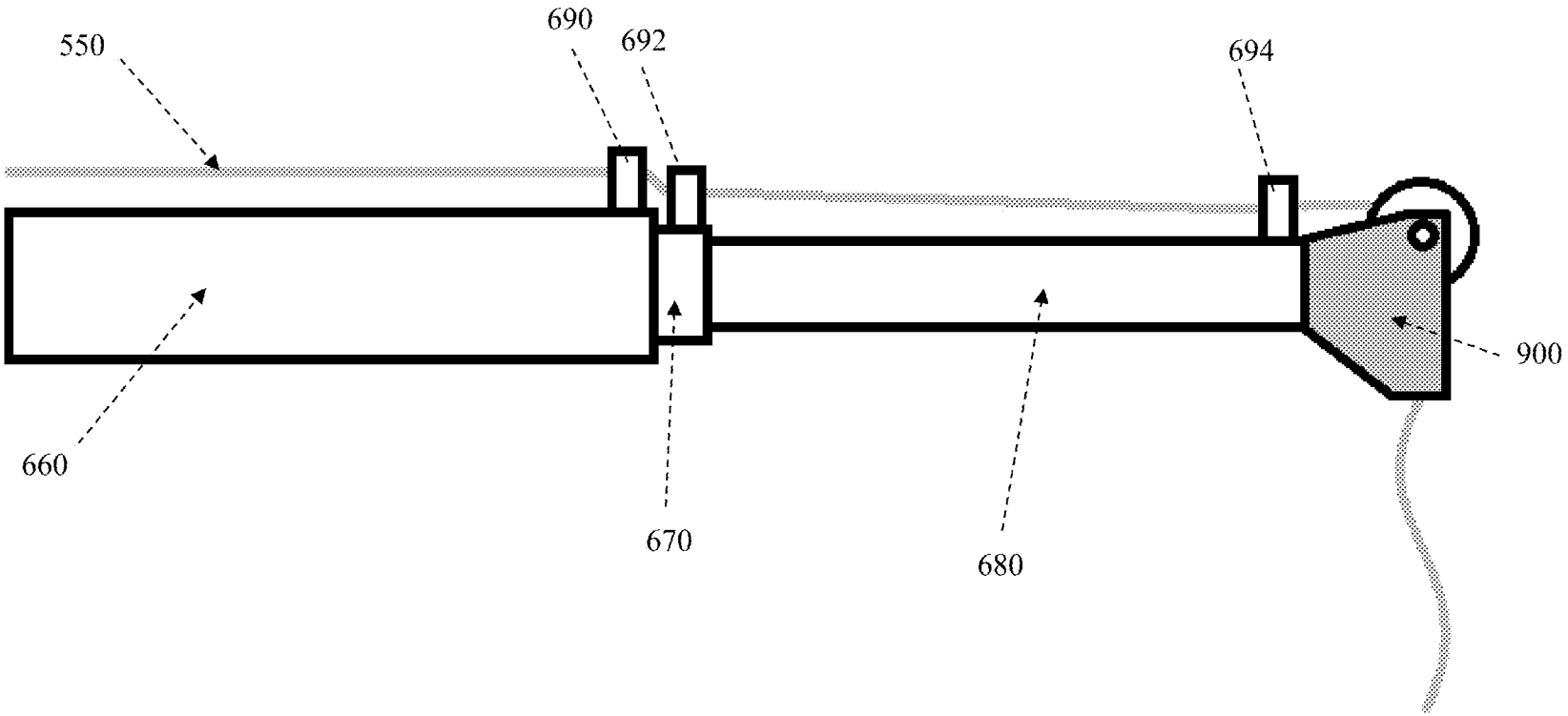

As the pressure increases in the extension arm 602, the third extension member 608 gradually moves from away from the second extension member 606. In other words, the third extension member telescopically extends away from the second extension member 606. As a result, the telescopic movement of the third extension member 606 also causes the third boom member 680 to telescopically extend away from the second boom member 660, while leaving the second boom member 660 in a static position. However, the movement of the third boom member 680 is limited by the interaction of the one or more grooves 680*j*, 680*k* with the one or more projections 670*h*, 670*i* of the second boom member 670. When the third boom member 680 slides away from the second boom member 670, the first end of the one or more grooves 680*j* eventually contacts the one or more projections 670*h*. Such contact prevents the third boom member 680 from moving any further with respect to the second boom member 670. Thus, the third boom member 680 has reached a final extended position, as shown in FIG. 31B. Similarly, the telescopic movement of the third extension member 606 also is limited by the interaction of the second blocking cap 624 of the second extension member 606 and the second blocking seal 626 of the third extension member 606. As discussed previously (and shown in FIGS. 14A and 14B), the second blocking seal 626 can be blocked by the second blocking cap 624, thereby preventing the third extension member 608 from being completely disconnected from the second extension member 606.

Figure 31C:
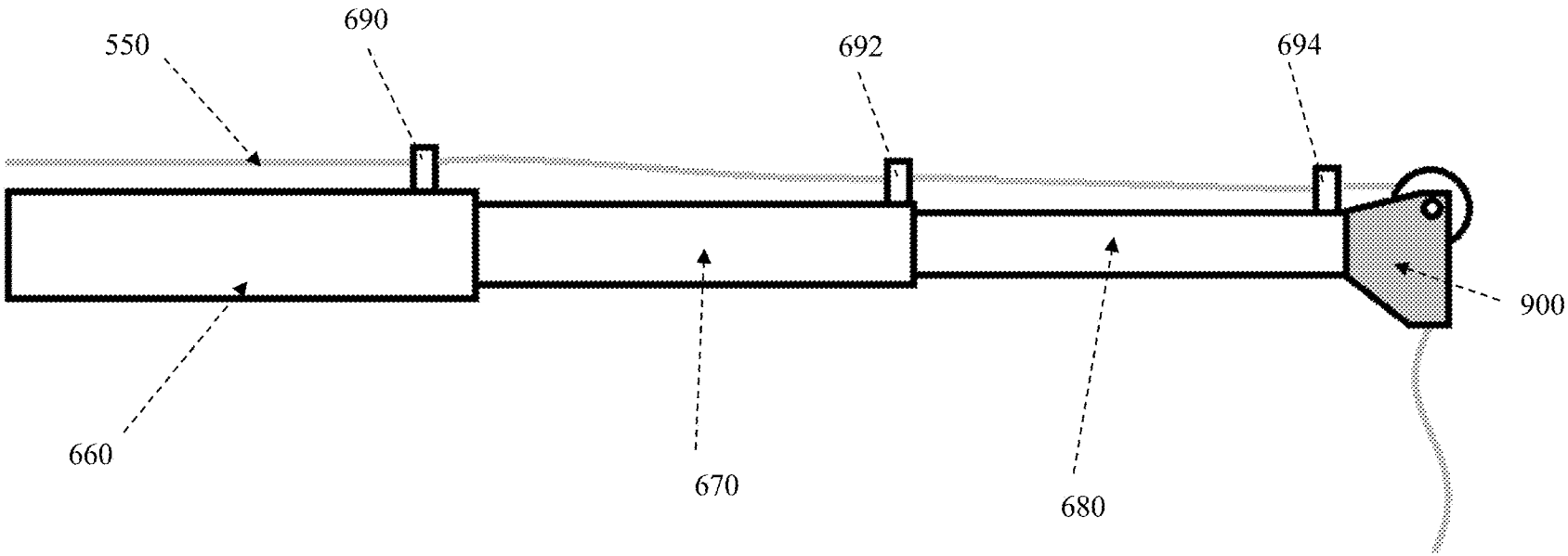

However, even though the third boom member 680 is at the final extended position, the second boom member 670 is still capable of moving. Because air is still being pumped into the extension arm 602, the air pressure within is still increasing. As such, the third extension member 608 (which is fixedly attached to the third boom member 680 via the release valve 628) causes the third boom member 680 to still move. However, as stated previously, because the third boom member 680 is in the final extended position, the third boom member 680 is unable to move with respect to the second boom member 670. Instead, the third boom member 680 pulls the second boom member 670 away from the first boom member 660. In other words, the third boom member 680 causes the second boom member 670 to telescopically extend away from first boom member 660. Like previously, the movement of the second boom member 670 is limited by the interaction of the one or more grooves 670*j* with the one or more projections 660*h* of the first boom member 660. When the second boom member 670 slides away from the first boom member 660, the first end of the one or more grooves 670*j*, 670*k* eventually contacts the one or more projections 660*h*, 660*i*. Such contact prevents the second boom member 670 from moving any further with respect to the first boom member 660. Thus, the second boom member 670 has reached a final extended position, as shown in FIG. 31C. As discussed previously (and shown in FIGS. 13A and 13B), the first blocking seal 622 can be blocked by the first blocking cap 620, thereby preventing the second extension member 606 from being completely disconnected from the first extension member 604. With each of the second boom member 670 and the third boom member 680 reaching the final extended position, the telescopic arm 600 is moved to an extended position, as shown in FIG. 31C. Due to the air pressure within the extension arm 602, the telescopic arm 600 maintains itself in the extended position. In other words, the telescopic arm 600 does not retract, and can resist retracting if, for example, a child tries to push in the arms to manually retract the telescopic arm 600 (i.e., without turning the crank in the opposite direction).

Figure 32A:
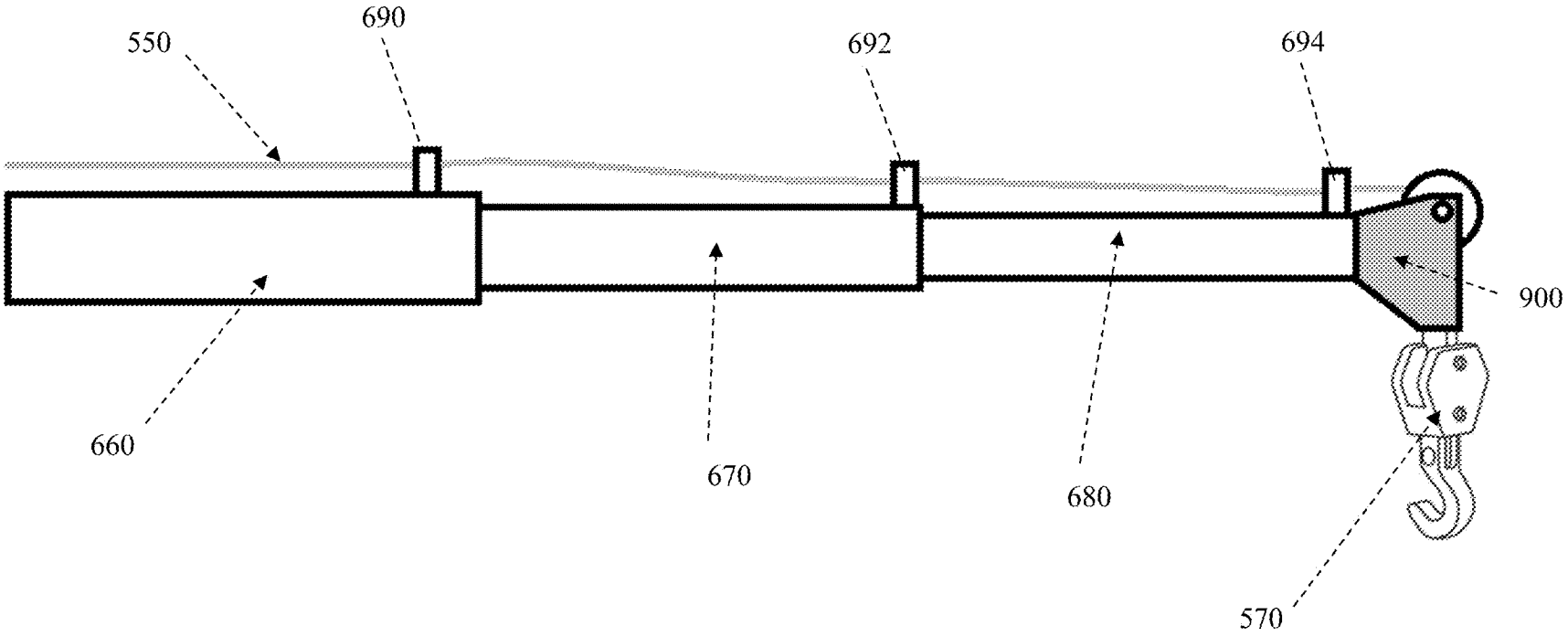
FIG. 32A-32C show the crane arm moving from an extended position to a retracted position.

The following is a process for causing the crane arm 500 to retract from an extended position to a retracted position, which is shown in FIG. 32A. To move the crane arm 500 to the retracted position, the selector 794 first is moved to the closing position. Then, the crank 730 is turned in a second turning direction. When the crank 730 is turned in the second turning direction, the clutch 740 causes the release shaft 722 to rotate, which in turn causes the rotating member 702 to rotate. As the rotating member 702 rotates, the cord 550 begins to wind around the rotating member (the spool) 702 and causes the hook 570 to be raised towards the air release mechanism 900. Simultaneously, while the rotating member 702 rotates, the first driving shaft 714 orbits around the first axis, which causes the driver 760 to move in such a manner that the rotational motion of the crank 730 is transformed into linear motion (e.g., reciprocating motion). Even though the rotating member 702 is rotating in a second turning direction, the driver 760 still causes the piston 776 to move repeatedly from the first position to the second position, and from the second position to the first position. However, because the selector 794 is in the closing position, air can no longer enter the first chamber 772 and second chamber 774 of the air pump 770. As such, no air is being pressed into the check valve 780. Thus, there is no increased air pressure within the extension arm 602.

Once the hook 570 contacts the release activator 902 (which is in the blocking position) the release activator 902 pivots towards the release pin 628*d* of the release valve 628, thereby causing the release pin 628*d* to move to a breaching position, as shown in FIGS. 30A and 30B. In other words, the release pin 628*d* no longer blocks the opening 628*f* of the release valve 628. As a result, air is released from the extension arm 602. Thus, the air pressure within the extension arm 602 starts to equate with the air pressure outside the extension arm 602. This allows the extension arm 602 to be capable of retracting (and by extension, the boom arm 650 is capable of retracting as well). In an exemplary embodiment, even though the air is released from the extension arm 602, the telescopic arm 600 may not necessarily retract automatically. The combination of the driving mechanism 700, the cord 550, the air release mechanism 900 and the hook 570 causes the telescopic arm 600 to retract. As discussed above, when the rotating member 702 rotates in the second turning direction (due to the rotation of the crank 730) the cord 550 begins to wind around the rotating member 702 and causes the hook 570 to be raised towards the air release mechanism 900. However, the release activator 902 of the air release mechanism 900 prevents the hook 570 from being raised any further. As a result, the continuous winding of the cord 550 causes the hook 570 to push the telescopic arm 600 to a retracted position.

Figure 32B:
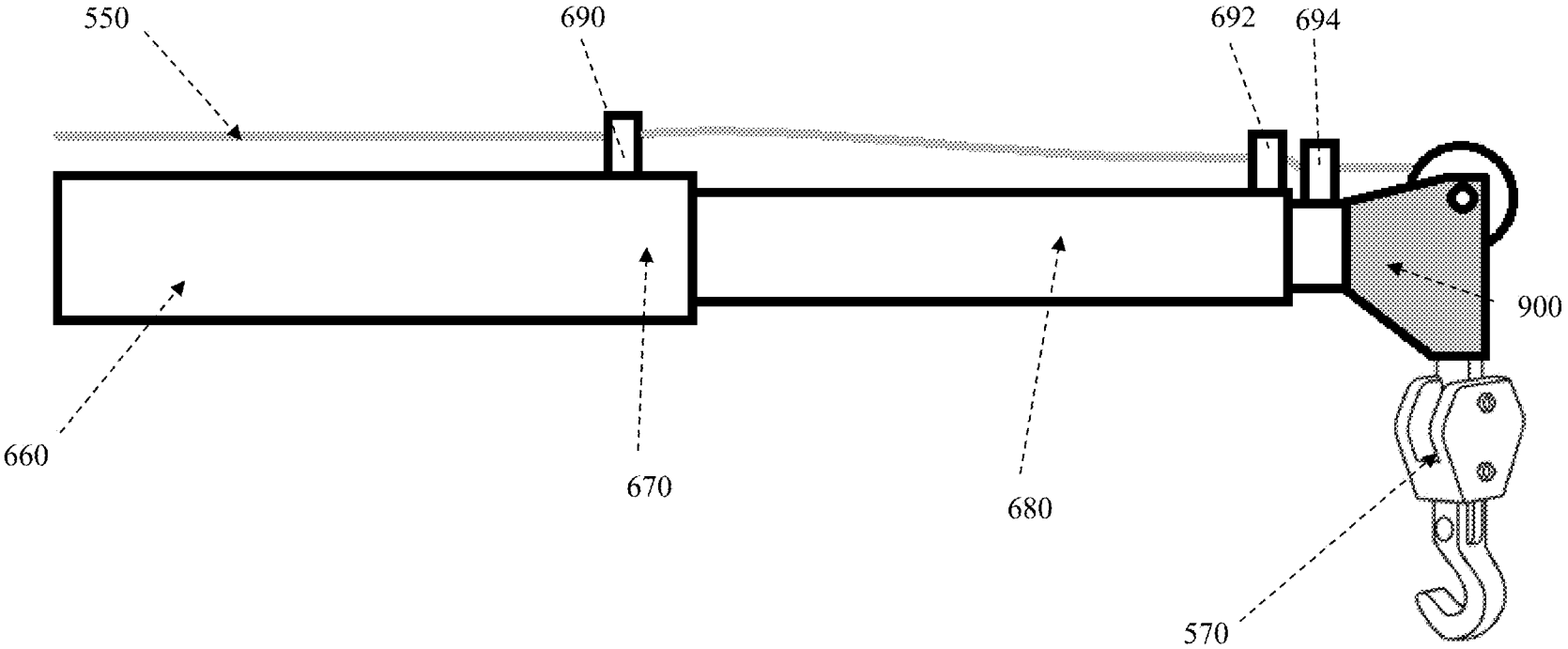

More specifically, the cord 550 causes the hook 570 to impart force upon the air release mechanism 900. Because the air release mechanism 900 is connected to the third boom member 680, the third boom member 680 (along with the third extension member 608) retracts. Such retracting movement of the third boom member 680 is limited by the interaction of the one or more grooves 680*j*, 680*k* with the one or more projections 670*h*, 670*i* of the second boom member 670. When the third boom member 680 slides away from the second boom member 670, the second end of the one or more grooves 680*j*, 680*k* eventually contacts the one or more projections 670*h*, 670*i*. Such contact prevents the third boom member 680 from moving any further with respect to the second boom member 670. Thus, the third boom member 680 has reached a final retracted position, as shown in FIG. 32B. As discussed previously (and shown in FIGS. 14C and 14D), the release valve 628 can be blocked by the second blocking cap 624, thereby preventing the second extension member 606 from exiting the third extension member 608 (via the first end 604*a* of the second extension member 606). As such, the aforementioned interaction between the release valve 629 and the second blocking cap 624 may also occur when the third boom member 680 has reached a final retracted position.

Figure 32C:
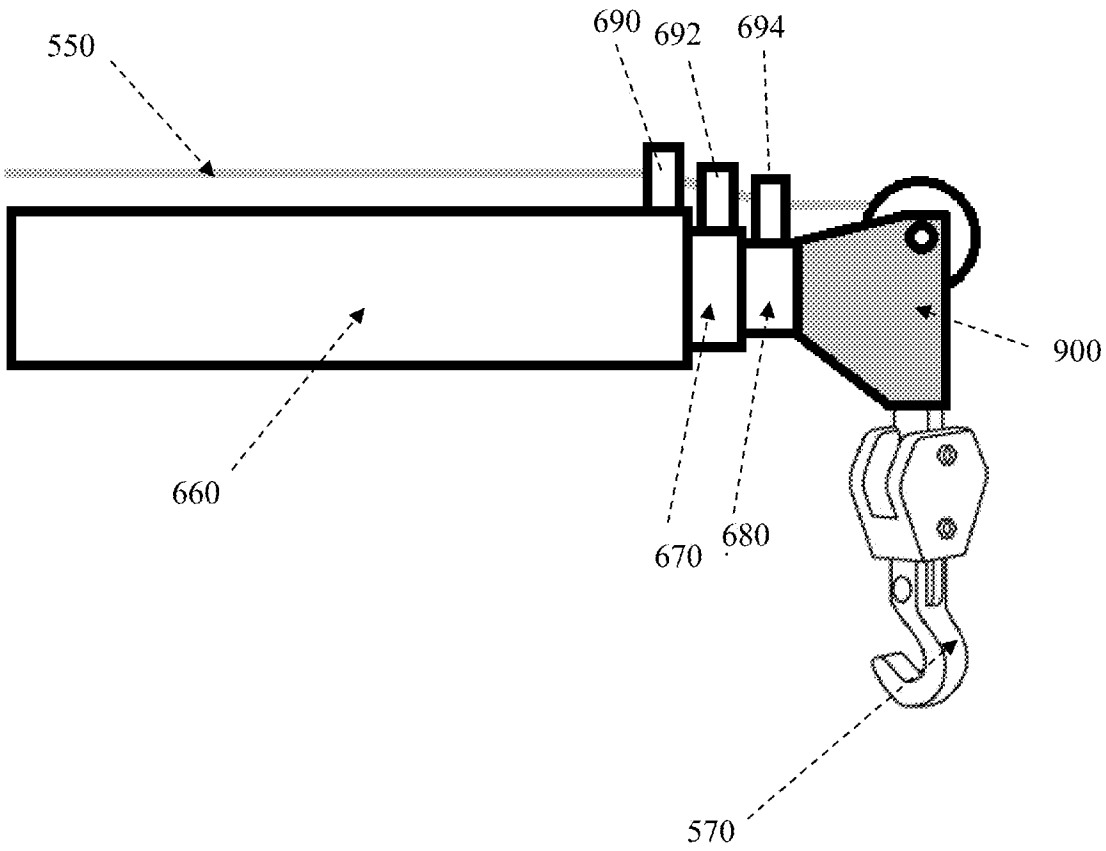

However, even though the third boom member 680 is not capable of moving with respect to the second boom member 670, once the third boom member 680 has reached the final retracted position, the third boom member 680 can still move with respect to the telescopic arm 600. The third boom member 680 pushes the second boom member 670 towards the first boom member 660. In other words, the third boom member 680 causes the second boom member 670 to telescopically retract towards the first boom member 660. Like previously, the movement of the second boom member 670 is limited by the interaction of the one or more grooves 670*j*, 670*k* with the one or more projections 660*h*, 660*i* of the first boom member 660. When the second boom member 670 slides towards the first boom member 660, the second end of the one or more grooves 670*j*, 670*k* eventually contacts the one or more projections 660*h*, 660*i*. Such contact prevents the second boom member 670 from moving any further with respect to the first boom member 660. Thus, the second boom member 670 has reached a final retracted position, as shown in FIG. 32C. As discussed previously (and shown in FIGS. 13C and 13D), the second blocking cap 624 can be blocked by the first blocking cap 620, thereby preventing the second extension member 606 from exiting the first extension member 604 (via the first end 604*a* of the first extension member 604). With each of the second boom member 670 and the third boom member 680 reaching the final retracted position, the telescopic arm 600 is moved to a retracted position, as shown in FIG. 32C.

Figure 33:
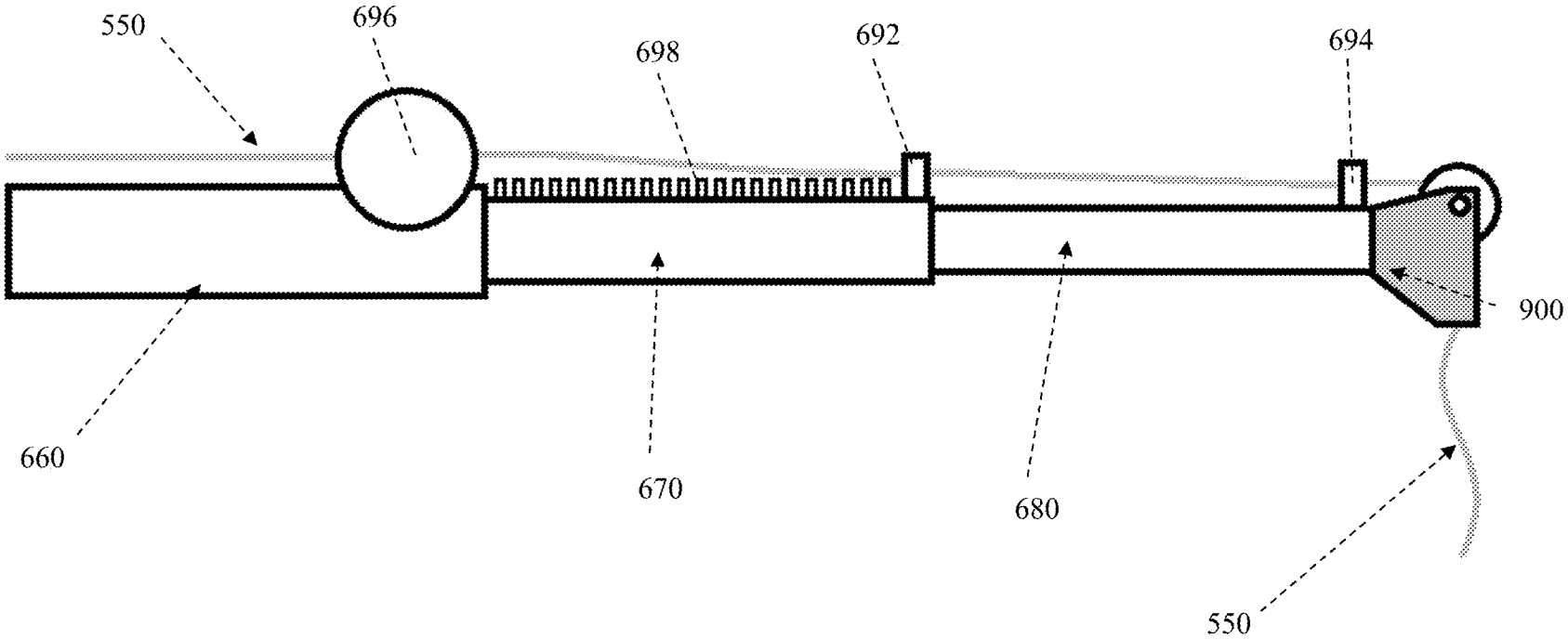
FIG. 33 shows the crane arm according to another exemplary embodiment.

It should be noted that the crane arm 500 may also and alternatively include a structure for manually causing the second boom member 670 to extend away from (or retract towards) the first boom member 660, as shown in FIG. 33. For example, the first boom member 660 may include a knob 696 that is attached to a circular gear (pinion) that drives a linear gear (rack) 698. The gear 698 is on the top surface 670*c* of the second boom member 670. As such, when the knob 696 is turned in a first direction, the second boom member 670 may extend away from the first boom member 660. Likewise, in the case that the knob 696 is turned in a second direction, the second boom member 670 may retract towards the first boom member 660. However, in the case that there is air pressure within the extension arm 602 that resists the retraction of the second boom member 670, the second boom member 670 may not be capable of retracting.

The aforementioned specific embodiments are illustrative, and many variations can be introduced on these embodiments without departing from the spirit of the disclosure or from the scope of the appended claims. Further, different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

What is claimed is:

1. An extendable crane arm mechanism for a toy truck having a flatbed section, the extendable crane arm mechanism comprising:

a plurality of telescopic extension members, at least one of said telescopic extension members being slidably held within a hollow interior of an adjacent telescopic extension member, the plurality of extension members together being capable of moving from a retracted position to an extended length projecting position;

said extension members providing and defining a closed air channel from a first proximal one of said extension members with respect to said flatbed section to a second and distal one of said extension members with respect to said flatbed section and having a one way valve for selectively maintaining air within said closed air channel when air is pumped therein;

a plurality of individual boom members, said plurality of boom members being slidable over and holding said extension members;

said plurality of boom members also being capable of moving from a retracted position to an extended position with respect to said flatbed section;

an operable air pump to press air into said plurality of extension members to telescopically move from the retracted position to the extended position wherein a winding mechanism is also provided to said air pump, such that rotation of said winding mechanism causes said air pump to repeatedly press air into said plurality of extension members, said winding mechanism also comprising a winding spool attached to a first end of a length of cord, said cord having a second and distal end, wherein said cord is capable of being wound or unwound around said winding spool, and a hand crank attached to said winding mechanism, wherein rotation of said crank in a first direction causes the plurality of extension members to move from the retracted position to the extended position and causes said cord to unwind from around the winding spool, and wherein rotation of the crank in a second direction causes the plurality of extension members to move from the extended position to the retracted position as said cord rewinds around said winding spool.

2. The extendable crane arm mechanism according to claim 1 further comprising:

a hook mechanism having a distal hook shape that is attached to said second and distal end of said cord.

3. The extendable crane arm mechanism according to claim 1, wherein the plurality of extension members also include a release valve that is capable of activating to release air from within the plurality of extension members, thereby permitting the plurality of extension members to move from an extended position to a retracted position.

4. The extendable crane arm mechanism according to claim 3, wherein the release valve includes a release pin that facilitates the release valve releasing air when the release pin is moved from a non-releasing position to a releasing position, the release pin being connected to a biasing spring that tends to maintain the release pin in a non-releasing position.

5. The extendable crane arm mechanism according to claim 1, wherein the extended movement of the plurality of extension members from the retracted position to the extended position also causes the movement of the plurality of boom members from the retracted position to the extended position.

6. A toy truck comprising:

a cab and a flatbed body and a set of wheels for supporting said cab and said flatbed body; and an extendable crane arm mechanism connected to the flatbed body, the extendable crane arm mechanism comprising:

a plurality of extension members each having two opposed ends, a first of said extension members being secured on a first of its two ends to said flatbed body and the second of said ends being outwardly projected, with additional extension members being connected to the first of said extension members to define a set of adjacent extension members distal of said first extension member, each of the plurality of distal extension members being telescopically slidably held within a hollow interior of an adjacent extension member, the plurality of distal extension members being capable of moving from a retracted position to an extended position with respect to said flatbed body, said extension members having a continuous sealed interior air chamber;

a plurality of boom members, with at least one of said boom members being telescopically slidably held within a hollow interior of an adjacent boom member, the plurality of boom members being capable of moving from a retracted position to an extended position with respect to said flatbed body and supporting said extension members during extension thereof;

an air pump attached to said air chamber of said extension members which can be operated to provide air into said air chamber to cause the plurality of extension members to move from the retracted position to the extended position, wherein the extendable crane arm mechanism further comprises a hand crank attached to a spool wherein manual rotation of said crank in a first direction causes air to flow into said air chamber of said extension members and results in extension of said crane arm and movement of said distal extension members from their retracted position to their extended position and also causes a cord to unwind from around said spool and wherein rotation of said crank in a second direction causes the plurality of said distal extension members to move from their extended position to their retracted position and also causes said cord to wind around said spool.

7. The toy truck according to claim 6, wherein the extendable crane arm mechanism further comprises a check valve disposed between the air pump and, said air chamber so as to permit air flowing into the plurality of extension members from flowing in reverse towards said air pump, thereby maintaining air pressure within the plurality of distal extension members, and preventing the plurality of distal extension members from unintentionally moving from an extended position to a retracted position.

8. The toy truck according to claim 7, wherein the plurality of extension members further include a release valve that is capable of being activated to release air from within said air chamber, thereby permitting the plurality of distal extension members to deliberately move from an extended position to a retracted position.

9. The toy truck according to claim 8, wherein said release valve includes a release pin that causes activation of said release valve for releasing air when said release pin is moved from a non-releasing position to a releasing position, said release pin being connected to a biased spring that maintains said release pin in an initial, non-releasing position.

10. The toy truck as claimed in claim 8 wherein said cord is provided with a mechanism such that when a sufficient length of cord is wound around said spool as a consequence of turning said crank, said release valve opening to release air to facilitate the retraction of said distal extension arms and said plurality of boom members.

* * * * *